US010069243B2

(12) United States Patent
Neu et al.

(10) Patent No.: US 10,069,243 B2
(45) Date of Patent: Sep. 4, 2018

(54) BOARD MOUNT ELECTRICAL CONNECTOR ASSEMBLY

(71) Applicant: 3M INNOVATIVE PROPERTIES COMPANY, St. Paul, MN (US)

(72) Inventors: Steven A. Neu, Cedar Park, TX (US); Alexander R. Mathews, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/434,337

(22) PCT Filed: Jul. 28, 2014

(86) PCT No.: PCT/US2014/048348
§ 371 (c)(1),
(2) Date: Apr. 8, 2015

(87) PCT Pub. No.: WO2015/017298
PCT Pub. Date: Feb. 5, 2015

(65) Prior Publication Data

US 2016/0134034 A1 May 12, 2016

Related U.S. Application Data

(60) Provisional application No. 61/860,540, filed on Jul. 31, 2013.

(51) Int. Cl.
*H01R 13/633* (2006.01)
*H01R 13/629* (2006.01)
(Continued)

(52) U.S. Cl.
CPC ..... *H01R 13/62977* (2013.01); *H01R 4/24* (2013.01); *H01R 12/7005* (2013.01);
(Continued)

(58) Field of Classification Search
CPC ..... H01R 12/675; H01R 12/7005; H01R 13/633; H01R 13/629; H01R 13/639;
(Continued)

(56) References Cited

U.S. PATENT DOCUMENTS 4,006,957 A * 2/1977 Narozny ..... H01R 12/675 439/405
4,068,912 A 1/1978 Hudson et al.
(Continued)

FOREIGN PATENT DOCUMENTS

EP 1 653 566 B1 6/2008
JP S54-102687 12/1977
(Continued)

OTHER PUBLICATIONS

PCT International Search Report for PCT/US2014/048348 dated Oct. 21, 2014, 5 pages.

*Primary Examiner* — Michael A Lyons
*Assistant Examiner* — Matthew T Dzierzynski
(74) *Attorney, Agent, or Firm* — Robert S. Moshrefzadeh

(57) ABSTRACT

A board mount electrical connector (3) includes an insulative connector housing (1100) including a longitudinal bottom wall (1102) defining a plurality of contact openings (1104) for receiving a plurality of contacts (1200), first and second side walls (1106, 1108) extending upwardly from the bottom wall at opposing sides thereof, first and second end walls (1110, 1112) extending upwardly from the bottom wall at opposing ends (1102*c*, 1102*d*) thereof, first and second pairs of latch openings (1114, 1116) at opposing ends of the bottom wall, and first and second protrusions (1154, 1156) extending upwardly from the bottom wall and disposed between respective first and second pairs of latch openings. Each latch opening extends through the bottom wall and through a side wall and is configured to allow a latch to eject a mating connector by moving within the opening. Each of
(Continued)

the protrusions is configured to engage a corresponding opening in a latch of a mating connector cover or strain relief assembled to the electrical connector.

10 Claims, 29 Drawing Sheets

(51) Int. Cl.

| | |
|---|---|
| ***H01R 4/24*** | (2018.01) |
| ***H01R 13/62*** | (2006.01) |
| ***H01R 13/58*** | (2006.01) |
| ***H01R 13/639*** | (2006.01) |
| *H01R 12/79* | (2011.01) |
| *H01R 12/67* | (2011.01) |
| *H01R 12/70* | (2011.01) |

(52) U.S. Cl.
CPC ..... *H01R 13/5804* (2013.01); *H01R 13/62* (2013.01); *H01R 13/633* (2013.01); *H01R 13/639* (2013.01); *H01R 13/6335* (2013.01); *H01R 12/675* (2013.01); *H01R 12/7029* (2013.01); *H01R 12/79* (2013.01)

(58) Field of Classification Search
CPC .. H01R 23/66; H01R 13/6273; H01R 12/772; H01R 13/501; H01R 13/6271; H01R 13/62966; H01R 13/62994
See application file for complete search history.

(56) References Cited

U.S. PATENT DOCUMENTS 4,070,081 A * 1/1978 Takahashi ..... H01R 13/629 361/759
4,178,051 A * 12/1979 Kocher ..... H01R 13/633 439/157
4,241,966 A * 12/1980 Gomez ..... H01R 12/7005 439/157
4,341,428 A * 7/1982 Hatch ..... H01R 13/6456 439/157
4,410,222 A 10/1983 Enomoto et al.
4,447,101 A * 5/1984 Gugliotti ..... H01R 13/633 439/153
4,531,795 A * 7/1985 Sinclair ..... H01R 13/633 439/152
4,579,408 A * 4/1986 Sasaki ..... H01R 13/62994 439/153
4,668,039 A 5/1987 Marzili
4,761,141 A * 8/1988 Hawk ..... H01R 13/6275 439/153
4,973,255 A * 11/1990 Rudoy ..... H01R 13/62994 439/157
5,108,298 A 4/1992 Simmel
5,338,220 A 8/1994 Soes et al.
5,389,000 A * 2/1995 DiViesti ..... H01R 12/7005 439/157
5,498,172 A 3/1996 Noda
5,571,025 A * 11/1996 Arai ..... H01R 12/7005 439/160
5,588,858 A 12/1996 Lester et al.
5,672,072 A * 9/1997 Arai ..... H01R 12/7005 439/160
5,746,613 A * 5/1998 Cheng ..... H01R 12/7005 439/157
5,980,303 A 11/1999 Lee et al.
6,036,531 A * 3/2000 Lee ..... H01R 12/675 439/405
6,322,388 B1 * 11/2001 Akio ..... H01R 13/5812 439/459
6,328,592 B1 12/2001 Burke et al.
6,780,045 B2 8/2004 Shuey et al.
6,893,277 B2 5/2005 Parrish et al.
7,156,686 B1 1/2007 Sekela et al.
7,163,414 B2 1/2007 Lo et al.
7,234,962 B1 6/2007 Lin
7,530,827 B2 5/2009 Caveney et al.
9,537,236 B2 1/2017 Neu
2012/0090866 A1 4/2012 Gundel
2012/0090872 A1 4/2012 Gundel
2012/0090873 A1 4/2012 Gundel
2012/0097421 A1 4/2012 Gundel
2014/0370734 A1 12/2014 Mathews et al.

FOREIGN PATENT DOCUMENTS

| | | |
|---|---|---|
| JP | S59-182887 U | 12/1984 |
| JP | H07-036368 | 7/1995 |
| JP | H08-124612 | 5/1996 |
| JP | H09-55249 | 2/1997 |
| JP | 2002-343518 | 11/2001 |
| WO | WO 2013/119522 | 8/2013 |

* cited by examiner

BOARD MOUNT ELECTRICAL CONNECTOR ASSEMBLY

TECHNICAL FIELD

The present disclosure relates generally to interconnections made between a printed circuit board and an electrical cable carrying signals to and from the printed circuit board. More particularly, the present disclosure relates to an electrical connector system including an electrical connector for assembly to a printed circuit board and a mating electrical connector for assembly to an electrical cable to facilitate these interconnections.

BACKGROUND

Interconnection between printed circuit boards and electrical cables is known in the art. Such interconnections typically have not been difficult to form, especially when the signal line densities have been relatively low. As user requirements grow more demanding with respect to interconnect sizes, the design and manufacture of interconnects that can perform satisfactorily in terms of physical size has grown more difficult.

A typical method of reducing the interconnect size is to reduce its contact-to-contact spacing, typically referred to as contact pitch. For example, compared to a 0.100" (2.54 mm) pitch interconnect, a 0.050" (1.27 mm) pitch interconnect can provide the same number of electrical connections (i.e., contacts) in half the space. However, typical solutions of smaller pitch interconnects are merely scaled down versions of larger pitch interconnects. These scaled down versions typically have a large overall interconnect size relative to the contact pitch, especially when additional components such as, e.g., a latching/ejecting mechanism or a cable strain relief, are included, are prone to mechanical and electrical reliability issues, are inherently expensive to manufacture, and offer limited to no customization to meet specific end user needs.

Therefore, there is a need in the art for an electrical connector system which can overcome the disadvantages of conventional connector systems.

SUMMARY

In at least one aspect, the present disclosure provides an electrical connector including an insulative connector housing. The connector housing includes a longitudinal bottom wall defining a plurality of contact openings for receiving a plurality of contacts, first and second side walls extending upwardly from the bottom wall at opposing sides of the bottom wall, first and second end walls extending upwardly from the bottom wall at opposing ends of the bottom wall, first and second pairs of latch openings at opposing ends of the bottom wall, and first and second protrusions extending upwardly from the bottom wall and disposed between respective first and second pairs of latch openings. Each latch opening extends through the bottom wall and through a side wall and is configured to allow a latch to eject a mating connector by moving within the opening. Each of the protrusions is configured to engage a corresponding opening in a latch of a mating connector cover or strain relief assembled to the electrical connector.

In at least one aspect, the present disclosure provides a strain relief for an electrical cable, including a longitudinal base portion and first and second opposing strain relief latches extending from opposing lateral sides of the base portion. Each latch includes a curved connecting portion extending from a lateral side of the base portion first curving upwardly and then curving downwardly and terminating at an arm portion that extends downwardly. The arm portion is configured to resiliently deflect outwardly to accommodate secure attachment of the strain relief to an electrical connector. The arm portion includes an opening configured to receive a corresponding protrusion of an insulative connector housing of the electrical connector.

In at least one aspect, the present disclosure provides a cover for an electrical connector, including a longitudinal body portion extending along a first direction and first and second cover latches extending from opposing longitudinal ends thereof in a second direction different than the first direction. Each cover latch includes at least one ridge disposed on a side surface thereof and extending in the second direction for guiding the cover latch along a ridge of a connector housing, at least one first catch portion disposed on the side surface at an end distant from the body portion for being deflected by and engaging the ridge of the connector housing to secure the cover with respect to the connector housing, and an opening configured to receive a corresponding protrusion of the connector housing.

At least one aspect of the present disclosure features a latch for securing and ejecting a mating connector from a connector housing. The latch includes a hinge portion configured to pivotably attach the latch to a connector housing, an arm portion extending from a first side of the hinge portion along a first direction, a pair of discrete spaced apart hinge arms extending from an opposite second side of the hinge portion along a second direction different than the first direction, and an actuation portion extending from the arm portion along a fourth direction different than the first direction and adapted to be pushed by a user to actuate the latch. The hinge arms are configured to eject the mating connector through a pair of corresponding spaced apart latch openings extending through a bottom wall and through side walls of the connector housing. An actuation angle between the arm portion and the actuation portion is equal to or less than 90°.

In at least one aspect, the present disclosure provides an electrical connector including an insulative longitudinal base defining a plurality of contact openings extending therein in a vertical direction for supporting a plurality of insulation displacement contact (IDC) terminals and an insulative longitudinal cover disposed on the base and including a plurality of second wire positioning features disposed on a bottom surface thereof. The base includes a plurality of first wire positioning features disposed on a top surface thereof and positioned near the contact openings. The plurality of first wire positioning features and the plurality of second wire positioning features define pairs of wire positioning features along the vertical direction. Each pair of wire positioning features is adapted to receive and position a wire and includes a first wire positioning feature and a corresponding second wire positioning feature. At least one wire positioning feature disposed on one of the top and bottom surfaces is vertically offset relative to at least one other wire positioning feature disposed on the same surface.

In at least one aspect, the present disclosure provides an electrical connector defining a plurality of discrete spaced apart wire positioning openings extending therein in a horizontal direction for receiving and securing a plurality of wires, and a plurality of discrete spaced apart contact openings extending therein in a vertical direction for receiving a plurality of insulation displacement contact (IDC) terminals. Each wire positioning opening corresponds to and is in registration with a different corresponding contact opening. An IDC terminal received in a contact opening is adapted to make contact with a conductive core of a wire received and secured in a wire positioning opening corresponding to the contact opening. At least one wire positioning opening is vertically offset relative to at least one other wire positioning opening.

The above summary of the present invention is not intended to describe each disclosed embodiment or every implementation of the present invention. The details of one or more embodiments of the present invention are set forth in the accompanying drawings and the detailed description below. Other features, objects, and advantages of the invention will be apparent from the detailed description and drawings, and from the claims.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Figure 1:
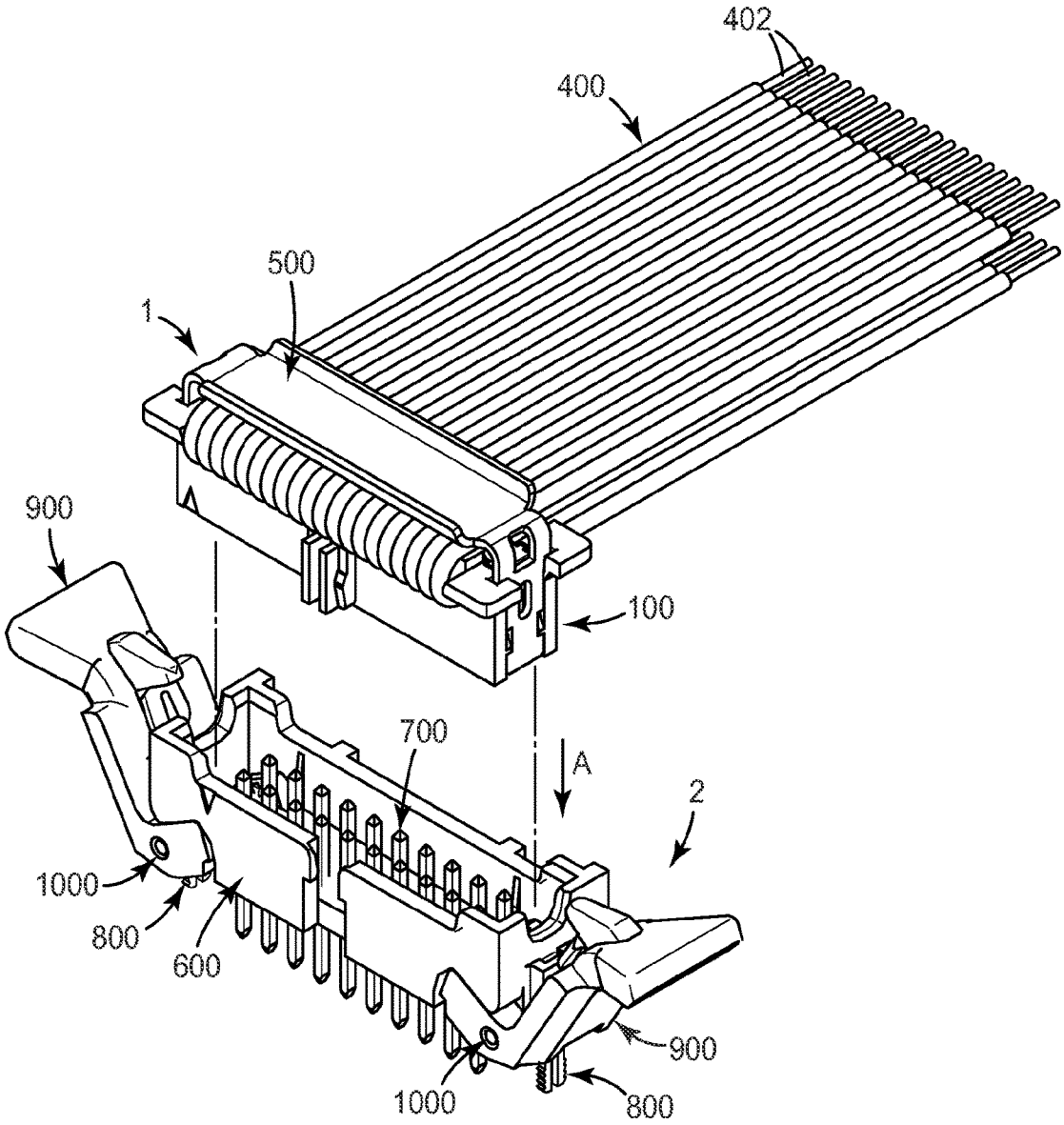
FIG. 1 is a perspective view of an exemplary embodiment of an electrical connector system according to an aspect of the present disclosure in an unmated configuration.

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present disclosure. The following detailed description, therefore, is not to be taken in a limiting sense, and the scope of the invention is defined by the appended claims.

In the illustrated embodiments, directional representations, i.e., up, down, left, right, front, rear and the like, used for explaining the structure and movement of the various elements of the present application, are relative. These representations are appropriate when the elements are in the position shown in the Figures. If the description of the position of the elements changes, however, it is assumed that these representations are to be changed accordingly. Throughout the Figures, like reference numbers denote like parts.

Exemplary embodiments of an electrical connector system according to aspects of the present disclosure have numerous advantages over conventional connector systems. Advantages include 1) a connector housing of a mating electrical connector (which may in some embodiments be referred to as "socket" or "wire mount electrical connector") which includes guiding, positioning, and securing elements to enable assembly of a cover and a strain relief in a reduced space, 2) an electrical contact terminal which provides an increased spring beam length, a reduced localized stress, and an increased spring force for a given overall contact height enabling a lower overall connector height, 3) a cover which includes guiding, positioning, and securing elements to enable assembly to a connector housing of a mating electrical connector while occupying a minimized space of the connector, 4) a strain relief which includes guiding, positioning, and securing elements to enable assembly to a connector housing of a mating electrical connector while occupying a minimized space of the connector, 5) a connector housing of an electrical connector (which may in some embodiments be referred to as "header" or "board mount electrical connector") which enables blind mating of a mating electrical connector and has a significantly reduced overall connector size relative to the contact pitch, and 6) a latch which can both securely latch a mating electrical connector to a connector housing of an electrical connector and eject the mating electrical connector from the connector housing with or without the presence of a strain relief, and which is integrated with the connector housing such as to minimize the overall connector size relative to the contact pitch, to name a few. Further advantages will be described herein throughout.

Principles and elements of the exemplary embodiments of an electrical connector system described herein and variations thereof allow electrical connector systems to be made smaller, more reliable, and at a lower cost. These principles and elements may be applied to any suitable electrical connector system, such as, e.g., 2.0 mm, 0.050" (1.27 mm), 1.0 mm, 0.8 mm, and 0.5 mm pitch wire-to-board sockets and headers, to name a few.

Figure 2:
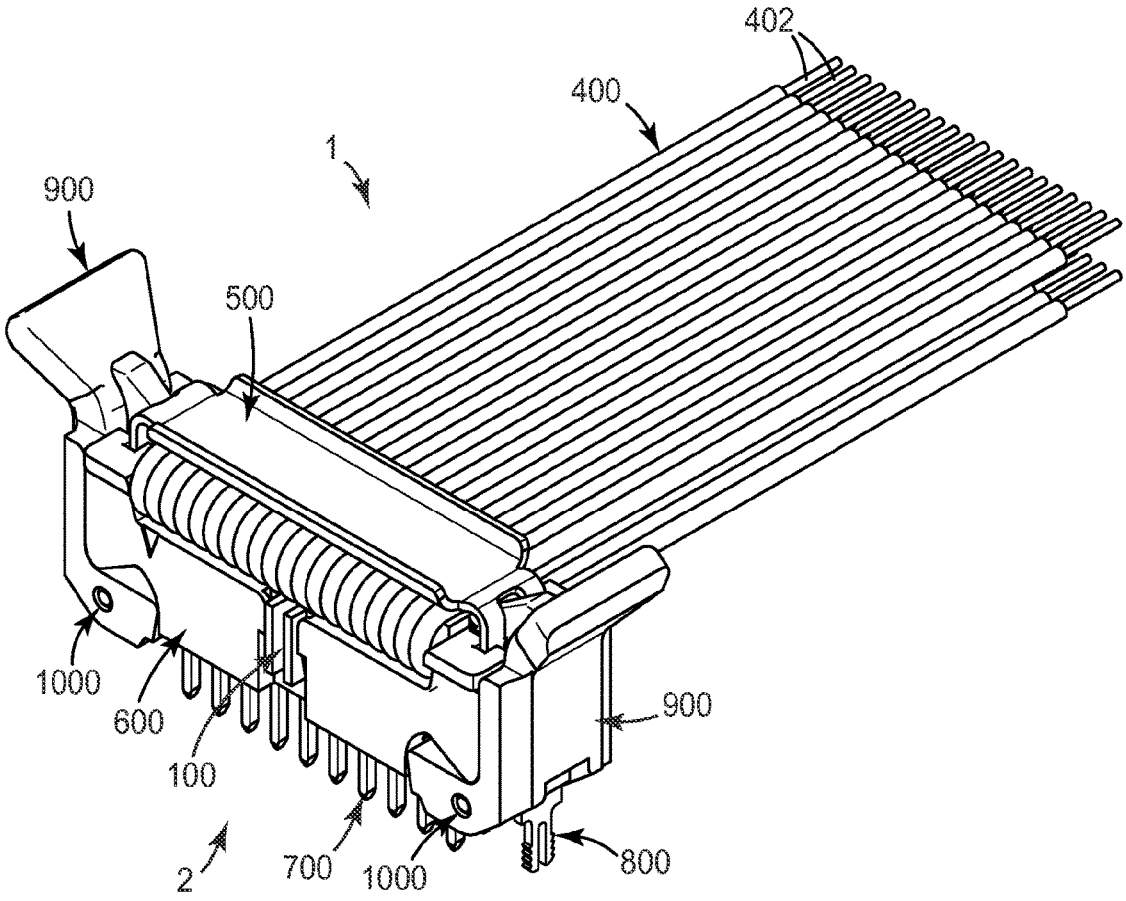
FIG. 2 is a perspective view of an exemplary embodiment of an electrical connector system according to an aspect of the present disclosure in a mated configuration.
Figure 3:
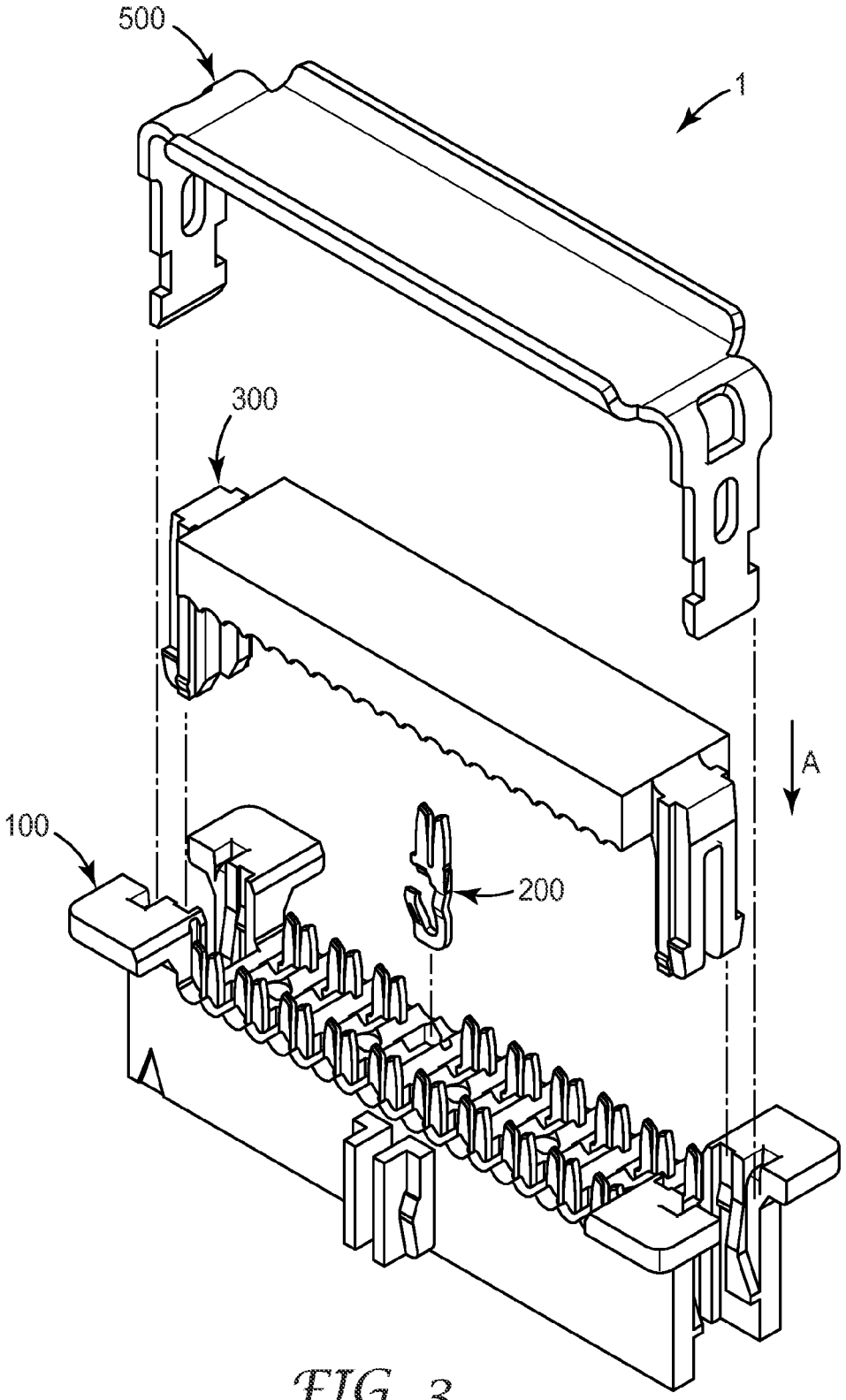
FIG. 3 is an exploded perspective view of an exemplary embodiment of a mating electrical connector according to an aspect of the present disclosure.

Referring now to the Figures, FIGS. 1-2 illustrate an exemplary embodiment of an electrical connector system according to an aspect of the present disclosure in an unmated configuration (FIG. 1) and in a mated configuration (FIG. 2). The electrical connector system includes a mating electrical connector 1 (which may in some embodiments be referred to as "socket" or "wire mount electrical connector") configured for mating with an electrical connector 2 (which may in some embodiments be referred to as "header" or "board mount electrical connector"). FIG. 3 illustrates an exemplary embodiment of a mating electrical connector according to an aspect of the present disclosure. Referring to FIG. 3, mating electrical connector 1 includes an insulative connector housing 100, a plurality of electrical contact terminals 200 supported in connector housing 100, and a cover 300 for attachment to connector housing 100. In at least one embodiment, mating electrical connector 1 further includes a strain relief 500 for attachment to connector housing 100.

Figure 4A:
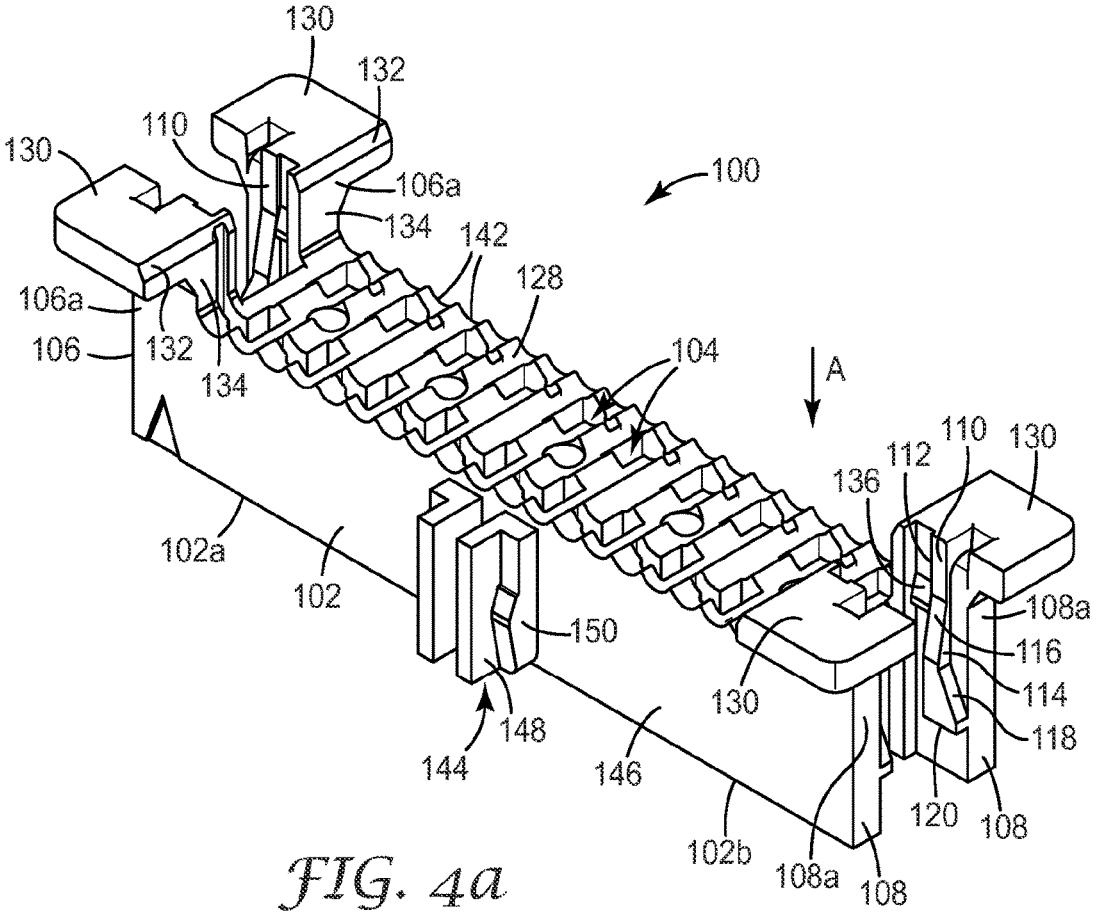
FIGS. 4*a*-4*e* are perspective, front, side, top, and bottom views, respectively, of an exemplary embodiment of a connector housing according to an aspect of the present disclosure.
Figure 4B:
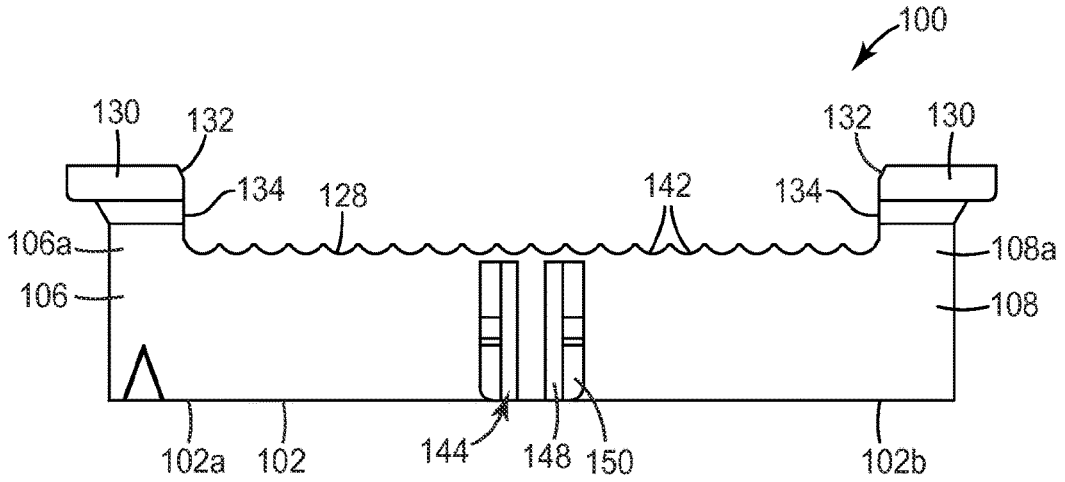
Figure 4C:
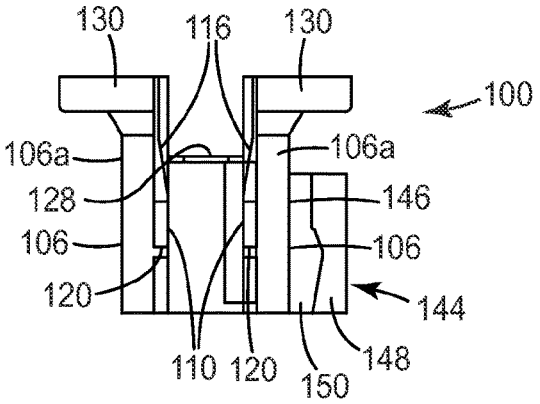
Figure 4D:
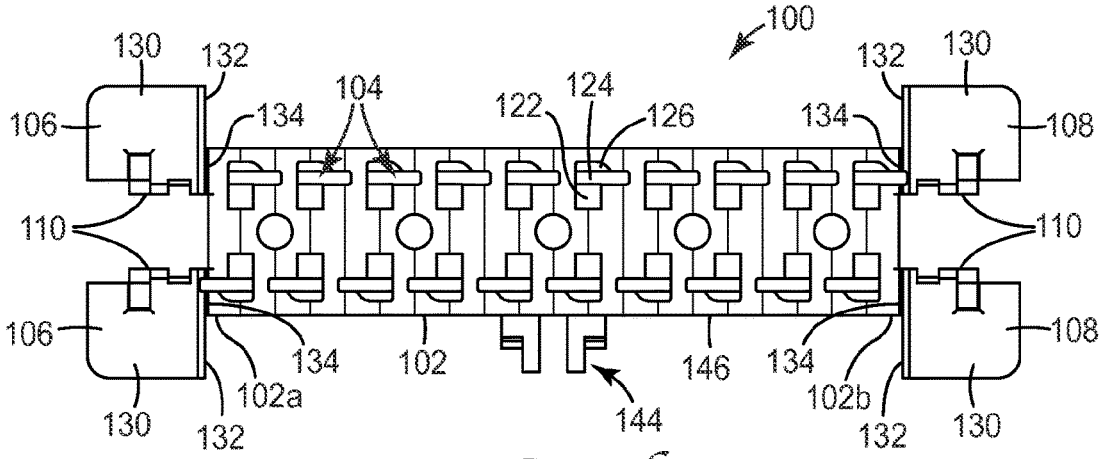
Figure 4E:
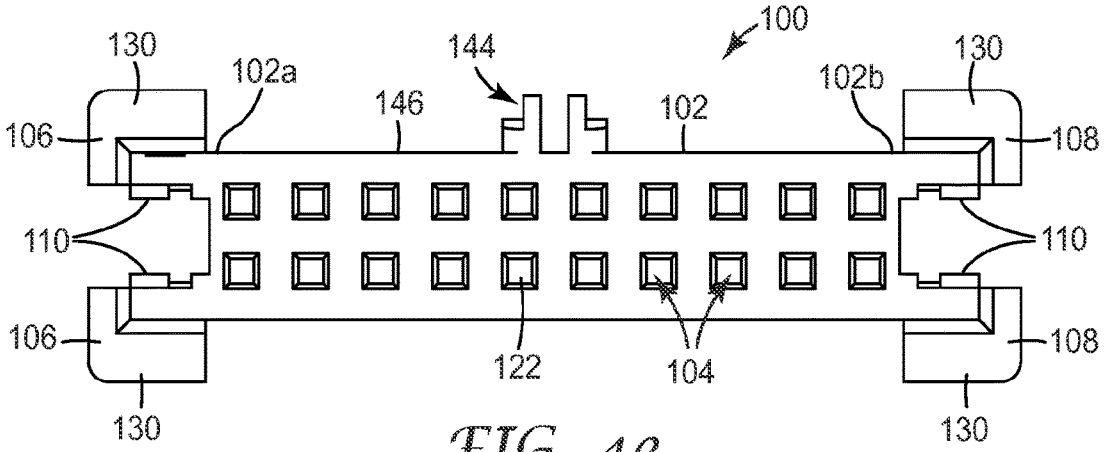
Figure 5A:
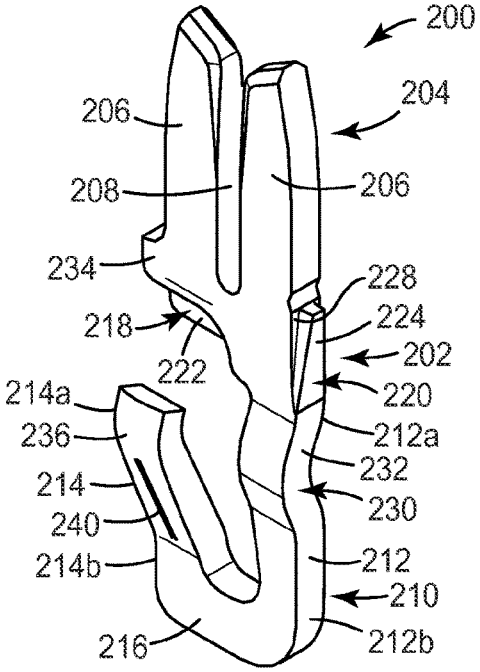
FIGS. 5*a*-5*c* are perspective, side, and front views, respectively, of an exemplary embodiment of an electrical contact terminal according to an aspect of the present disclosure.
Figure 5B:
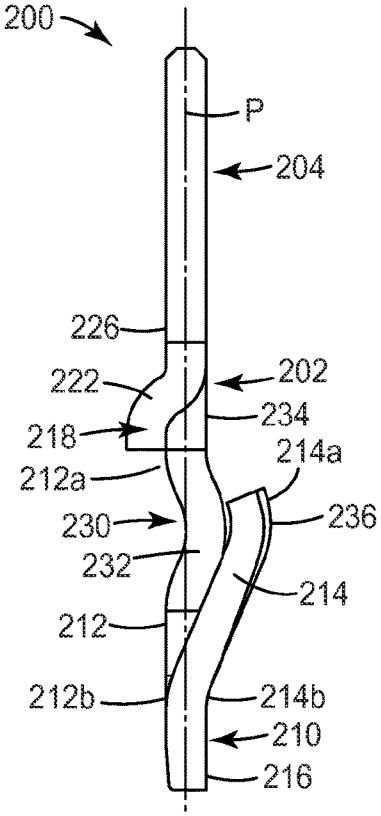
Figure 5C:
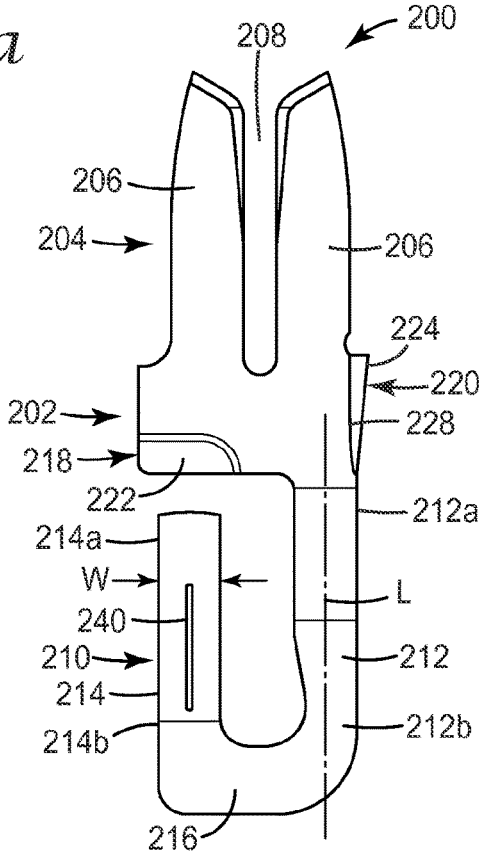
Figure 14:
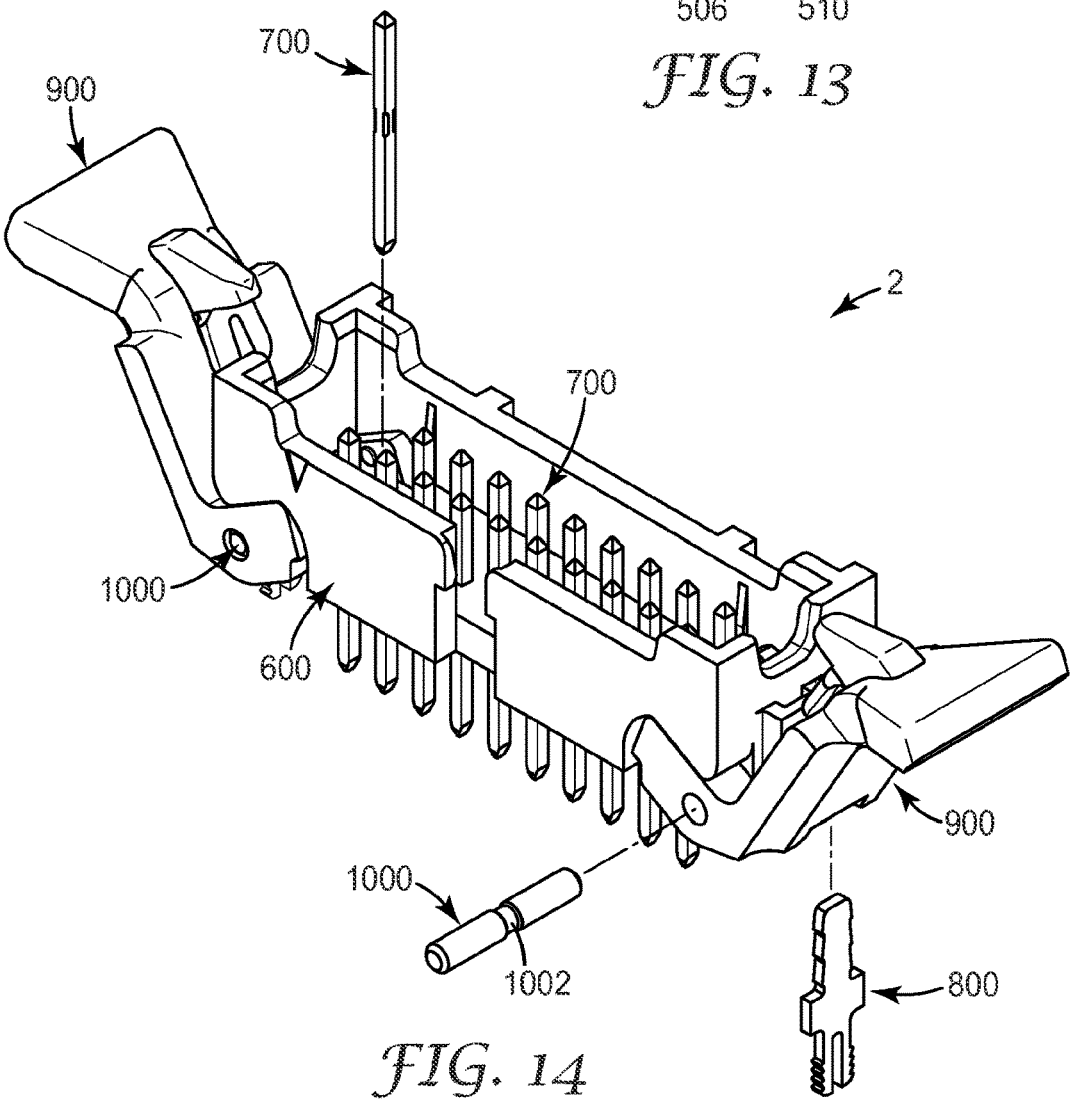
FIG. 14 is an exploded perspective view of an exemplary embodiment of an electrical connector according to an aspect of the present disclosure.

FIGS. 4*a*-4*e* illustrate an exemplary embodiment of a connector housing according to an aspect of the present disclosure. Referring to FIGS. 4*a*-4*e*, insulative connector housing 100 includes a longitudinal body portion 102 having a plurality of contact openings 104 extending therein in an insertion direction A. Contact openings 104 are configured to support a plurality of electrical contact terminals, such as, e.g., electrical contact terminals 200 (FIGS. 5*a*-5*c*). In at least one embodiment, each contact opening 104 includes a contact pin receiving portion 122 extending through body portion 102 and a contact retention portion 124 adjacent to contact pin receiving portion 122. Contact pin receiving portion 122 is configured to receive an electrical contact pin of a mating connector, such as, e.g., electrical contact pin 700 of electrical connector 2 (FIG. 14). Contact retention portion 124 is configured to retain an electrical contact terminal In at least one embodiment, contact retention portion 124 includes a shelf portion 126 configured to retain an electrical contact terminal. Shelf portion 126 is configured to prevent downward movement of an electrical contact terminal, e.g., during termination of an electrical conductor to the electrical contact terminal. The design and location of contact retention portion 124 minimizes the space used for contact retention, thereby enabling a minimized connector design.

Insulative connector housing 100 further includes first and second pairs of opposing end portions 106, 108 extending from opposing ends 102*a*, 102*b* of body portion 102 in insertion direction A. End portions 106, 108 are configured to effectively guide, position, and retain a cover (see, e.g., FIG. 3 and FIGS. 10*a*-10*c*) and a strain relief (see, e.g., FIG. 3 and FIG. 13) while occupying a minimized space, thereby enabling a minimized connector design. In at least one embodiment, end portions 106, 108 extend beyond a top surface 128 of body portion 102. Extending end portions 106, 108 beyond top surface 128 facilitate alignment of a cover and a strain relief. It also facilitates alignment of a connector housing of a mating connector before electrical contact pins of the mating connector engage connector housing 100, allowing for blind mating of the mating connector with little risk of damaging electrical contact pins during mating.

In at least one embodiment, end portions 106, 108 each include a flange 130 extending laterally therefrom at an end 106*a*, 108*a* thereof. Flanges 130 facilitate connector housing 100 to be easily handled, e.g., during mating and unmating. For example, to enable easy removal of mating electrical connector 1 from an electrical connector, flanges 130 may be grabbed between a human finger and thumb. In at least one embodiment, flanges 130 include conductor insertion guide surfaces 132 configured to accommodate engagement of an electrical conductor, such as, e.g., a discrete electrical conductor or an electrical conductor as part of an electrical cable, such as, e.g., electrical conductors 402 of electrical cable 400 (FIG. 1). Conductor insertion guide surfaces 132 are configured to guide an electrical conductor in a width direction (along the length of connector housing 100) reducing misaligned conductor terminations and increasing conductor termination rate.

In at least one embodiment, end portions 106, 108 include opposing conductor support surfaces 134 configured to support an electrical conductor. In at least one aspect, conductor support surfaces 134 are configured to securely support outside conductors of a ribbon cable to eliminate high resistance failures on the outside conductors common to conventional ribbon cable connectors.

Figure 10A:
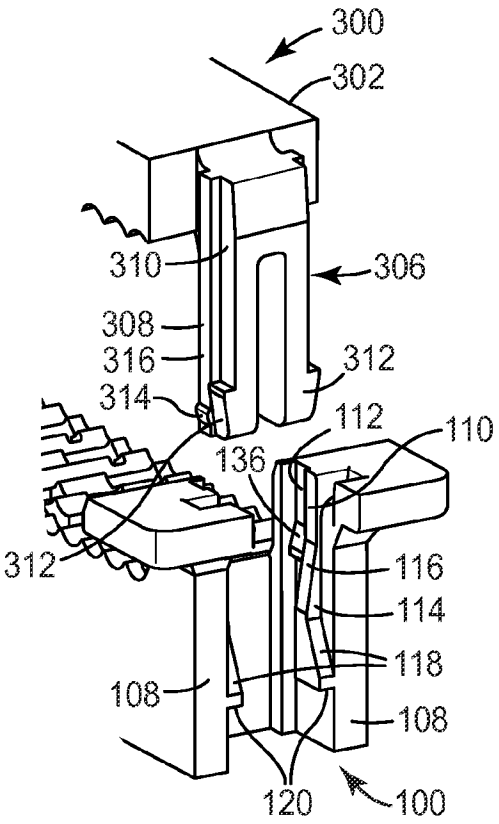
FIGS. 10*a*-10*c* are partial perspective views of an exemplary embodiment of a cover and a connector housing according to an aspect of the present disclosure aligned for assembly, in an open position, and in a closed position, respectively.
Figure 10B:
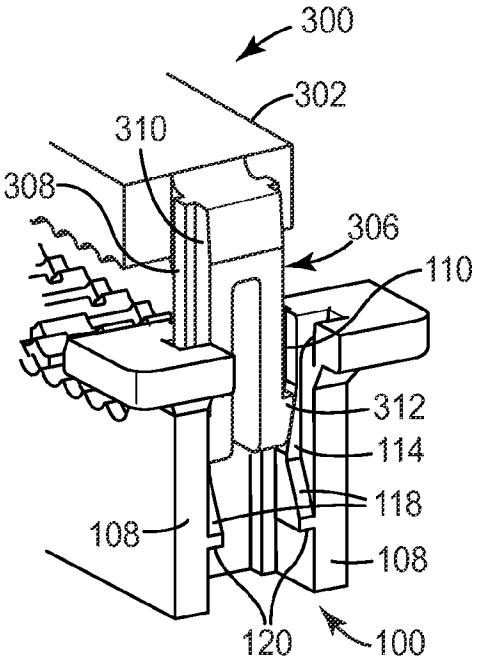
Figure 10C:
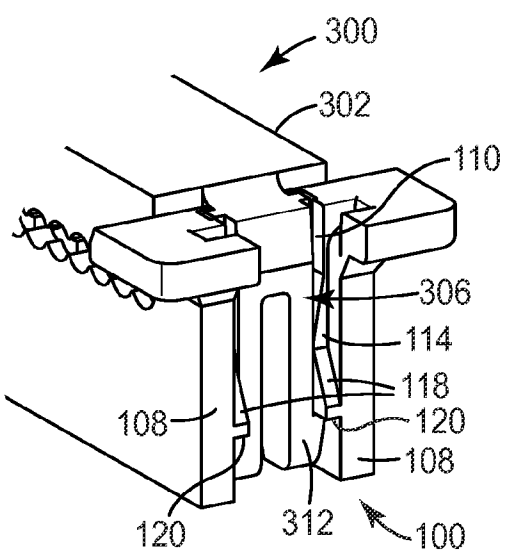
Figure 13:
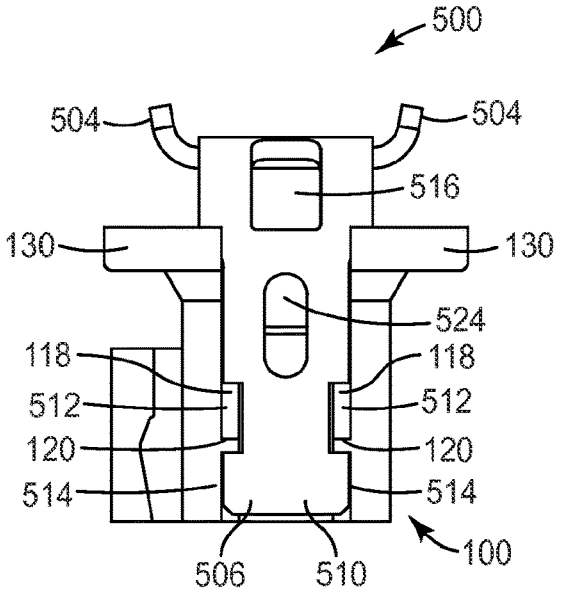
FIG. 13 is a side view of an exemplary embodiment of a strain relief and a connector housing according to an aspect of the present disclosure in an assembled configuration.

At least one end portion in each pair of opposing end portions 106, 108 includes a ridge 110 extending in insertion direction A. Ridge 110 is configured to guide a cover latch, such as, e.g., first and second cover latches 304, 306 of cover 300 (FIGS. 9a-9e), along a side surface 112 of ridge 110 and a strain relief latch, such as, e.g., first and second strain relief latches 506 of strain relief 500 (FIGS. 11a-11b), along an opposing side surface 114 of ridge 110. As best illustrated in FIG. 4a, ridge 110 has an inclined top surface 116 for resiliently deflecting a cover latch and an inclined side surface 118 for resiliently deflecting a strain relief latch. In at least one embodiment, inclined top surface 116 is configured to accommodate positioning of a cover in an open position. Ridge 110 further has an end portion 120 for latching onto a cover latch and a strain relief latch. In at least one embodiment, end portion 120 is configured to accommodate retention of a cover in a closed position, e.g., as illustrated in FIG. 10c. In at least one embodiment, end portion 120 is configured to accommodate retention of a strain relief, e.g., as illustrated in FIG. 13.

In at least one embodiment, at least one end portion in each pair of opposing end portions 106, 108 includes a catch portion 136 for resiliently deflecting and latching onto a cover latch. In at least one embodiment, catch portion 136 is configured to accommodate retention of a cover in an open position, e.g., as illustrated in FIG. 10b.

In at least one embodiment, body portion 102 further includes a plurality of conductor grooves 142 extending in a transverse direction perpendicular to insertion direction A in a top surface 128 thereof. Conductor grooves 142 are configured to accommodate electrical conductors. In at least one embodiment, conductor grooves 142 have a cross-sectional shape substantially corresponding to the cross-sectional shape of the electrical conductors.

In at least one embodiment, body portion 102 further includes a polarization element 144 disposed on a side 146 thereof. Polarizing element 144 is configured to engage with a polarization opening of a mating connector, such as, e.g., polarization opening 628 of connector housing 600 (FIGS. 16a-16e). Polarization element 144 includes a taller ridge 148 extending in insertion direction A. Taller ridge 148 is configured to be disposed within the polarization opening. In combination, polarization element 144 and the polarization opening prevent mating electrical connector 1 from being incorrectly, i.e., rotated 180° about insertion direction A, mated to the mating connector. In at least one embodiment, polarization element 144 further includes a shorter ridge 150 extending in insertion direction A. Shorter ridge 150 is configured to frictionally engage a surface of the mating connector, such as, e.g., interior surface 652 of connector housing 600 (FIGS. 16a-16e). In at least one aspect, this allows mating electrical connector 1 to be securely attached to the mating connector, which is particularly useful in the absence of a separate latch/eject mechanism. Polarization element 144 may be on either side of body portion 102 at any suitable location.

Figure 8A:
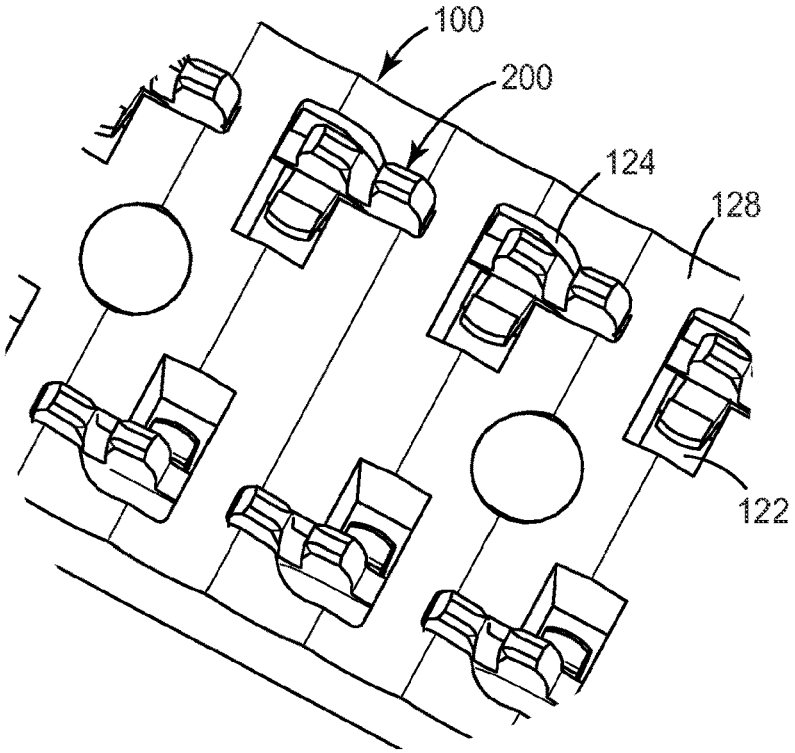
FIGS. 8*a*-8*b* are perspective and cross-sectional views, respectively, of an exemplary embodiment of a plurality of electrical contact terminals assembled in a connector housing according to an aspect of the present disclosure.

In at least one embodiment, electrical connector 1 further includes a plurality of electrical contact terminals supported in contact openings 104. FIGS. 5a-5c illustrate an exemplary embodiment of an electrical contact terminal according to an aspect of the present disclosure. Referring to FIGS. 5a-5c, electrical contact terminal 200 includes a base portion 202, an insulation displacement connecting (IDC) portion 204, and a contact portion 210. Base portion 202 is configured for positioning and retaining electrical contact terminal 200 within a connector housing, such as, e.g., connector housing 100. IDC portion 204 extends upwardly from base portion 202 and includes a pair of spaced apart arms 206 defining an opening 208 therebetween for receiving and making electrical contact with an electrical conductor. Contact portion 210 extends downwardly from base portion 202 and is configured to float when electrical contact terminal 200 is retained and positioned within a connector housing. The design and floating configuration of contact portion 210 provides an increased spring beam length, a reduced localized stress, and an increased spring force for a given overall contact height enabling a lower overall connector height. For example, in at least one embodiment, body portion 102 has a height that is less than about 3 mm Contact portion 210 includes a first arm 212, a second arm 214, and an arcuate base portion 216. First arm 212 extends downwardly and includes a first end (212a) attached to base portion 202 and an opposite second end 212b. Second arm 214 extends downwardly and includes a free first end 214a closer to base portion 202 and an opposite second end 214b farther from base portion 202. Second arm 214 is configured to deflect when making electrical contact with a mating contact pin, such as, e.g., electrical contact pin 700 of electrical connector 2 (FIG. 14). Arcuate base portion 216 connects second end 212b of first arm 212 and second end 214b of second arm 214. In at least one embodiment, at least one of first arm 212 and arcuate base portion 216 is configured to deflect when second arm 214 makes electrical contact with a mating contact pin. This configuration of at least one of first arm 212 and arcuate base portion 216 adds to the effective length of the contact spring beam. In at least one embodiment, the deflection includes a rotation about a longitudinal axis L of first arm 212. In at least one embodiment, a width W of second arm 214 tapers from second end 214b of second arm 214 to free first end 214a of second arm 214. This tapered configuration of second arm 214 assists in the ability of contact portion 210 to withstand a desired normal force without yielding. In at least one embodiment, contact portion 210 can withstand a normal force of about 250 grams without yielding. In at least one embodiment, first arm 212 and second arm 214 do not lie in a same plane. In at least one embodiment, when second arm 214 deflects when making contact with a mating contact pin, the deflection creates a stress distribution that extends to first arm 212. In at least one embodiment, the stress distribution ranges from about 0 psi to about 165K psi. In at least one embodiment, the stress distribution ranges from about 25K psi to about 165K psi. In at least one embodiment, contact portion 210 is S-shaped. In at least one embodiment, contact portion 210 is U-shaped. In at least one embodiment, second arm 214 includes a curvilinear contacting portion 236 positioned at free first end 214a of second arm 214. In the illustrated embodiment, curvilinear contacting portion 236 is defined by a curved end of second arm 214. Alternatively, curvilinear contacting portion 236 may take alternate forms from the one illustrated, and may include, e.g., a Hertzian bump extending from second arm 214. In at least one embodiment, such as, e.g., the embodiment illustrated in FIGS. 5a-5c, contacting portion 236 faces away from base portion 202. In at least one embodiment, second arm 214 includes a rib 240 configured to increase the stiffness of second arm 214. In at least one embodiment, second arm 214 is configured to deflect toward a major plane P of base portion 202 when it makes electrical contact with a mating contact pin. In at least one aspect, when electrical contact terminal 200 is assembled in contact opening 104 of connector housing 100, second arm 214 is disposed in contact pin receiving portion 122 of contact opening 104, as best illustrated in FIG. 8a. As such, second arm 214 deflects when making electrical contact with a mating contact pin received by contact pin receiving portion 122.

In at least one embodiment, electrical contact terminals 200 each include at least one retaining portion to retain electrical contact terminals 200 in contact openings 104 of connector housing 100. The retaining portion may be configured to prevent electrical contact terminal 200 from moving in insertion direction A, e.g., during termination of an electrical conductor to the electrical contact terminal. The retaining portion may be configured to prevent electrical contact terminal 200 from moving a direction lateral to insertion direction A, e.g., to prevent interference of at least a portion of contact portion 210 with side walls of contact opening 104.

Figure 8B:
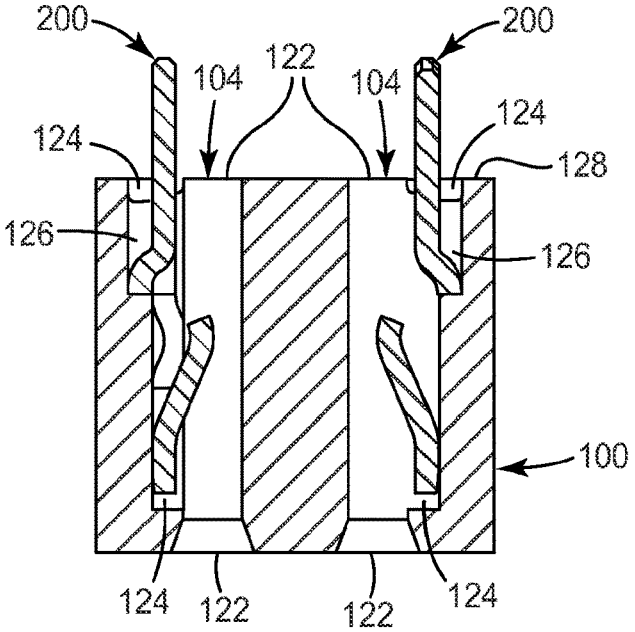
Figure 9A:
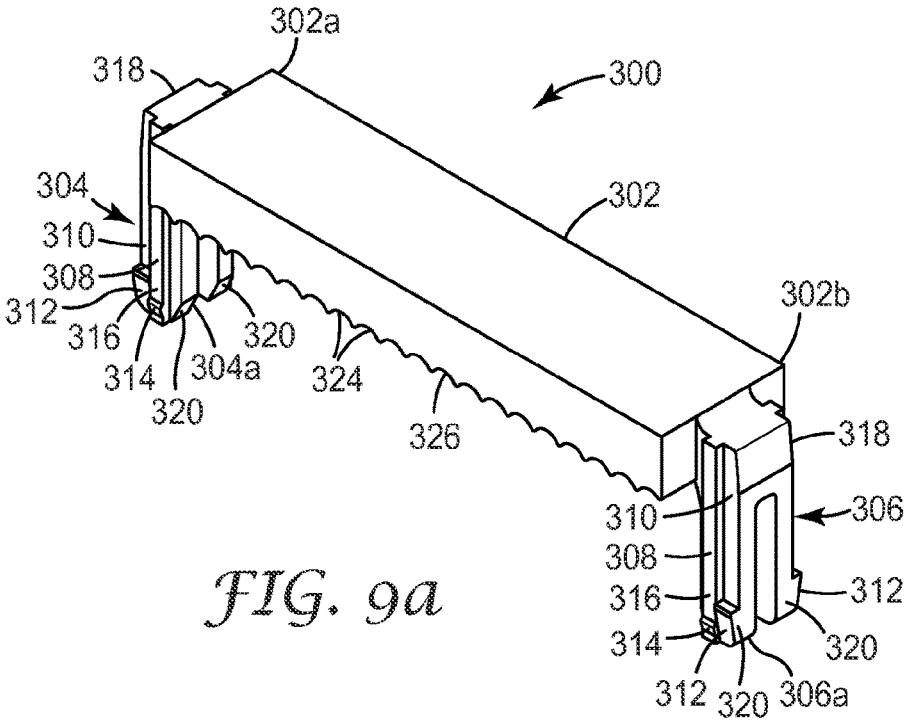
FIGS. 9*a*-9*e* are perspective, front, side, top, and bottom views, respectively, of an exemplary embodiment of a cover according to an aspect of the present disclosure.
Figure 9B:
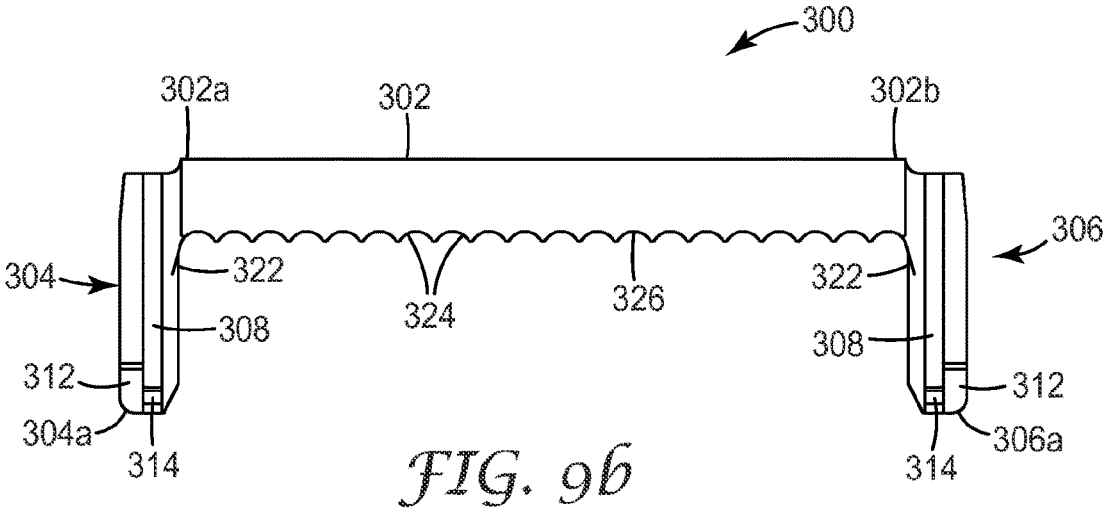
Figure 9C:
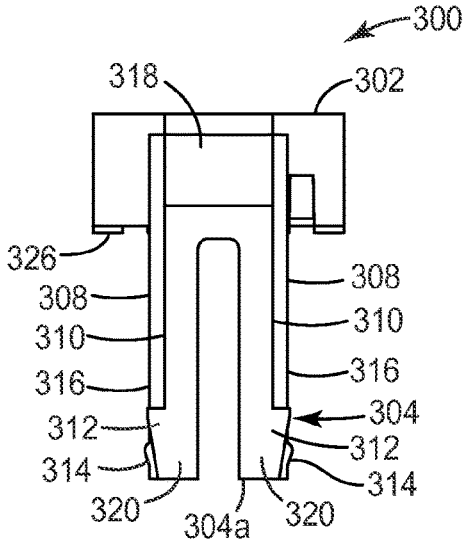
Figure 9D:
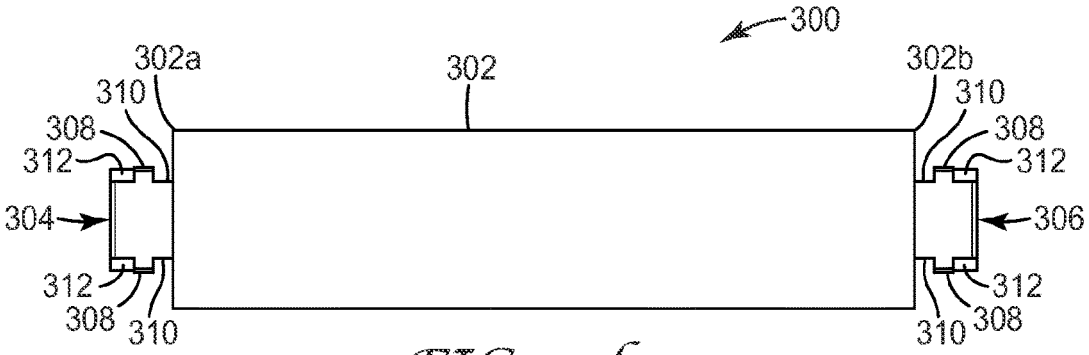
Figure 9E:
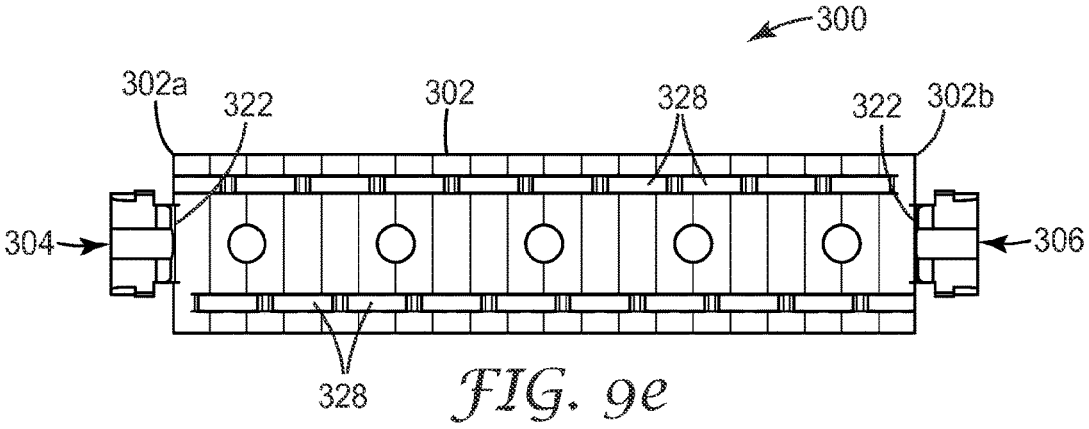

In at least one embodiment, base portion 202 includes a first retaining portion 218 configured to retain and position electrical contact terminal 200 in a connector housing. In at least one embodiment, first retaining portion 218 is configured to prevent downward movement of electrical contact terminal 200 during termination of an electrical conductor. In at least one embodiment, first retaining portion 218 includes a shell-shaped portion 222. In at least one aspect, when electrical contact terminal 200 is assembled in contact opening 104 of connector housing 100, shell-shaped portion 222 is disposed on shelf portion 126 of contact opening 104, as best illustrated in FIG. 8*b*. As such, in combination, shell-shaped portion 222 and shelf portion 126 prevent electrical contact terminal 200 from moving in insertion direction A, e.g., during termination of an electrical conductor to the electrical contact terminal In at least one embodiment, first retaining portion 218 extends from a first major surface 226 of electrical contact terminal 200 and is configured to retain and longitudinally position electrical contact terminal 200 in a connector housing.

In at least one embodiment, base portion 202 includes a second retaining portion 220 configured to retain and position electrical contact terminal 200 in a connector housing. In at least one embodiment, second retaining portion 220 extends from a side surface 228 of base portion 202 and is configured to retain and laterally position electrical contact terminal 200 in a connector housing. In at least one embodiment, second retaining portion 220 includes a wedge-shaped portion 224. In at least one aspect, when electrical contact terminal 200 is assembled in contact opening 104 of connector housing 100, wedge-shaped portion 224 is disposed in and provides an interference fit or press-fit with contact retention portion 124 of contact opening 104. As such, in combination, wedge-shaped portion 224 and retention portion 124 retain and laterally position electrical contact terminal 200 in connector housing 100.

In at least one embodiment, first arm 212 includes a third retaining portion 230 configured to retain and position electrical contact terminal 200 in a connector housing. In at least one embodiment, third retaining portion 230 extends from a second major surface 234 of electrical contact terminal 200 and is configured to retain and laterally position electrical contact terminal 200 in a connector housing. In at least one embodiment, third retaining portion 230 includes a curved portion 232. In at least one aspect, when electrical contact terminal 200 is assembled in contact opening 104 of connector housing 100, curved portion 232 is disposed in and provides an interference fit or press-fit with contact retention portion 124 of contact opening 104, as best illustrated in FIG. 8*b*. As such, in combination, curved portion 232 and retention portion 124 retain and laterally position electrical contact terminal 200 in connector housing 100.

Figure 6A:
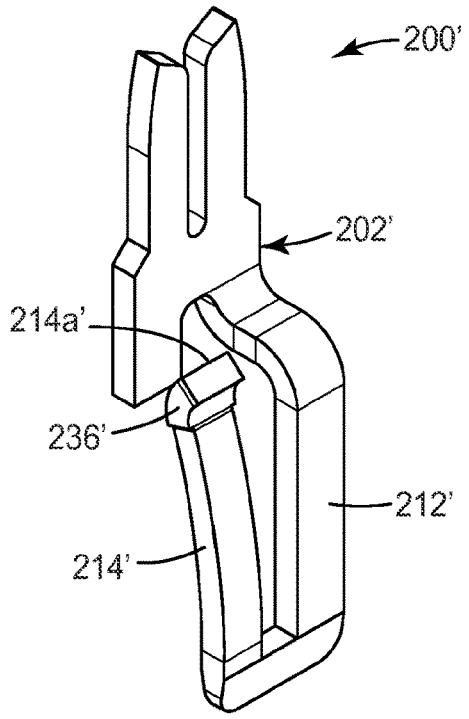
FIGS. 6*a*-6*c* are perspective, side, and front views, respectively, of another exemplary embodiment of an electrical contact terminal according to an aspect of the present disclosure.
Figure 6B:
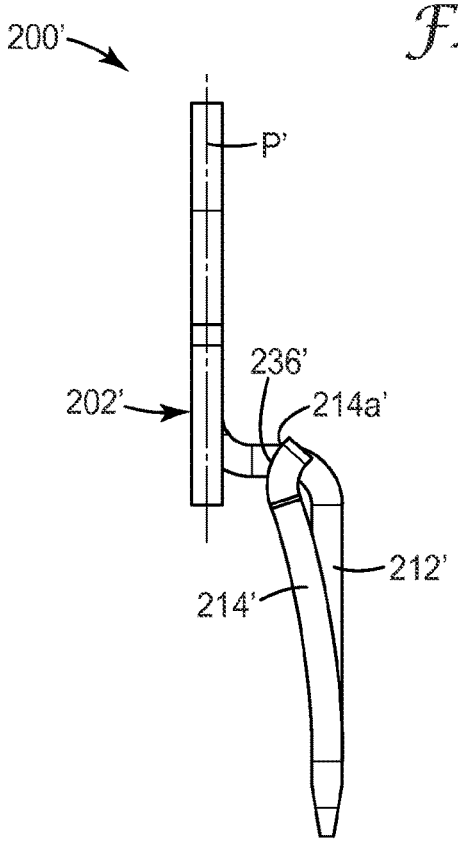
Figure 6C:
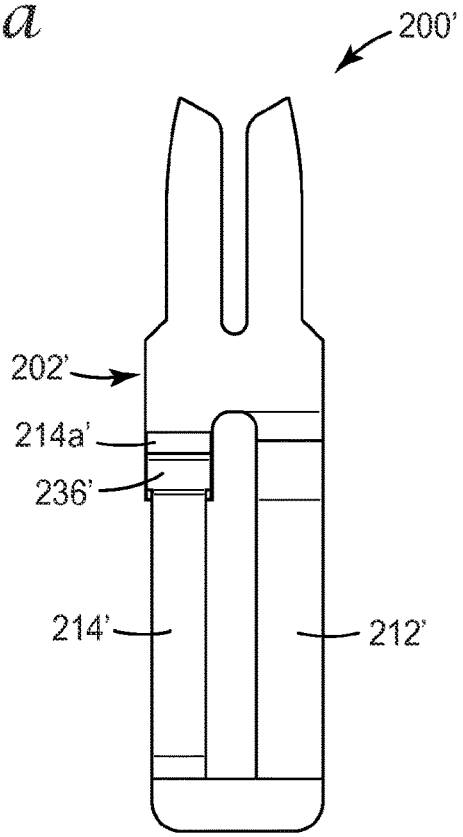

FIGS. 6*a*-6*c* illustrate another exemplary embodiment of an electrical contact terminal according to an aspect of the present disclosure. Referring to FIGS. 6*a*-6*c*, electrical contact terminal 200' is similar to electrical contact terminal 200. In FIGS. 6*a*-6*c*, elements of electrical contact terminal 200' that are similar to those of electrical contact terminal 200 have the same numbers but provided with a prime (') to indicate their association with electrical contact terminal 200'. In electrical contact terminal 200', first arm 212' and base portion 202' do not lie in a same plane. In at least one embodiment, second arm 214' includes a curvilinear contacting portion 236' positioned at free first end 214*a*' of second arm 214'. In at least one embodiment, contacting portion 236' faces toward base portion 202'. In at least one aspect, an electrical contact pin of a mating connector is positioned between base portion 202' and second arm 214' when electrical connector 1 and the mating connector are in a mated configuration. In at least one embodiment, second arm 214' is configured to deflect away from a major plane P' of base portion 202 when it makes electrical contact with a mating contact pin. In at least one aspect, this electrical contact terminal configuration requires less space on the outer wall of body portion 102 of connector housing 100.

Figure 7A:
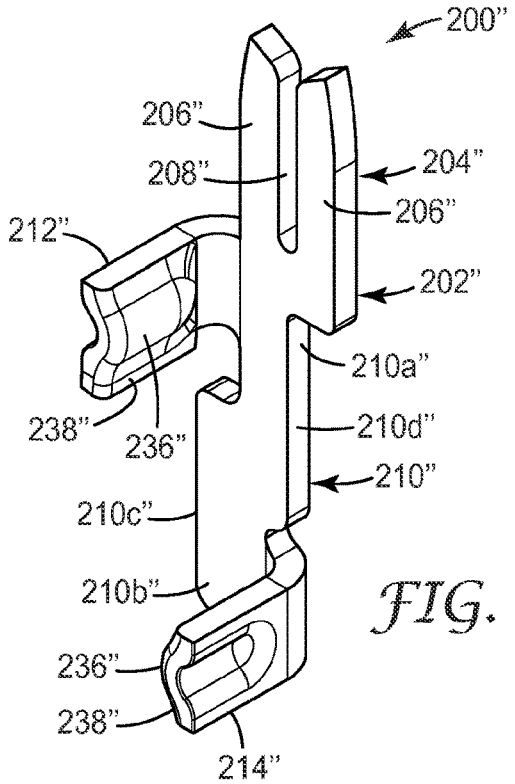
FIGS. 7*a*-7*c* are perspective, side, and front views, respectively, of another exemplary embodiment of an electrical contact terminal according to an aspect of the present disclosure.
Figure 7B:
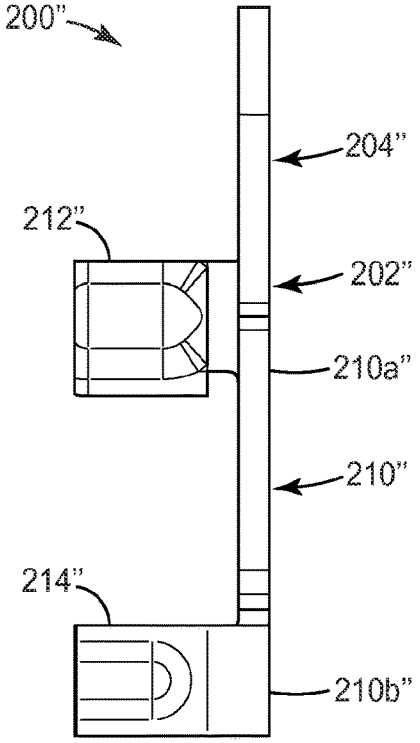
Figure 7C:
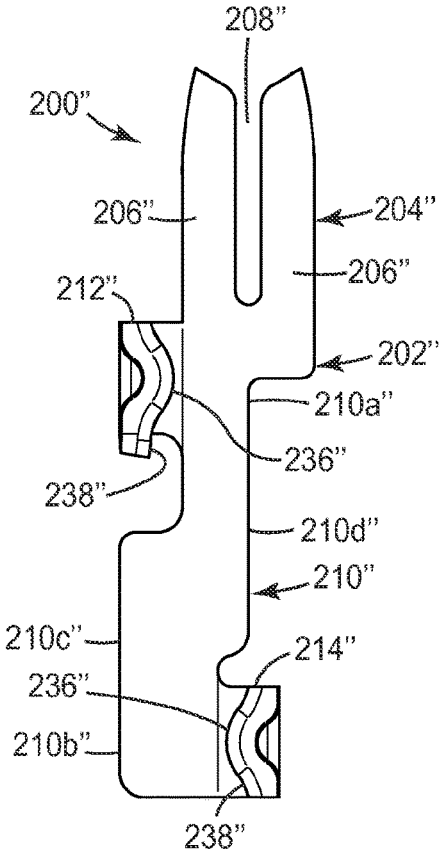

FIGS. 7*a*-7*c* illustrate another exemplary embodiment of an electrical contact terminal according to an aspect of the present disclosure. Referring to FIGS. 7*a*-7*c*, electrical contact terminal 200" is similar to electrical contact terminal 200. In FIGS. 7*a*-7*c*, elements of electrical contact terminal 200" that are similar to those of electrical contact terminal 200 have the same numbers but provided with a double prime (") to indicate their association with electrical contact terminal 200". Electrical contact terminal includes a base portion 202", an IDC portion 204", and a contact portion 210". IDC portion 204"extends upwardly from base portion 202" and includes a pair of spaced apart arms 206" defining an opening 208" therebetween for receiving and making electrical contact with an electrical conductor. Contact portion 210" extends downwardly from base portion 202" and is configured to float when electrical contact terminal 200" is retained and positioned within a connector housing. Contact portion 210" includes a first arm 212" and a second arm 214". First arm 212" extends forwardly at a first end 210*a*" of contact portion 210" attached to base portion 202". Second arm 214" extends forwardly at an opposite second end 210*b*" of contact portion 210". First and second arms 212", 214" are configured to deflect when making electrical contact with a mating contact pin. In at least one embodiment, first and second arms 212", 214" extend at opposing sides 210*c*", 210*d*" of contact portion 210". In at least one embodiment, first and second arms 212", 214" each include a curvilinear contacting portion 236" extending from a major surface 238" thereof. In the illustrated embodiment, curvilinear contacting portion 236" is defined by a curved end of first and second arms 212", 214". Alternatively, curvilinear contacting portion 236" may take alternate forms from the one illustrated, and may include, e.g., a Hertzian bump extending from first and second arms 212", 214". In at least one embodiment, contacting portions 236" extend from first and second arms 212", 214" toward each other. In at least one aspect, an electrical contact pin of a mating connector is positioned between base portion first and second arms 212", 214" when electrical connector 1 and the mating connector are in a mated configuration. In at least one aspect, first and second arms 212", 214" define short side wiping spring beams.

In at least one embodiment, electrical connector 1 further includes a cover for reliably terminating at least one electrical conductor, e.g., electrical conductors 402 of electrical cable 400 (FIG. 1), to a corresponding electrical contact terminal supported in a connector housing. The cover is configured to provide protection of the termination when securely attached to the connector housing. FIGS. 9*a*-9*e* illustrate an exemplary embodiment of a cover according to an aspect of the present disclosure, and FIGS. 10*a*-10*c* illustrate an exemplary embodiment of a cover and a connector housing according to an aspect of the present disclosure aligned for assembly, in an open position, and in a closed position, respectively.

Referring to FIGS. 9*a*-9*e*, cover 300 for an electrical connector includes a longitudinal body portion 302 extending along a first direction and first and second cover latches 304, 306 extending from opposing longitudinal ends 302*a*, 302*b* thereof in a second direction different than the first direction. In at least one aspect, when cover 300 is used with electrical connector housing 100, the second direction is equal to insertion direction A. Each cover latch 304, 306 includes at least one ridge 308 and at least one first catch portion 312. Ridge 308 is disposed on a side surface 310 of cover latch 304, 306 and extends in the second direction for guiding cover latch 304, 306 along a ridge of a connector housing, such as, e.g., ridge 110 of connector housing 100. First catch portion 312 is disposed on side surface 310 at an end 304*a*, 306*a* of cover latch 304, 306 distant from body portion 302 for being deflected by and engaging the ridge of the connector housing to secure cover 300 with respect to the connector housing.

In at least one embodiment, the ridge of the connector housing includes an inclined top surface, such as, e.g., inclined top surface 116 of ridge 110, for resiliently deflecting cover latch 304, 306. When first catch portion 312 engages the inclined top surface, cover 300 is positioned in an open position, e.g., as illustrated in FIG. 10*b*. When cover latch 304, 306 is resiliently deflected by the inclined top surface, the spring force generated by cover latch 304, 306 keeps cover 300 in the open position, preventing cover 300 from unintentionally closing and resisting unintentional cover termination until adequate force is applied. In the open position, cover 300 is prepositioned with respect to the connector housing to allow an electrical conductor or cable to be easily inserted between cover 300 and the connector housing for termination. In at least one aspect, the prepositioning of cover 300 provides a space of about three times the diameter of a typical electrical conductor or cable that can be used with electrical connector 1 to facilitate easy insertion of the conductor or cable, which increases the rate electrical conductors or cables can be terminated to electrical connectors 1. In at least one aspect, the prepositioning of cover 300 takes place in the lateral direction (as opposed to the longitudinal direction), which reduces the overall length of the connector housing and cover 300. For example, in at least one embodiment, body portion 102 has a length that is less than about 35 mm and includes at least 50 contact openings.

In at least one embodiment, the ridge of the connector housing includes an end portion, such as, e.g., end portion 120 of ridge 110, for latching onto cover latch 304, 306. When first catch portion 312 engages the end portion, cover 300 is retained in a closed position, e.g., as illustrated in FIG. 10*c*. In the closed position, cover 300 is securely attached to the connector housing and provides protection of the termination.

In at least one embodiment, ridge 308 includes a second catch portion 314 disposed on a top surface 316 thereof at an end 304*a*, 306*a* of cover latch 304, 306 distant from body portion 302. Second catch portion 314 is configured for being deflected by and engaging a catch portion of the connector housing, such as, e.g., catch portion 136 of connector housing 100, to secure cover latch 304, 306 with respect to the connector housing. In one embodiment, when second catch portion 314 engages the catch portion of the connector housing, cover 300 is retained in an open position, e.g., as illustrated in FIG. 10*b*. In one aspect, when second catch portion 314 engages the catch portion of the connector housing, cover 300 is prevented from unintentionally separating from the connector housing.

In at least one embodiment, each cover latch 304, 306 further includes a base portion 318 attached to body portion 302 and a pair of opposing latch arms 320 extending from base portion 318 in the second direction. In at least one aspect, when cover 300 is securely attached to a connector housing, latch arms 320 may be deflected toward each other, e.g., squeezed between a human finger and thumb, to release and remove cover 300 without damaging it.

In at least one embodiment, cover latches 304, 306 include opposing conductor support surfaces 322 configured to support an electrical conductor. In at least one aspect, conductor support surfaces 322 are configured to securely support outside conductors of a ribbon cable to eliminate high resistance failures on the outside conductors common to conventional ribbon cable connectors.

In at least one embodiment, body portion 302 further includes a plurality of conductor grooves 324 extending in a transverse direction perpendicular to the second direction in a bottom surface 326 thereof. Conductor grooves 324 are configured to accommodate electrical conductors. In at least one embodiment, conductor grooves 324 have a cross-sectional shape substantially corresponding to the cross-sectional shape of the electrical conductors. In at least one aspect, conductor grooves 324 of cover 300 and conductor grooves 142 of connector housing 100 cooperatively position, e.g., with respect to electrical contact terminals 200, and retain the electrical conductors.

In at least one embodiment, body portion 302 further includes a plurality of contact openings 328 extending therein in the second direction. Contact openings 328 are configured to receive portions of electrical contact terminals, such as, e.g., electrical contact terminals 200. In at least one aspect, each contact opening 328 provides clearance and lateral support for the IDC portion of a corresponding electrical contact terminal.

In at least one embodiment, electrical connector 1 further includes at least one electrical conductor, such as, e.g., a discrete electrical conductor or an electrical conductor as part of an electrical cable, such as, e.g., electrical conductors 402 of electrical cable 400 (FIG. 1). Referring to FIG. 1, electrical cable 400 includes a plurality of parallel spaced apart electrical conductors 402 surrounded by an insulation. Electrical cable 400 may be a conventional flat ribbon cable or any other suitable electrical cable. Electrical cable 400 may have any suitable number of electrical conductors 402 spaced at any suitable pitch. In one exemplary embodiment of electrical connector 1, electrical cable 400 includes 20 electrical conductors 402 spaced at a 0.025" (0.635 mm) pitch (FIG. 1), terminated to 2×10 electrical contact terminals 200 spaced at a 0.050"×0.050" (1.27 mm×1.27 mm) pitch (FIG. 3). Electrical conductors 402 may have any suitable wire configuration, such as, e.g., a 28 AWG solid wire or a 30 AWG solid or stranded wire, wherein the stranded wire may include, e.g., up to 19 wire strands. Electrical conductors may be surrounded by an insulation having any suitable diameter, such as, e.g., a diameter ranging from about 0.022" (0.559 mm) to about 0.028" (0.711 mm) for a 0.025" (0.635 mm) pitch cable.

Figure 11A:
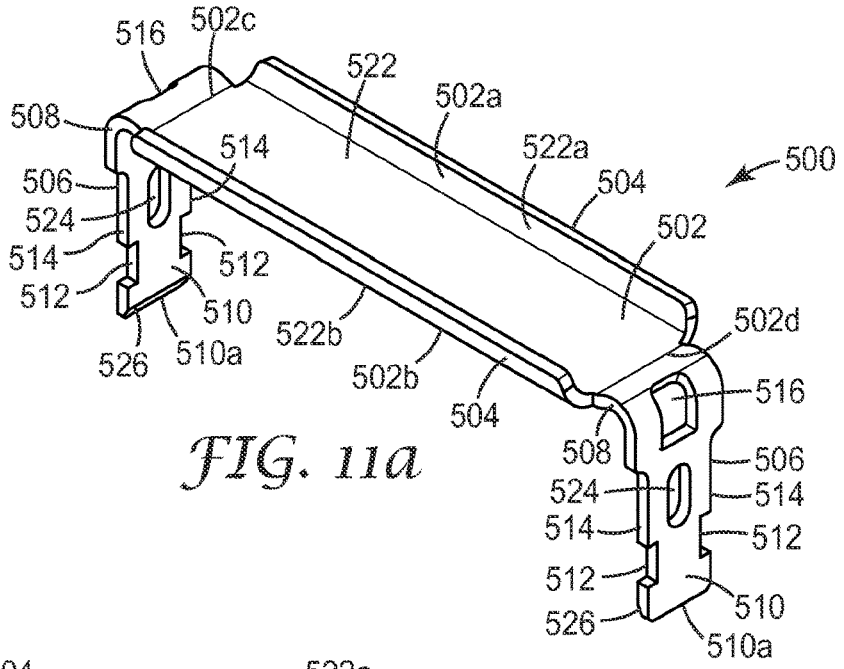
FIGS. 11*a*-11*b* are perspective and top views, respectively, of an exemplary embodiment of a strain relief according to an aspect of the present disclosure.
Figure 11B:
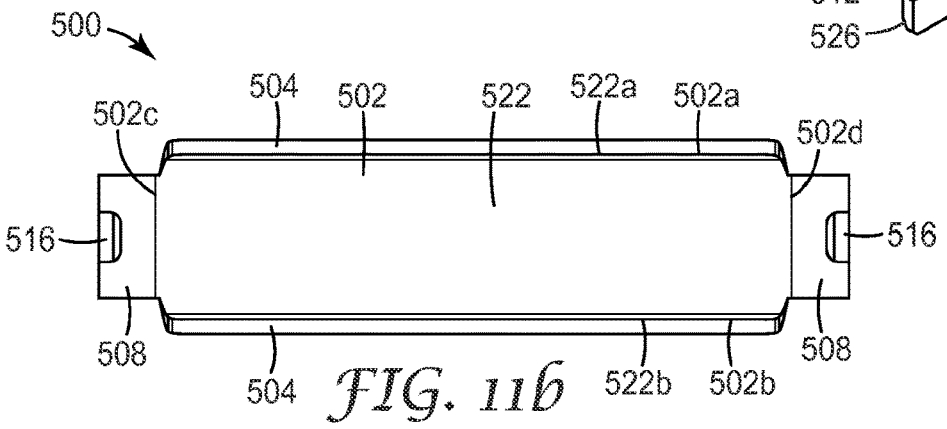

In at least one embodiment, electrical connector 1 further includes a strain relief for an electrical cable, such as, e.g., electrical cable 400. The strain relief is configured to securely retain a terminated electrical cable to prevent the termination from being compromised, e.g., during handling or movement of the electrical cable, when securely attached to the connector housing. In one aspect, the design of the strain relief requires a smaller overall electrical connector height and provides a strong and stable strain relief. FIGS. 11*a*-11*b* illustrate an exemplary embodiment of a strain relief according to an aspect of the present disclosure, and FIG. 13 illustrates a strain relief and a connector housing according to an aspect of the present disclosure in an assembled configuration.

Referring to FIGS. 11*a*-11*b*, strain relief 500 includes a longitudinal base portion 502 and first and second opposing strain relief latches 506 extending from opposing lateral sides 502*c*, 502*d* of base portion 502. In at least one aspect, when strain relief 500 is used with electrical connector housing 100, first and second strain relief latches 506 extend from opposing lateral sides 502*c*, 502*d* generally in insertion direction A. Longitudinal base portion 502 includes curved side portions 504 extending upwardly from opposing longitudinal sides 502*a*, 502*b* thereof. In at least one aspect, curved side portions 504 add rigidity to strain relief 500 while allowing strain relief 500 to still have a lower profile (smaller thickness) than many conventional strain reliefs. In the embodiment illustrated in FIGS. 11*a*-11*b*, base portion 502 includes a longitudinal planar middle portion 522, and curved side portions 504 extend upwardly from opposing longitudinal sides 522*a*, 522*b* of middle portion 522.

Each strain relief latch 506 includes a curved connecting portion 508 extending from a lateral side 502*c*, 502*d* of base portion 502 first curving upwardly and then curving downwardly and terminating at an arm portion 510 that extends downwardly. In at least one aspect, when strain relief 500 is used with electrical connector housing 100, arm portion extends in insertion direction A. Arm portion 510 is configured to resiliently deflect outwardly to accommodate secure attachment of strain relief 500 to an electrical connector. In at least one aspect, curved connecting portion 508 contributes to a suitable deflection, such as, e.g., 0.015" (0.38 mm), of arm portion 510, such that strain relief 500 can be easily installed to an electrical connector without yielding of strain relief latches 506. In at least one embodiment, to enable a low profile and a strong and stable strain relief base portion 502 and strain relief latches 506 are integrally formed from sheet metal. An exemplary sheet metal material that can be used is stainless steel, although other suitable materials may be selected as suitable for the intended application. In at least one aspect, material properties are selected such that strain relief 500 can have a narrower width, which minimizes the additional width required for a latching mechanism on a mating connector.

In at least one embodiment, arm portion 510 includes opposing recesses 512 disposed in opposing side surfaces 514 thereof. Recesses 512 are configured to accommodate an inclined side surface of a ridge of the electrical connector, such as, e.g., inclined side surface 118 of ridge 110 of connector housing 100, as best illustrated in FIG. 13. As such, recesses 512 enable arm portion 510 to engage end portion 120 of ridge 110 for secure attachment of strain relief 500 to connector housing 100. In at least one aspect, during installation of strain relief 500 to connector housing 100, arm portion 510 engages inclined side surface 118 and, as a result, resiliently deflects outwardly. It then engages end portion 120 to complete the installation and securely attach strain relief 500 to connector housing 100. In at least one embodiment, to accommodate assembly of strain relief 500 to electrical connector 1, strain relief latches 506 include opposing ramp surfaces 526 positioned at an end 510*a* of arm portion 510.

In at least one embodiment, connecting portion 508 includes an opening 516, also referred to herein as first closed perimeter opening. Opening 516 is configured to receive a portion of a latch of a mating electrical connector, such as, e.g., securing portion 908 of latch 900 (FIGS. 17*a*-17*c*) of electrical connector 2, as best illustrated in FIG. 2. In at least one aspect, opening 516 receives securing portion 908 to secure strain relief 500 to connector housing 600 of electrical connector 2.

In at least one embodiment, arm portion 510 includes an opening 524, also referred to herein as second closed perimeter opening. Opening 524 is configured to increase the flexibility of arm portion 510. Opening 524 may have any suitable shape, such as, e.g., a racetrack shape (as illustrated, e.g., in FIG. 11*a*), a curvilinear shape, or a rectilinear shape. In at least one aspect, opening 524 contributes to more evenly distribute stress over strain relief latch 506, enabling a suitable deflection of strain relief latch 506 without yielding, e.g., during installation of strain relief 500. In at least one embodiment, first closed perimeter opening 516 is disposed between second closed perimeter opening 524 and longitudinal base portion 502, such that a latch that is deflected outwardly experiences a maximum stress that is less as compared to a latch that has the same construction except that it does not include second closed perimeter opening 524. In at least one embodiment, a region immediately adjacent second closed perimeter opening 524 experiences a maximum stress that is more as compared to a latch that has the same construction except that it does not include second closed perimeter opening 524.

Figure 19A:
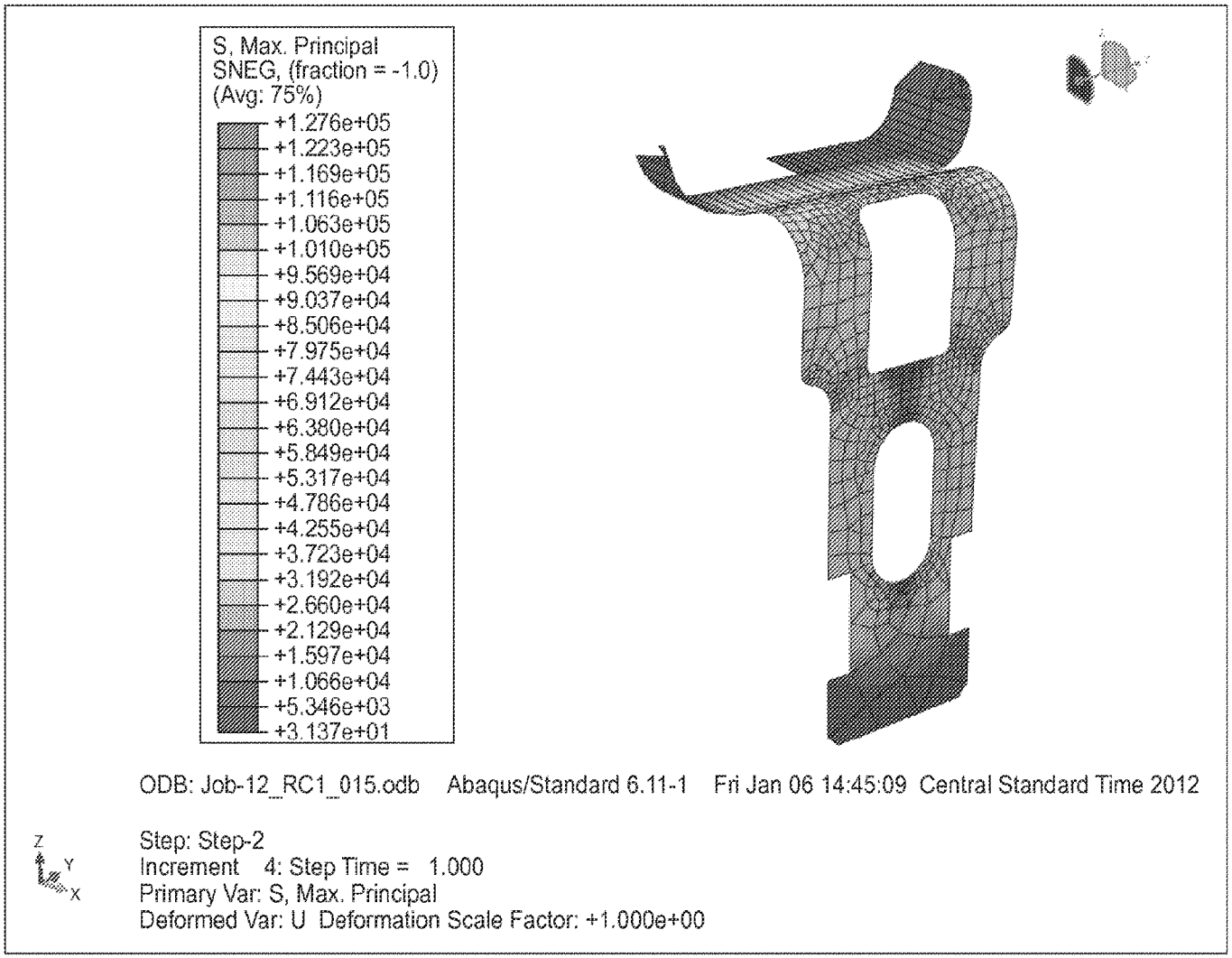
FIGS. 19*a*-19*b* are graphs illustrating the maximum stresses in exemplary embodiments of a strain relief according to aspects of the present disclosure.
Figure 19B:
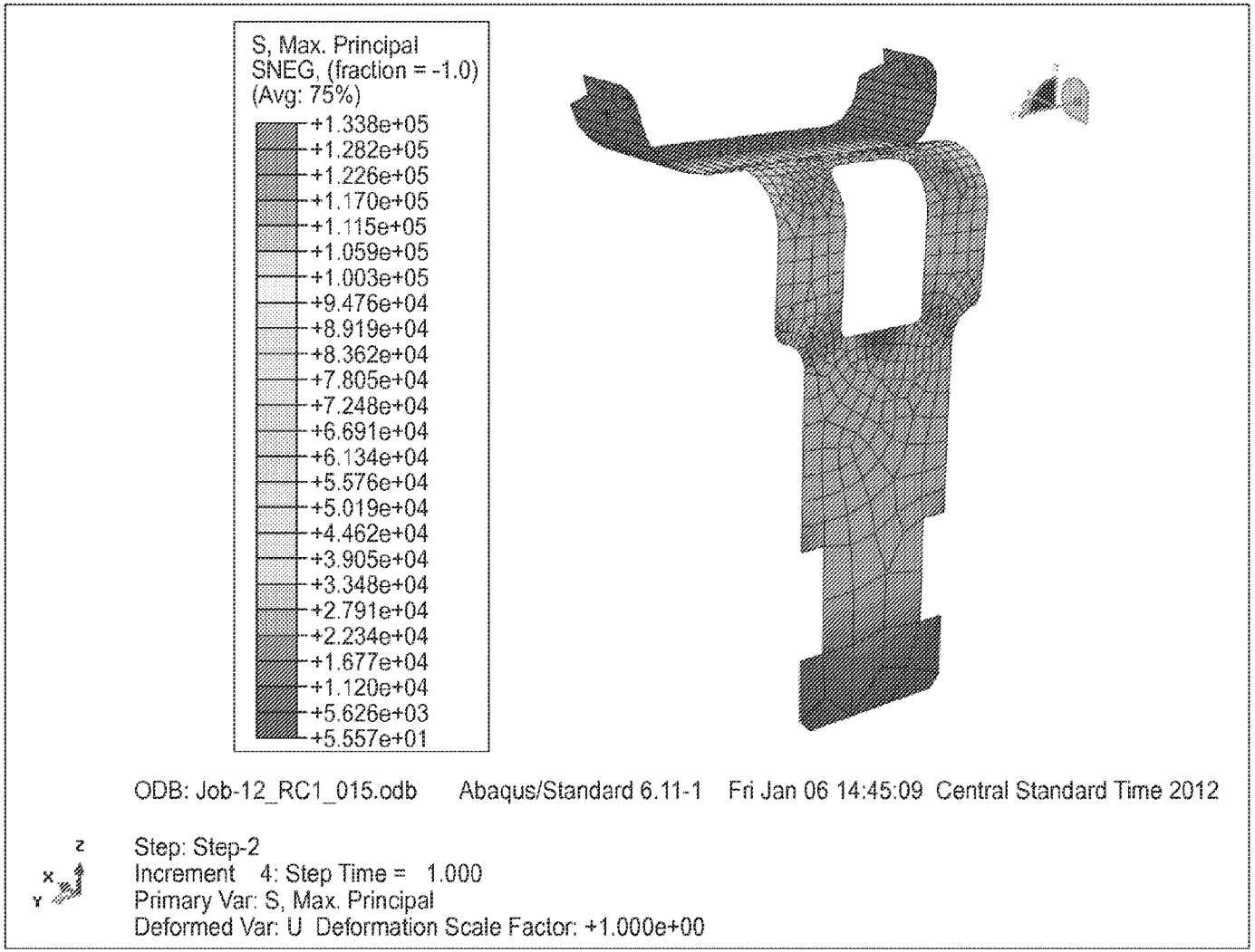

This is clearly illustrated in FIGS. 19*a*-19*b*, which are graphs illustrating the maximum stresses in a strain relief latch 506 with opening 524 (FIG. 19*a*) and an otherwise identical strain relief latch 506 without opening 524 (FIG. 19*b*). These graphs were created by first creating a Finite Element Analysis (FEA) model from the CAD geometry of the strain relief. The model was then imported into FEA modeling software, available under the trade designation Abaqus FEA from Simulia, Providence, R.I., U.S.A. Using displacement load constraints, a zero displacement was applied to base portion 502 thereby fixing the strain relief in space. Then, an outward displacement of up to 0.015" (0.38 mm) was applied on strain relief latch 506 at a point up from the end that represents the contacting surface of the latch when installed on a connector. The modeling software then examined the strain relief through the range of motion and displayed the resulting stress and strain. As illustrated in the graphs, the presence of opening 524 improves the maximum stress, which adds a safety margin from the material yield point. In at least one embodiment, the maximum stress is at least 1% less. In at least one embodiment, the maximum stress is at least 5% less (127K psi versus 133K psi as illustrated). As illustrated in the graphs, the presence of opening 524 also distributes the stress over a larger area rather than concentrating it on a small region, as illustrated by the increase in the maximum stress in a region immediately adjacent opening 524. In at least one embodiment, the maximum stress is at least 1% more. In at least one embodiment, the maximum stress is at least 5% more.

In at least one aspect, strain relief 500 and connector housing 100 are designed such that mating electrical connector 1 can mate with the same electrical connector, such as, e.g., electrical connector 2, with or without strain relief 500. In at least one aspect, strain relief 500 and connector housing 100 are designed such that the same latch, such as, e.g., latch 900, can latch to connector housing 100 with or without strain relief 500.

Figure 12:
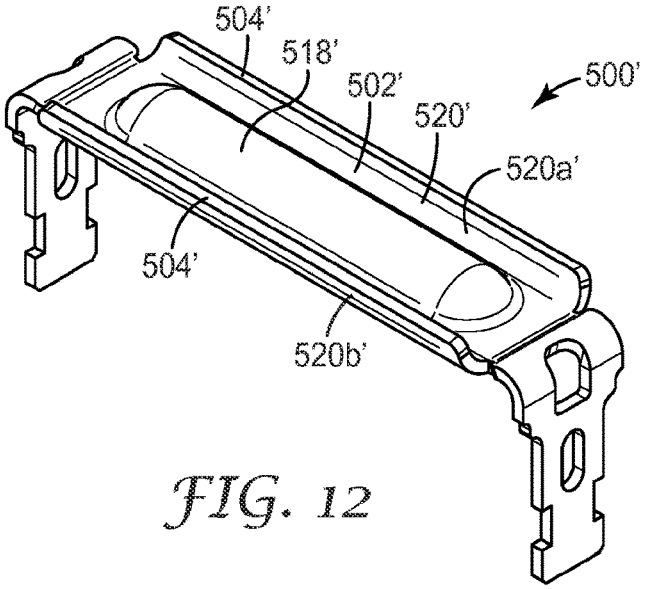
FIG. 12 is a perspective view of another exemplary embodiment of a strain relief according to an aspect of the present disclosure.

FIG. 12 illustrates another exemplary embodiment of a strain relief according to an aspect of the present disclosure. Referring to FIG. 12, strain relief 500' is similar to strain relief 500. In FIG. 12, elements of strain relief 500' that are similar to those of strain relief 500 have the same numbers but provided with a prime (') to indicate their association with strain relief 500'. In the embodiment illustrated in FIG. 12, base portion 502' includes a hollow dome-shaped portion 518' surrounded by a planar racetrack-shaped portion 520', and curved side portions 504' extend upwardly from opposing longitudinal sides 520*a*', 520*b*' of racetrack-shaped portion 520'. In at least one aspect, hollow dome-shaped portion 518' adds rigidity to strain relief 500' while allowing strain relief 500' to still have a lower profile (smaller thickness) than many conventional strain reliefs.

Figure 15:
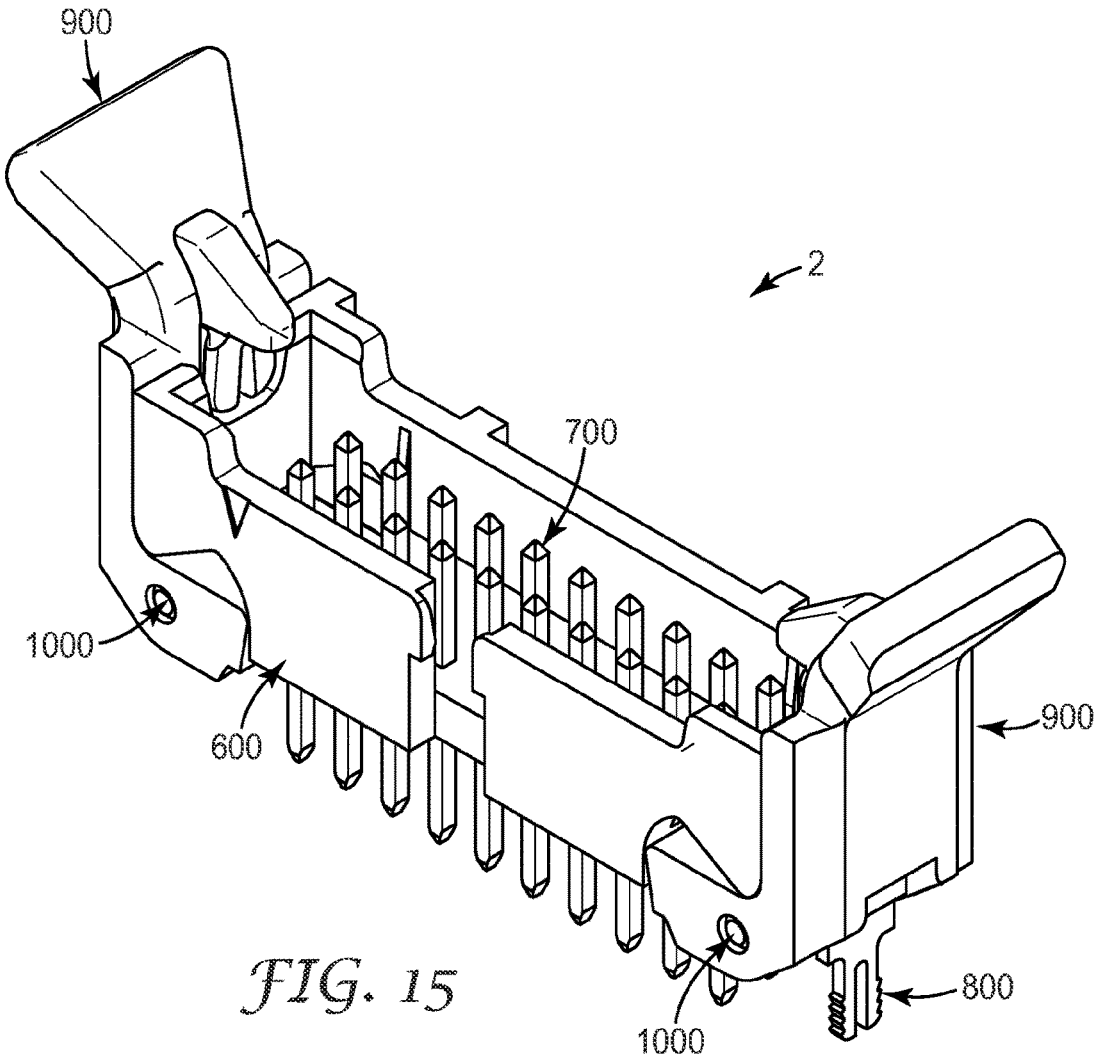
FIG. 15 is a perspective view of an exemplary embodiment of an electrical connector according to an aspect of the present disclosure.

FIGS. 14-15 illustrate an exemplary embodiment of an electrical connector according to an aspect of the present disclosure. Referring to FIGS. 14-15, electrical connector 2 includes an insulative connector housing 600 and a plurality of electrical contact pins 700 supported in connector housing 600. In at least one embodiment, electrical connector 2 further includes first and second retention clips 800 and/or first and second latches 900 and pivot pins 1000.

FIGS. 16*a*-16*e* illustrate an exemplary embodiment of an insulative connector housing according to an aspect of the present disclosure. Referring to FIGS. 16*a*-16*e*, insulative connector housing 600 includes a longitudinal bottom wall 602 having a plurality of contact openings 604. In at least one embodiment, electrical connector 2 includes a plurality of electrical contact pins 700 extending through contact openings 604 in insertion direction A. Connector housing 600 further includes first and second side walls 606, 608 extending upwardly from bottom wall 602 at opposing sides 602*a*, 602*b* of bottom wall 602, and first and second end walls 610, 612 extending upwardly from bottom wall 602 at opposing ends 602*c*, 602*d* of bottom wall 602. In at least one embodiment, side walls 606, 608 and end walls 610, 612 include chamfers 632 configured to accommodate engagement of a mating connector. In at least one aspect, chamfers 632 help guide a mating connector into connector housing 600 during mating.

Figure 16A:
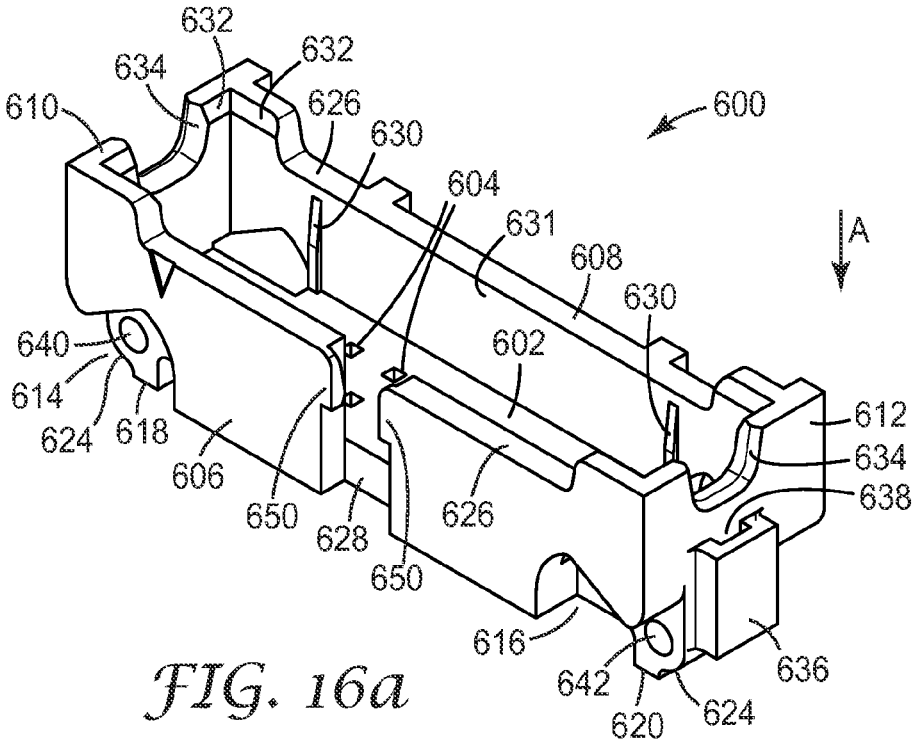
FIGS. 16*a*-16*e* are perspective, front, side, top, and bottom views, respectively, of an exemplary embodiment of a connector housing according to an aspect of the present disclosure.
Figure 16B:
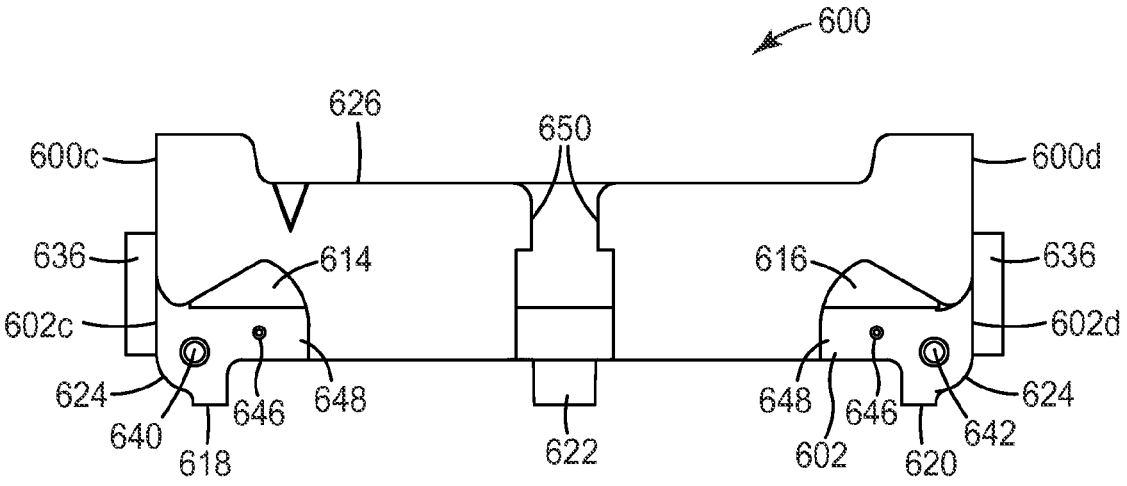
Figure 16C:
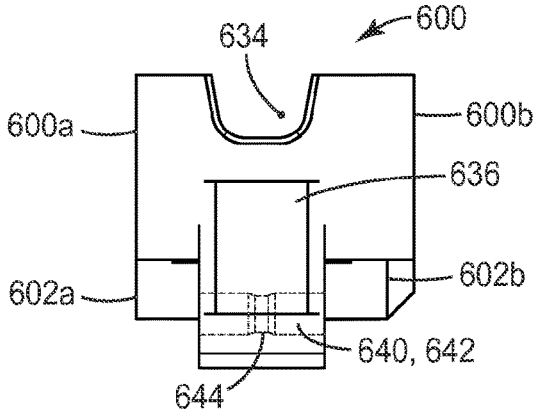
Figure 16D:
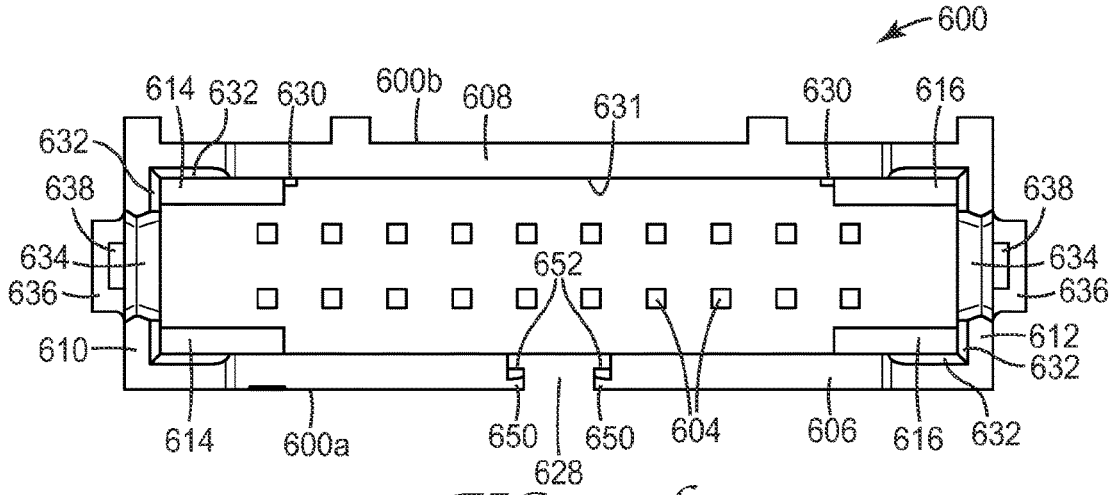
Figure 16E:
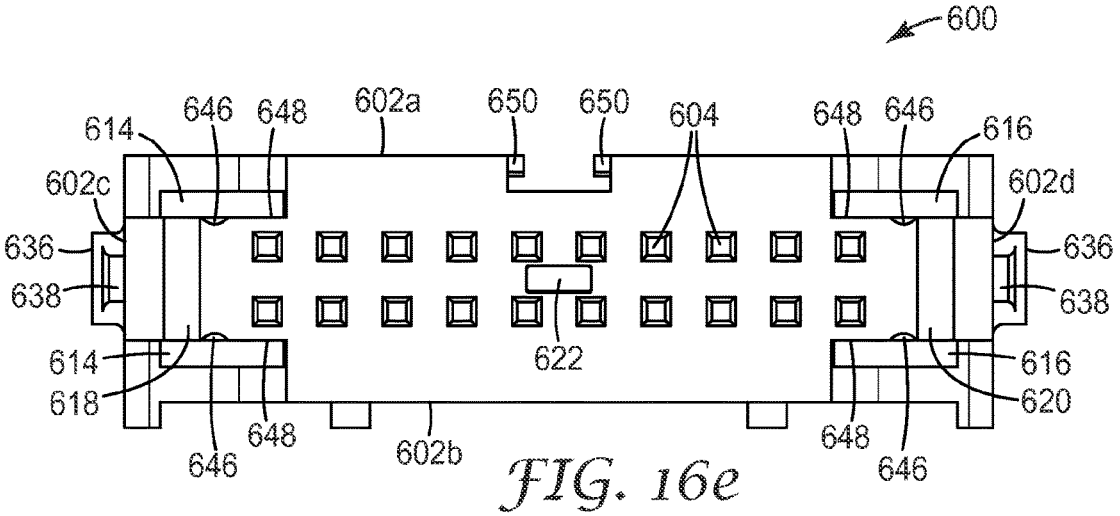

Connector housing 600 further includes first and second pairs of latch openings 614, 616 at opposing ends 602*c*, 602*d* of bottom wall 602. Each latch opening extends through bottom wall 602 and through a side wall and is configured to allow a latch, such as, e.g., latch 900, to eject a mating connector, such as, e.g., mating electrical connector 1, by moving within the opening. In at least one embodiment, the latch openings are shaped to accommodate a pivoting motion of a latch. In at least one aspect, in a configuration of electrical connector 2 wherein first and second latches 900 are present, the presence of first and second pairs of latch openings 614, 616 allows latches 900 to engage the pin field, i.e., the area configured to receive electrical contact pins, of electrical connector 2, which allows the overall length of this configuration of electrical connector 2 to be reduced. For example, in at least one embodiment, the connector housing has a length that is less than about 36 mm and includes at least 50 contact openings, and the latches add less than about 30% to the length of the electrical connector. This advantage of integrating latches 900 with connector housing 600 is best illustrated in FIG. 15. In at least one aspect, latches 900 engage the pin field of electrical connector 2 to eject a mating connector from electrical connector 2. To accommodate this, in at least one embodiment, the latch openings extend into bottom wall 602 beyond side walls 606, 608. In at least one embodiment, a portion of bottom wall 602 is positioned between at least one of the first and second pairs of latch openings 614, 616, which allows the pin field to be expanded to include an area between a pair of latch openings, as best illustrated in FIGS. 16*d*-16*e*.

In at least one embodiment, bottom wall 602 further includes first and second end standoffs 618, 620 extending downwardly therefrom at opposing ends 600*c*, 600*d* of connector housing 600. In at least one embodiment, bottom wall 602 further includes at least one center standoff 622 extending downwardly therefrom between opposing ends 600*c*, 600*d* of connector housing 600. In at least one aspect, first and second end standoffs 618, 620 and center standoff 622 are configured to properly support connector housing 600 on a printed circuit board (not shown), create a suitable space between bottom wall 602 of connector housing 600 and the printed circuit board, e.g., to enable soldering of electrical contact pins, allow the presence of printed circuit board components under connector housing 600, or allow the presence and pivoting of latches 900. First and second end standoffs 618, 620 and center standoff may have any suitable height.

Figure 17A:
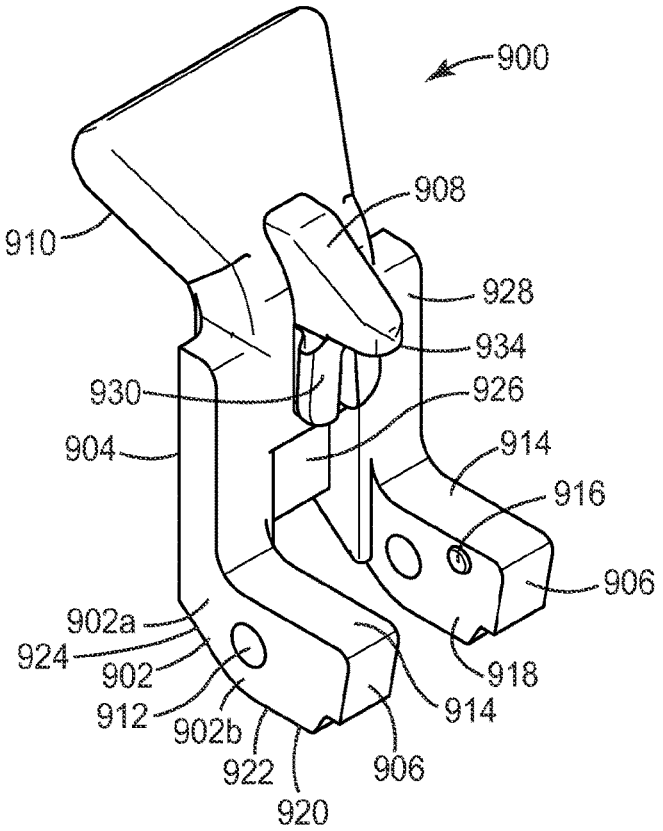
FIGS. 17*a*-17*c* are perspective, side, and top views, respectively, of an exemplary embodiment of a latch according to an aspect of the present disclosure.
Figure 17B:
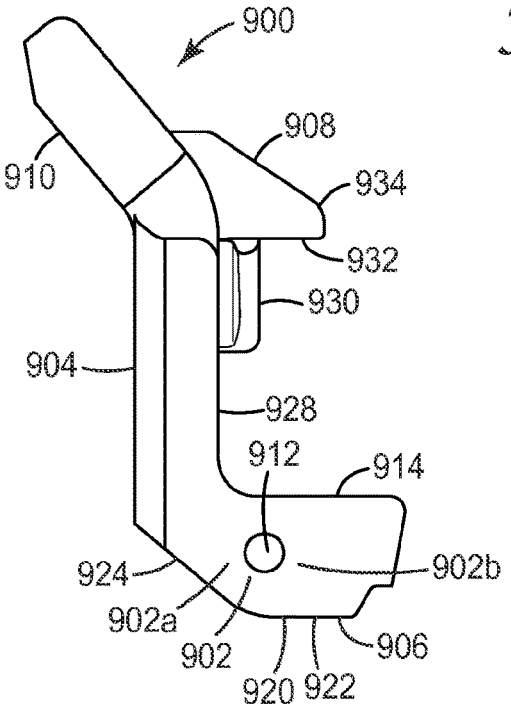
Figure 17C:
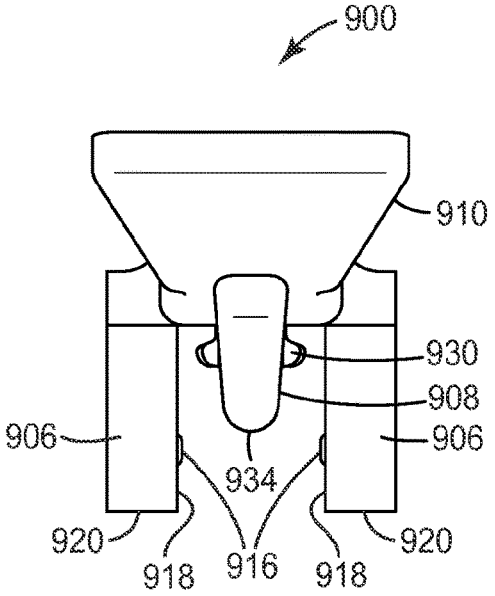

In at least one embodiment, bottom wall 602 further includes engagement edges 624 at opposing ends 600*c*, 600*d* thereof. Engagement edges 624 are shaped to engage with a portion of a latch, such as, e.g., second portion 924 of latch 900 (FIGS. 17*a*-17*c*). In at least one aspect, engagement edges 624 provide a stop for latch 900 to limit movement of the latch to an open position, e.g., as illustrated in FIG. 14. In at least one embodiment, bottom wall 602 includes a friction bump recess 646 in a side surface 648 thereof behind each latch opening Friction bump recess 646 is configured to receive a friction bump of a latch, such as, e.g., friction bump 916 of latch 900 (FIGS. 17*a*-17*c*). In at least one aspect, friction bump recess 646 provides clearance for the friction bump, e.g., to facilitate installation of the latch to connector housing 600 or when the latch is in a closed or locked position, e.g., as illustrated in FIG. 15.

In at least one embodiment, side walls 606, 608 include an electrical conductor recess 626 between opposing ends 600*c*, 600*d* of connector housing 600. Electrical conductor recess 626 is configured to receive a portion of an electrical conductor, such as, e.g., electrical conductors 402 of electrical cable 400. In at least one aspect, electrical conductor recess 626 contributes to a lower profile or overall height of the mated configuration of electrical connector 2 and mating electrical connector 1, as best illustrated in FIG. 2.

In at least one embodiment, side wall 606 includes a polarization opening 628 at a middle thereof. Polarization opening 628 is configured to receive a portion of a polarization element of a mating connector, such as, e.g., polarization element 144 of connector housing 100 of mating electrical connector 1. In combination, polarization opening 628 and the polarization element prevent a mating electrical connector from being incorrectly, i.e., rotated 180° about insertion direction A, mated to electrical connector 2. In at least one embodiment, side wall 606 includes a pair of engagement elements 650 extending into polarization opening 628. Engagement elements 650 include an interior surface 652 configured to frictionally engage with a polarization element of a mating connector, such as, e.g., polarization element 144 of connector housing 100 of mating electrical connector 1. In this example, interior surface 652 is configured to frictionally engage with shorter ridge 150 of polarization element 144. In at least one aspect, this allows the mating connector to be securely attached to electrical connector 2, which is particularly useful in the absence of a separate latch/eject mechanism. In at least one embodiment, side wall 608 includes engagement ramps 630 extending from an interior surface 608*a* thereof. Engagement ramps 630 are configured to engage with a mating connector, such as, e.g., mating electrical connector 1. In at least one aspect, during insertion of mating electrical connector 1 in connector housing 600, engagement ramps 630 on side wall 608 direct mating electrical connector 1 toward side wall 606 to ensure suitable frictional engagement of shorter ridge 150 of polarization element 144 with interior surface 652 of engagement element 650 on side wall 606. Polarization opening 628, engagement elements 650, and engagement ramps 630 may be on either side wall at any suitable location.

In at least one embodiment, end walls 610, 612 include a slot 634 positioned between opposing sides 600*a*, 600*b* of connector housing 600. Slot 634 is configured to frictionally engage with a friction lock of a latch, such as, e.g., friction lock 930 of latch 900 (FIGS. 17*a*-17*c*). In combination, slot 634 and the friction lock retain the latch in a closed or locked position, e.g., as illustrated in FIG. 15, thereby keeping a mating connector securely locked to electrical connector 2, provide lateral stability to the latch, and resist lateral forces and forces in insertion direction A, e.g., when an electrical cable attached to the mating connector is pulled. In at least one embodiment, slot 624 has a curvilinear shape and the friction lock has a corresponding shape.

In at least one embodiment, electrical connector 2 includes first and second retention clips 800 attached to connector housing 600 at opposing ends 600*c*, 600*d* thereof. In at least one embodiment, end walls 610, 612 of connector housing 600 include a retention clip retainer 636. In at least one embodiment, retention clip retainer 636 is integrally formed with connector housing 600. Retention clip retainer 636 includes a retention clip opening 638 extending therethrough in insertion direction A. Retention clip opening 638 is configured to receive a portion of a retention clip, such as, e.g., retention clip 800 (FIG. 14). Retention clip 800 functions to retain electrical connector 2 to a printed circuit board. Retention clip 800 is an optional component; electrical connector 2 may be retained to a printed circuit board by any other suitable method or structure. For example, electrical connector 2 may be retained to a printed circuit board merely by electrical contact pins 700, e.g., by soldering or press-fit. Therefore, in at least one embodiment of electrical connector housing 600, retention clip retainer 636 is omitted. In at least one aspect, omitting retention clip retainer 636 reduces the length of connector housing 600. This is particularly beneficial in a configuration of electrical connector 2 wherein first and second latches 900 are not present, because it reduces the overall length of electrical connector 2.

In at least one embodiment, insulative connector housing 600 further includes first and second pivot pin holes 640, 642 extending through bottom wall 602 in a transverse direction perpendicular to insertion direction A at opposing ends 600*c*, 600*d* of connector housing 600. Pivot pin holes 640, 642 are configured to receive a portion of a pivot pin, such as, e.g., pivot pin 1000 (FIG. 14). In at least one embodiment, pivot pin holes 640, 642 include a restricted portion 644 configured to position and retain a pivot pin. For example, to position and retain pivot pin 1000, pivot pin holes 640, 642 include restricted portion 644 which corresponds to recessed portion 1002 of pivot pin 1000. In at least one aspect, during insertion of pivot pin 1000 in pivot pin holes 640, 642, first an end portion of pivot pin 1000 frictionally engages restricted portion 644, after which recessed portion 1002 engages restricted portion 644, which properly positions and pivotably retains pivot pin 1000 in connector housing 600.

In at least one embodiment, electrical connector 2 further includes first and second latches pivotably attached to connector housing 600 at opposing ends 600*c*, 600*d* thereof. Each latch is configured to secure a mating connector, such as, e.g., mating electrical connector 1, to connector housing 600, and eject a mating connector from connector housing 600. Advantages of the cooperative configuration of the latches and connector housing 600 include 1) a width of electrical connector 2 that is the same with or without the presence of the latches, 2) an overall length of electrical connector 2 that is minimally increased by the presence of the latches, 3) the ability for end walls 610, 612 of connector housing 600 to be present with or without the presence of the latches, which allows the use of the same connector housing 600 and therefore provides the same longitudinal alignment and blind mating capability for both connector configurations, and 4) a significant reduction in connector size and cost, to name a few.

In a configuration of a mating connector wherein a strain relief is present, each latch is configured to additionally secure the strain relief to connector housing 600. In at least one aspect, the latches advantageously operate in the same manner with or without the presence of a strain relief.

The latches are optional components; a mating connector may be secured to and removed from connector housing 600 by any other suitable method or structure. For example, a mating connector may be secured to connector housing 600 by a friction lock mechanism, such as, e.g., the combination of shorter ridge 150 of connector housing 100 of mating electrical connector 1 and interior surface 652 of connector housing 600. And, a mating connector may be removed from connector housing 600 by manual force, such as, e.g., by clamping mating electrical connector 1 between a human finger and thumb at flanges 130 of connector housing 100 and manually pulling it.

FIGS. 17*a*-17*c* illustrate an exemplary embodiment of a latch according to an aspect of the present disclosure. Referring to FIGS. 17*a*-17*c*, in at least one aspect, latch 900 is configured to secure a mating connector, such as, e.g., mating electrical connector 1, to connector housing 600, and eject a mating connector from connector housing 600. Latch 900 includes a hinge portion 902, an arm portion 904 extending from a first side 902*a* of hinge portion 902 along a first direction, and a pair of discrete spaced apart hinge arms 906 extending from an opposite second side 902*b* of hinge portion 902 along a second direction different than the first direction.

Hinge portion 902 is configured to pivotably attach latch 900 to connector housing 600. In at least one embodiment, hinge portion 902 includes a pivot hole 912 extending therethrough in a transverse direction perpendicular to the first direction. Pivot hole 912 is configured to receive a pivot pin, such as, e.g., pivot pin 1000. In at least one aspect, in combination, pivot hole 912 of latch 900, pivot hole 640, 642 of connector housing 600, and pivot pin 1000 provide a secure free moving latch 900 and a low cost hinge mechanism.

In at least one embodiment, arm portion 904 includes a recess 926 in an internal surface 928 thereof. Recess 926 is configured to accommodate a retention clip retainer, such as, e.g., retention clip retainer 636. In at least one aspect, recess 926 provides sufficient clearance for retention clip retainer 636 such that latch 900 can be brought into a closed or locked position, e.g., as illustrated in FIG. 15, without interference from retention clip retainer 636. In at least one embodiment, arm portion 904 includes a friction lock 930 extending from an internal surface 928 thereof. Friction lock 930 is configured to frictionally engage with a slot in an end wall of connector housing 600, such as, e.g., slot 634 in end walls 610, 612. In combination, friction lock 930 and the slot retain latch 900 in a closed or locked position, thereby keeping a mating connector securely locked to electrical connector 2, provide lateral stability to latch 900, and resist lateral forces and forces in insertion direction A, e.g., when an electrical cable attached to the mating connector is pulled. In at least one embodiment, friction lock 930 is substantially U-shaped and the slot has a corresponding shape.

Hinge arms 906 are configured to eject the mating connector through a pair of corresponding spaced apart latch openings 614, 616 extending through bottom wall 602 and through side walls 606, 608 of connector housing 600. In at least one embodiment, hinge arms 906 include an actuation surface 914 configured such that when the mating connector is inserted in connector housing 600, latch 900 pivots to a locked or closed position. To accommodate this pivoting motion, in at least one embodiment, actuation surface 914 is substantially planar, which in at least one aspect increases the leverage when pushing down on hinge arms 906. Advantageously, the presence of first and second latches 900 provides a total of four areas of actuation, which provides a greater bearing surface, and enables an even ejection and less binding during ejection of a mating connector. In at least one embodiment, hinge arms 906 are configured such that when latch 900 pivots to an open position, hinge arms 906 extend beyond a mating face of connector housing 600, which, in at least one aspect, enables ejection of a mating connector. In at least one embodiment, hinge arms 906 have a thickness substantially equal to a depth of latch openings 614, 616. In at least one embodiment, hinge arms 906 have a width substantially equal to a thickness of bottom wall 602. In at least one aspect, these thickness and width configurations of hinge arms 906 contribute to a reduced connector size. In at least one embodiment, hinge arms 906 include a friction bump 916 disposed on an internal surface 918 thereof. Friction bump 916 is configured to frictionally engage with side surface 648 of bottom wall 602. In at least one aspect, when latch 900 is in an open position, interference between friction bump 916 and internal surface 918 prevents latch 900 from unintentionally closing, although by frictionally engaging friction bump 916 with side surface 648, latch 900 can be intentionally closed. In at least one embodiment, hinge arms 906 include a bottom surface 920 configured such that a first portion 922 thereof is substantially parallel to bottom wall 602 when latch 900 is in a closed position, and a second portion 924 thereof is substantially parallel to bottom wall 602 when latch 900 is in an open position. In at least one aspect, when electrical connector 2 is attached to a printed circuit board, first portion 922 and second portion 924 cooperate with the printed circuit board to provide a stop position for latch 900 corresponding to the closed position and the open position, respectively, to help prevent damage or breakage of the latching/ejecting mechanism or the connector housing of the electrical connector during normal operation while supporting the continuing miniaturization of electrical connectors.

In at least one embodiment, latch 900 further includes a securing portion 908. Securing portion 908 extends from arm portion 904 along a third direction different than the first direction. Securing portion 908 is adapted to secure the mating connector to connector housing 600. In at least one aspect, when securing mating electrical connector 1 to connector housing 600, securing portion 908 engages cover 300, specifically first and second cover latches 304, 306, of mating electrical connector 1. In at least one embodiment, securing portion 908 is adapted to additionally secure a strain relief, such as, e.g., strain relief 500, to connector housing 600. In at least one aspect, opening 516 of strain relief 500 receives securing portion 908 to secure strain relief 500 to connector housing 600 of electrical connector 2, as best illustrated in FIG. 2. In at least one embodiment, the third direction is parallel to the second direction. In at least one embodiment, securing portion 908 includes a connector engagement surface 932 substantially perpendicular to arm portion 904. In at least one embodiment, securing portion 908 includes a rounded end 934. In at least one aspect, these configurations of securing portion 908 ensure proper engaging and securing of the mating connector and, when present, the strain relief.

In at least one embodiment, latch 900 further includes an actuation portion 910 extending from arm portion 904. Actuation portion 910 is adapted to actuate latch 900. In at least one aspect, actuation portion 910 allows latch 900 to be easily manually operated, e.g., moved from a closed or locked position to an open position and vice versa. For example to accommodate easy manual operation of latch 900, in at least one embodiment, a width of actuation portion 910 increases as actuation portion 910 extends from arm portion 904, and in at least one embodiment, actuation portion 910 extends from arm portion 904 along a fourth direction different than the first direction.

In at least one embodiment, a width of arm portion 904, a width of hinge portion 902, a maximum width of actuation portion 910, and a width of connector housing 600 are substantially the same. In at least one aspect, this provides a reduced overall width of a configuration of electrical connector 2 wherein latches 900 are present.

Figure 18:
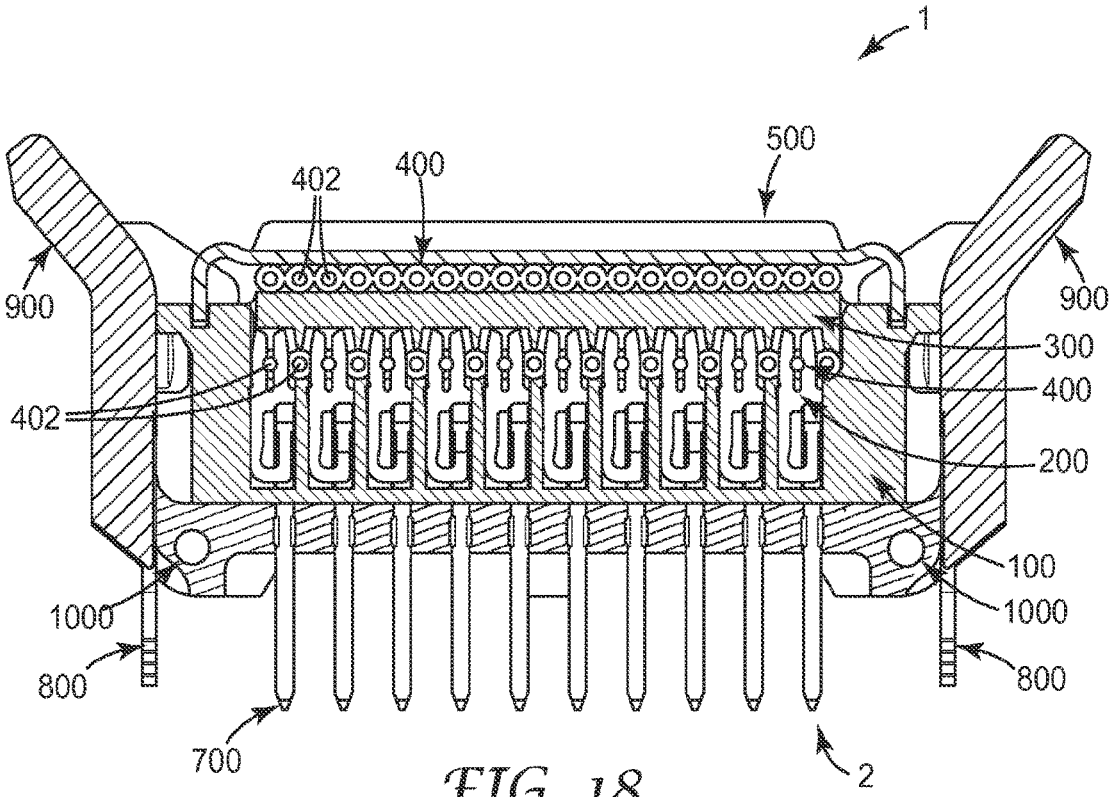
FIG. 18 is a cross-sectional view of an exemplary embodiment of an electrical connector system according to an aspect of the present disclosure in a mated configuration.

FIG. 18 illustrates mating electrical connector 1 and electrical connector 2 in a mated configuration. Specifically, it illustrates how in at least one embodiment, electrical conductors 402 of electrical cable 400 are retained between connector housing 100 and cover 300 and electrically connected to electrical contact terminals 200 supported in connector housing 100. It also illustrates how in at least one embodiment, electrical conductors 402 of electrical cable 400 are additionally retained between cover 300 and strain relief 500.

Figure 20A:
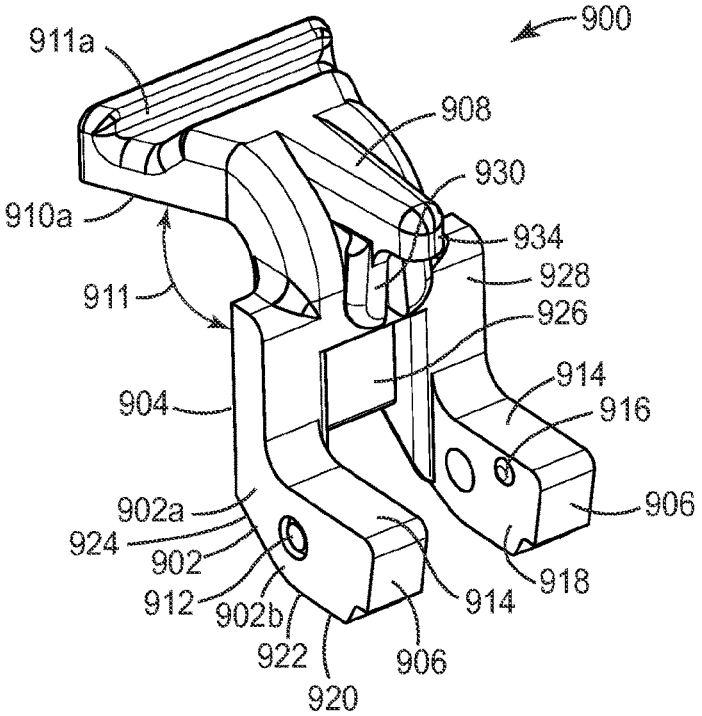
FIGS. 20*a*-20*c* are perspective, side, and top views, respectively, of another exemplary embodiment of a latch according to an aspect of the present disclosure.
Figure 20B:
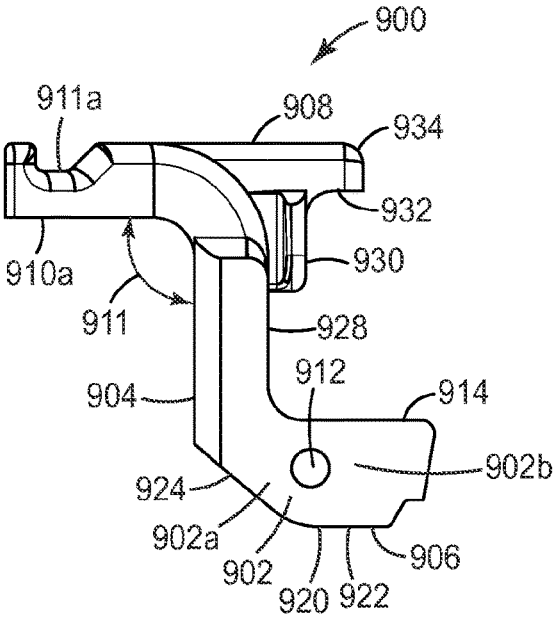
Figure 20C:
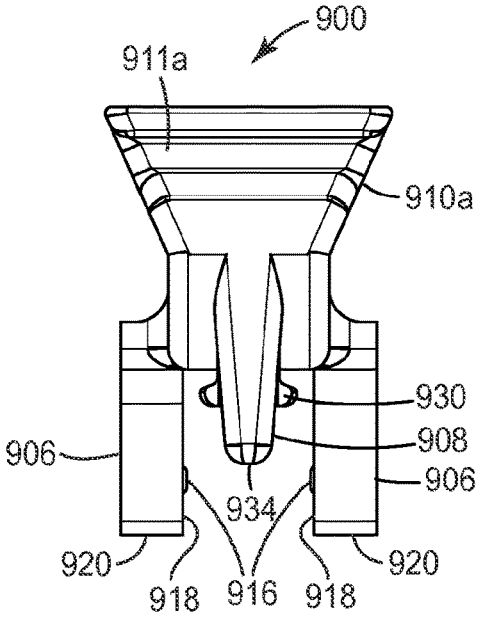

FIGS. 20*a*-20*c* illustrate an exemplary embodiment of a latch according to an aspect of the present disclosure. Referring to FIGS. 20*a*-20*c*, in at least one aspect, latch 900 is configured to secure a mating connector, such as, e.g., mating electrical connector 1, to connector housing 600, and eject a mating connector from connector housing 600. Latch 900 includes a hinge portion 902, an arm portion 904 extending from a first side 902*a* of hinge portion 902 along a first direction, a pair of discrete spaced apart hinge arms 906 extending from an opposite second side 902*b* of hinge portion 902 along a second direction different than the first direction, a securing portion 908 extending from arm portion 904 along a third direction different than the first direction, and a low profile actuation portion 910*a* extending from arm portion 904 along a fourth direction. Compared with actuation portion 910 illustrated in FIGS. 17*a*-c, actuation portion 910*a* illustrated in FIGS. 20*a*-c does not increase the overall height of the latch 900. In at least some implementations, actuation portion 910*a* is not higher than the securing portion 908.

Hinge portion 902 is configured to pivotably attach latch 900 to connector housing 600. In at least one embodiment, hinge portion 902 includes a pivot hole 912 extending therethrough in a transverse direction perpendicular to the first direction. Pivot hole 912 is configured to receive a pivot pin, such as, e.g., pivot pin 1000. In at least one aspect, in combination, pivot hole 912 of latch 900, pivot hole 640, 642 of connector housing 600, and pivot pin 1000 provide a secure free moving latch 900 and a low cost hinge mechanism.

In at least one embodiment, arm portion 904 includes a recess 926 in an internal surface 928 thereof. Recess 926 is configured to accommodate a retention clip retainer, such as, e.g., retention clip retainer 636. In at least one aspect, recess 926 provides sufficient clearance for retention clip retainer 636 such that latch 900 can be brought into a closed or locked position, e.g., as illustrated in FIG. 15, without interference from retention clip retainer 636. In at least one embodiment, arm portion 904 includes a friction lock 930 extending from an internal surface 928 thereof. Friction lock 930 is configured to frictionally engage with a slot in an end wall of connector housing 600, such as, e.g., slot 634 in end walls 610, 612. In combination, friction lock 930 and the slot retain latch 900 in a closed or locked position, thereby keeping a mating connector securely locked to electrical connector 2, provide lateral stability to latch 900, and resist lateral forces and forces in insertion direction A, e.g., when an electrical cable attached to the mating connector is pulled. In at least one embodiment, friction lock 930 is substantially U-shaped and the slot has a corresponding shape.

Hinge arms 906 are configured to eject the mating connector through a pair of corresponding spaced apart latch openings 614, 616 extending through bottom wall 602 and through side walls 606, 608 of connector housing 600. In at least one embodiment, hinge arms 906 include an actuation surface 914 configured such that when the mating connector is inserted in connector housing 600, latch 900 pivots to a locked or closed position. To accommodate this pivoting motion, in at least one embodiment, actuation surface 914 is substantially planar, which in at least one aspect increases the leverage when pushing down on hinge arms 906. Advantageously, the presence of first and second latches 900 provides a total of four areas of actuation, which provides a greater bearing surface, and enables an even ejection and less binding during ejection of a mating connector. In at least one embodiment, hinge arms 906 are configured such that when latch 900 pivots to an open position, hinge arms 906 extend beyond a mating face of connector housing 600, which, in at least one aspect, enables ejection of a mating connector. In at least one embodiment, hinge arms 906 have a thickness substantially equal to a depth of latch openings 614, 616. In at least one embodiment, hinge arms 906 have a width substantially equal to a thickness of bottom wall 602. In at least one aspect, these thickness and width configurations of hinge arms 906 contribute to a reduced connector size. In at least one embodiment, hinge arms 906 include a friction bump 916 disposed on an internal surface 918 thereof. Friction bump 916 is configured to frictionally engage with side surface 648 of bottom wall 602. In at least one aspect, when latch 900 is in an open position, interference between friction bump 916 and internal surface 918 prevents latch 900 from unintentionally closing, although by frictionally engaging friction bump 916 with internal side surface 648, latch 900 can be intentionally closed. In at least one embodiment, hinge arms 906 include a bottom surface 920 configured such that a first portion 922 thereof is substantially parallel to bottom wall 602 when latch 900 is in a closed position, and a second portion 924 thereof is substantially parallel to bottom wall 602 when latch 900 is in an open position. In at least one aspect, when electrical connector 2 is attached to a printed circuit board, first portion 922 and second portion 924 cooperate with the printed circuit board to provide a stop position for latch 900 corresponding to the closed position and the open position, respectively, to help prevent damage or breakage of the latching/ejecting mechanism or the connector housing of the electrical connector during normal operation while supporting the continuing miniaturization of electrical connectors.

In at least one embodiment, latch 900 further includes a securing portion 908. Securing portion 908 extends from arm portion 904 along a third direction different than the first direction. Securing portion 908 is adapted to secure the mating connector to connector housing 600. In at least one aspect, when securing mating electrical connector 1 to connector housing 600, securing portion 908 engages cover 300, specifically first and second cover latches 304, 306, of mating electrical connector 1. In at least one embodiment, securing portion 908 is adapted to additionally secure a strain relief, such as, e.g., strain relief 500, to connector housing 600. In at least one aspect, opening 516 of strain relief 500 receives securing portion 908 to secure strain relief 500 to connector housing 600 of electrical connector 2, as best illustrated in FIG. 2. In at least one embodiment, the third direction is parallel to the second direction. In at least one embodiment, securing portion 908 includes a connector engagement surface 932 substantially perpendicular to arm portion 904. In at least one embodiment, securing portion 908 includes a rounded end 934. In at least one aspect, these configurations of securing portion 908 ensure proper engaging and securing of the mating connector and, when present, the strain relief.

In at least one embodiment, latch 900 further includes an actuation portion 910*a* extending from arm portion 904. Actuation portion 910*a* is adapted to actuate latch 900. In at least one aspect, actuation portion 910*a* allows latch 900 to be easily manually operated, e.g., moved from a closed or locked position to an open position and vice versa. For example to accommodate easy manual operation of latch 900, in at least one embodiment, a width of actuation portion 910 increases as actuation portion 910*a* extends from arm portion 904, and in at least one embodiment, actuation portion 910*a* extends from arm portion 904 along a fourth direction different than the first direction. In some embodiments, actuation portion 910*a* is adapted to be pushed by a user to actuate the latch. In some cases, actuation angle 911 between arm portion 904 and actuation portion 910*a* is equal to or less than 90°. In at least one embodiment, actuation angle 911 is equal to 90°. In some cases, the fourth direction is parallel to the second direction. In some embodiments, actuation portion 910*a* includes recessed actuation portion 911*a* on its outer surface that allows easy operations. For example, a user can push on recessed actuation portion 911 a to eject latch 900. In at least some implementations, the addition of actuation portion 910*a* does not increase the overall height of latch 900.

In at least one embodiment, a width of arm portion 904, a width of hinge portion 902, a maximum width of actuation portion 910*a*, and a width of connector housing 600 are substantially the same. In at least one aspect, this provides a reduced overall width of a configuration of electrical connector 2 wherein latches 900 are present.

Figure 21:
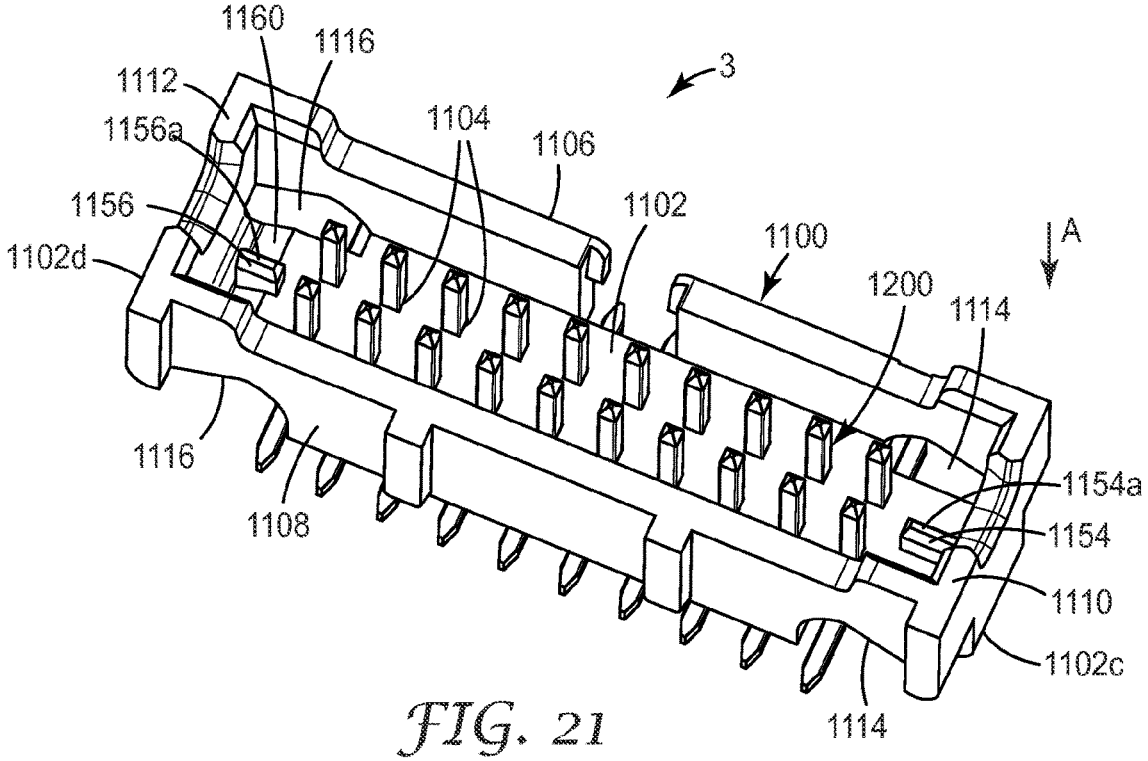
FIG. 21 is a perspective view of another exemplary embodiment of an electrical connector according to an aspect of the present disclosure.

FIG. 21 illustrates another exemplary embodiment of an electrical connector according to an aspect of the present disclosure. Referring to FIG. 21, electrical connector 3 is similar to electrical connector 2 illustrated, e.g., in FIG. 15. Electrical connector 3 includes an insulative connector housing 1100. Connector housing 1100 includes a longitudinal bottom wall 1102 defining a plurality of contact openings 1104 for receiving a plurality of contacts 1200, first and second side walls 1106, 1108 extending upwardly from bottom wall 1102 at opposing sides 1102*a*, 1102*b* (FIG. 22*a*) of bottom wall 1102, first and second end walls 1110, 1112 extending upwardly from bottom wall 1102 at opposing ends 1102*c*, 1102*d* of bottom wall 1102, first and second pairs of latch openings 1114, 1116 at opposing ends 1102*c*, 1102*d* of bottom wall 1102. Each latch opening extends through bottom wall 1102 and through a side wall and is configured to allow a latch, such as, e.g., latch 900, to eject a mating connector, such as, e.g., mating electrical connector 1, by moving within the opening. In at least one embodiment, electrical connector 3 includes a plurality of contacts 1200 extending through contact openings 1104 in insertion direction A. In at least one embodiment, contacts 1200 are through-hole type contacts, and as such can be either solder type contacts or press-fit type contacts. In at least one aspect, through-hole type contacts are configured for insertion and attachment in electrically conductive vias in a substrate, such as, e.g., a printed circuit board (not shown), to mechanically and electrically connect electrical connector 3 to the substrate. In at least one embodiment, contacts 1200 are surface mount type contacts. In at least one aspect, surface mount type contacts are configured for placement and attachment on electrically conductive pads on a substrate, such as, e.g., a printed circuit board (not shown), to mechanically and electrically connect electrical connector 3 to the substrate.

Electrical connector 3 is different from electrical connector 2 in at least the following aspects. Connector housing 1100 includes first and second protrusions 1154, 1156 extending upwardly from bottom wall 1102 and disposed between respective first and second pairs of latch openings 1114, 1116. Each of the protrusions is configured to engage a corresponding opening in a latch of a mating connector cover, such as, e.g., first and second cover latches 304, 306 of cover 300, or a latch of a strain relief, such as, e.g., first and second strain relief latches 1306 of strain relief 1300 (FIG. 23), assembled to the electrical connector.

Figure 22A:
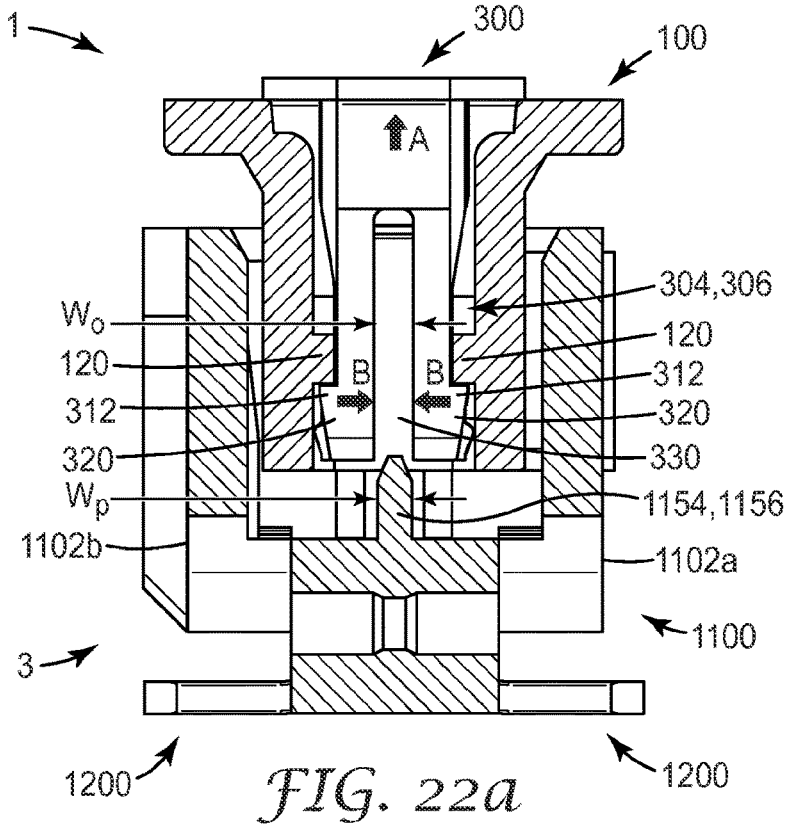
FIGS. 22*a*-22*b* are cross-sectional views of another exemplary embodiment of an electrical connector system according to an aspect of the present disclosure in an unmated configuration and in a mated configuration, respectively.
Figure 22B:
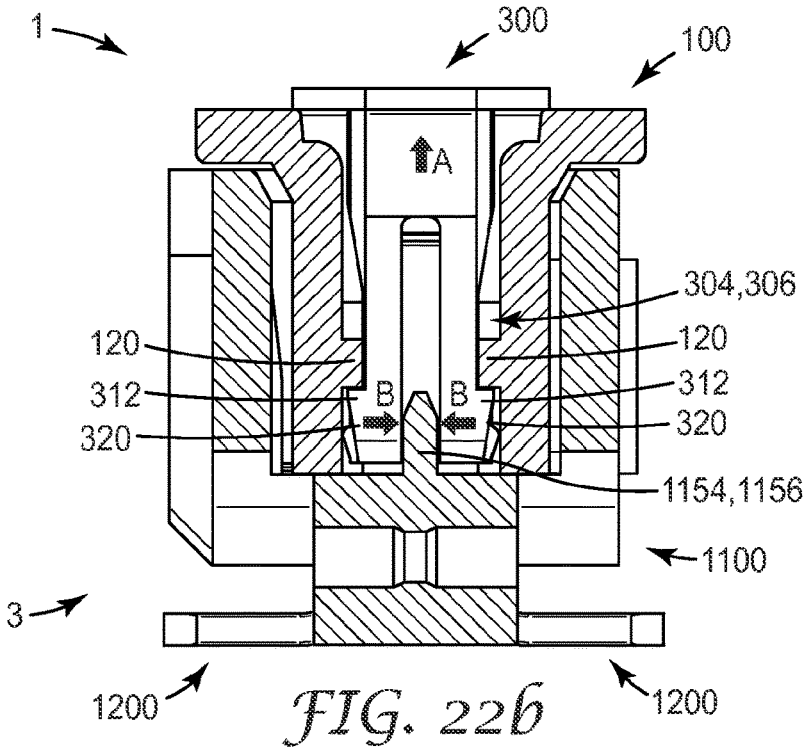

In at least one aspect, by engaging a corresponding opening in a latch of a mating connector cover, the protrusions prevent the latches from disengaging when the mating connector cover is assembled to the electrical connector, e.g., when subjected to an external force, such as, e.g., a pulling force on the cable attached to the mating connector. An example of this advantage of the protrusions is illustrated in FIGS. 22*a* and 22*b*, which illustrate an exemplary embodiment of an electrical connector system according to an aspect of the present disclosure in an unmated configuration and in a mated configuration, respectively. In an unmated configuration (FIG. 22*a*) or in a mated configuration without protrusions 1154, 1156, opposing latch arms 320 of cover latches 304, 306 of cover 300 are able to move toward each other, e.g., when an external force A is applied to mating connector 1 and results in inward forces B. As a result, first catch portions 312 of cover latches 304, 306 may disengage from end portions 120 of ridges 110 of connector housing 100, and, as a result, cover 300 may disengage from connector housing 100. In contrast, in a mated configuration with protrusions 1154, 1156 (FIG. 22*b*), protrusions 1154, 1156 prevent opposing latch arms 320 of cover latches 304, 306 of cover 300 from moving toward each other, e.g., when an external force A is applied to mating connector 1 and results in inward forces B. As a result, first catch portions 312 of cover latches 304, 306 remain engaged with end portions 120 of ridges 110 of connector housing 100, and, as a result, cover 300 remains engaged with connector housing 100. In at least one aspect, protrusions 1154, 1156 have the effect of increasing the force required to forcibly remove cover 300 from connector housing 100, because rather than first catch portions 312 disengaging from end portions 120, these features will need to break and shear before cover 300 can be removed from connector housing 100.

In at least one embodiment, first and second protrusions 1154, 1156 have a chamfered end 1154*a*, 1156*a*, as best illustrated in FIG. 21. Chamfered ends 1154*a*, 1156*a* are configured to assist with alignment of the mating connector cover or strain relief during assembly. In at least one aspect, this alignment mainly is in a lateral direction. In at least one embodiment, first and second protrusions 1154, 1156 have a substantially rectilinear, such as, e.g., rectangular, shape. In at least one embodiment, first and second protrusions 1154, 1156 have a substantially curvilinear, such as, e.g., rounded or curved, shape. In other embodiments, first and second protrusions 1154, 1156 may have any shape or length suitable for the intended application.

Referring to FIG. 22*a*, in at least one aspect of the present disclosure, cover 300 includes an opening 330 configured to receive a corresponding protrusion of a connector housing, such as, e.g., first and second protrusions 1154, 1156 of connector housing 1100. In at least one embodiment, opening 330 is disposed in first and second cover latches 304, 306 of cover 300. In at least one embodiment, first and second protrusions 1154, 1156 have a width $W_P$ that is smaller than a width $W_o$ of corresponding opening 330. Stated differently, opening 330 has a width Wo that is larger than a width $W_P$ of corresponding protrusion 1154, 1156. In this first case, opposing latch arms 320 are able to move toward each other, e.g., when an external force A is applied to mating connector 1 and results in inward forces B, but only until they abut first and second protrusions 1154, 1156. In at least one embodiment, first and second protrusions 1154, 1156 have a width $W_P$ that is substantially equal to a width $W_o$ of corresponding opening 330. Stated differently, opening 330 has a width $W_o$ that is substantially equal to a width $W_P$ of corresponding protrusion 1154, 1156. In this second case, opposing latch arms 320 are not able to move toward each other, e.g., when an external force A is applied to mating connector 1 and results in inward forces B. In at least one embodiment, first and second protrusions 1154, 1156 have a width $W_P$ that is larger than a width $W_o$ of corresponding opening 330. Stated differently, opening 330 has a width $W_o$ that is smaller than a width $W_P$ of corresponding protrusion 1154, 1156. In this third case, opposing latch arms 320 are not able to move toward each other, e.g., when an external force A is applied to mating connector 1 and results in inward forces B, and an interference between opposing latch arms 320 and first and second protrusions 1154, 1156 exists. In all three cases, first catch portions 312 of cover latches 304, 306 remain engaged with end portions 120 of ridges 110 of connector housing 100, and, as a result, cover 300 remains engaged with connector housing 100.

In at least one embodiment, first and second protrusions 1154, 1156 are connected to first and second end walls 1110, 1112, respectively. In at least one embodiment, at least one of first and second protrusions 1154, 1156 is spaced apart from first and second end walls 1110, 1112, respectively. In at least one aspect, spacing apart at least one protrusion from the corresponding end wall facilitates the injection molding process forming connector housing 1100. In at least one aspect, spacing apart the protrusion from corresponding end wall distant from the injection gate used to inject molten polymeric material into the mold cavity changes the way the molten polymeric material flows to fill the mold cavity during the injection molding process. This change in the way the molten material flows prevents an undesirable knit line in bottom wall 1102 at the end distant from the injection gate, which makes bottom wall 1102 stronger in this area. As illustrated in FIG. 21, first protrusion 1154 is connected to first end wall 1110, and second protrusion 1156 is spaced apart from second end wall 1112. In this example, end 1102*d* of bottom wall 1102 is the end distant from the injection gate.

In at least one embodiment, bottom wall 1102 includes a recess 1160 at one end thereof configured to accommodate forming of insulative connector housing 1100. In at least one aspect, recess 1160 facilitates the injection molding process forming connector housing 1100. In at least one aspect, recess 1160 distant from the injection gate changes the way the molten polymeric material flows to fill the mold cavity during the injection molding process. This change in the way the molten material flows prevents an undesirable knit line in bottom wall 1102 at the end distant from the injection gate, which makes bottom wall 1102 stronger in this area. As illustrated in FIG. 21, recess 1160 includes a ramped surface and is positioned at end 1102*d* of bottom wall 1102. In this example, end 1102*d* of bottom wall 1102 is the end distant from the injection gate. Recess 1160 may have any suitable shape and size.

Figure 23:
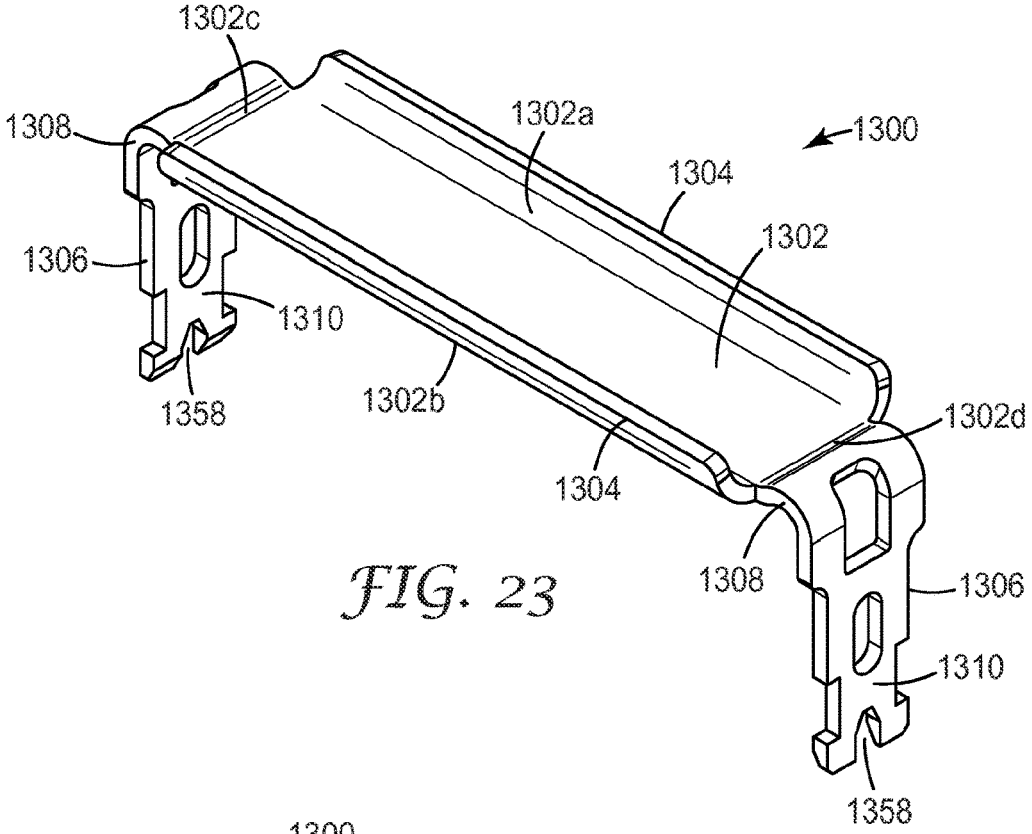
FIG. 23 is a perspective view of another exemplary embodiment of a strain relief according to an aspect of the present disclosure.

FIG. 23 illustrates another exemplary embodiment of a strain relief according to an aspect of the present disclosure. Referring to FIG. 23, strain relief 1300 is similar to strain relief 500 illustrated, e.g., in FIGS. 11*a*-11*b*. Strain relief 1300 includes a longitudinal base portion 1302 and first and second opposing strain relief latches 1306 extending from opposing lateral sides 1302*c*, 1302*d* of base portion 1302. Each strain relief latch 1306 includes a curved connecting portion 1308 extending from a lateral side 1302*c*, 1302*d* of base portion 1302 first curving upwardly and then curving downwardly and terminating at an arm portion 1310 that extends downwardly. Arm portion 1310 is configured to resiliently deflect outwardly to accommodate secure attachment of strain relief 1300 to an electrical connector. In at least one embodiment, similar to strain relief 500, longitudinal base portion 1302 includes curved side portions 1304 extending upwardly from opposing longitudinal sides 1302*a*, 1302*b* thereof.

Figure 24:
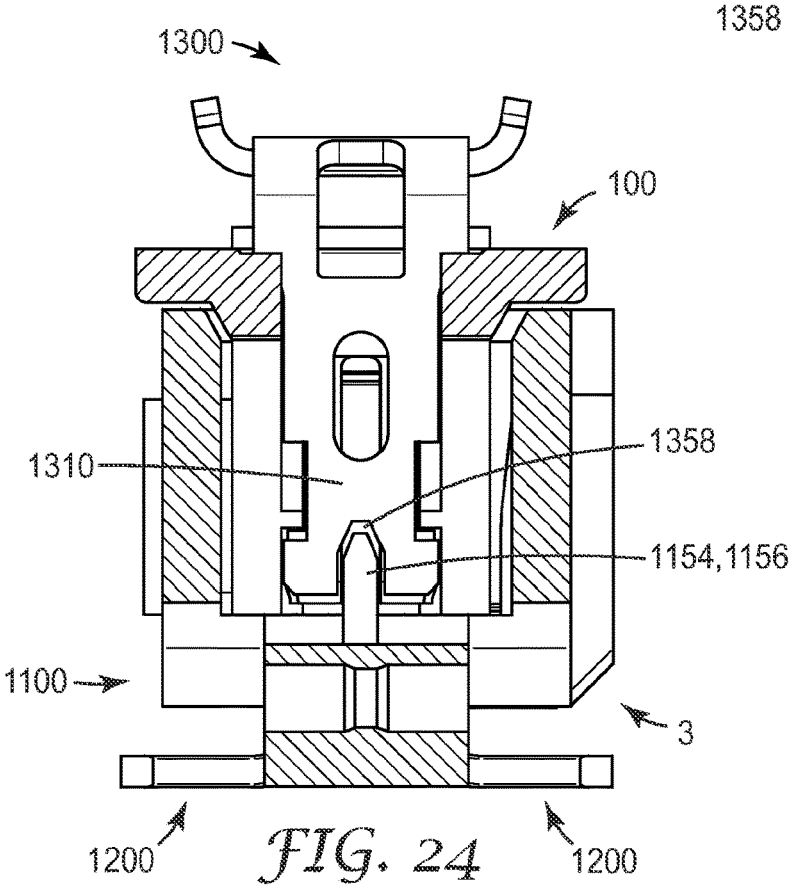
FIG. 24 is a cross-sectional view of an exemplary embodiment of a strain relief and an electrical connector according to an aspect of the present disclosure in an assembled configuration.

Strain relief 1300 is different from strain relief 500 in at least the following aspect. Arm portion 1310 includes an opening 1358 configured to receive a corresponding protrusion of an insulative connector housing, such as, e.g., first and second protrusions 1154, 1156 of connector housing 1100, of the electrical connector. In at least one aspect, openings 1358 prevent interference between arm portions 1310 of strain relief 1300 and first and second protrusions 1154, 1156 of connector housing 1100. This advantage of the presence of openings 1358 is illustrated in FIG. 24, which illustrates an exemplary embodiment of a strain relief and an electrical connector according to an aspect of the present disclosure in an assembled configuration. As illustrated in FIG. 24, strain relief 1300, assembled to connector housing 100, is assembled to electrical connector 3, including connector housing 1100 and a plurality of contacts 1200. In at least one embodiment, as illustrated in FIG. 24, opening 1358 is larger than the corresponding protrusion 1154, 1156. In at least one embodiment, as illustrated in FIG. 24, opening 1358 has a shape substantially corresponding to a shape of the corresponding protrusion 1154, 1156. Both this relative size and shape provide clearance between the opening and the corresponding protrusion. In at least one aspect, component manufacturing and assembly tolerances are taken into consideration to determine this relative size and shape.

Insulation displacement contact (IDC) connectors are typically designed to accommodate a plurality of substantially identical insulated conductors or wires. Because these wires are substantially identical, the IDC contacts for terminating the wires and any means in the connector for positioning the wires can therefore be substantially identical as well. However, the ongoing demand for cables that have improved characteristics, for example in the areas of mechanical performance, electrical performance, and cable density, has led to cable designs that include wires that have different wire gauges (defined, e.g., in AWG). Although a large difference in wire gauges generally would require different IDC terminal designs to accommodate these gauges, IDC terminals are generally designed to terminate wires in a predetermined range of consecutive wire gauges, such as, e.g., a span of two to six consecutive gauges. Therefore, a connector with a plurality of substantially identical IDC terminals should be able to properly terminate a plurality of wires that have different wire gauges within a predetermined range of consecutive wire gauges. However, this may not be the case if these wires are not properly positioned for termination. Proper positioning of an arrangement of wires that have different gauges and in particular an arrangement of insulated wires and non-insulated wires, such as, e.g., drain wires, may be challenging using conventional IDC connectors. For example, in an arrangement of insulated wires and non-insulated wires, the non-insulated wires have no insulation and therefore have a much smaller outer diameter than the insulated wires. As a result, while the insulated wires may properly terminate, the non-insulated wires may not get pressed far enough into the IDC terminals to make a reliable connection. In addition, the difference in outer diameter may cause improper support of the non-insulated wires by the connector, which may result in inadequate protection from movement of the wires, e.g., when in use. Movement of the wires may translate into movement or stress of the wires in the IDC terminals and result in failure of the electrical connection between the wires and the IDC terminals. This may also occur in an arrangement of wires that have different gauges.

In at least one aspect, the present disclosure provides an IDC connector that includes wire positioning features or wire positioning openings at least one of which is vertically offset relative to at least one other. In at least one aspect, these features or openings position insulated wires and non-insulated wires, or wires that have different gauges, substantially on the same horizontal plane. This allows the IDC terminals to remain substantially identical and positioned at substantially the same vertical height in the connector, which may reduce the cost of the connector. In addition, this provides proper support of all the wires, resulting in adequate protection from movement or stress of the wires in the IDC terminals.

Figure 25:
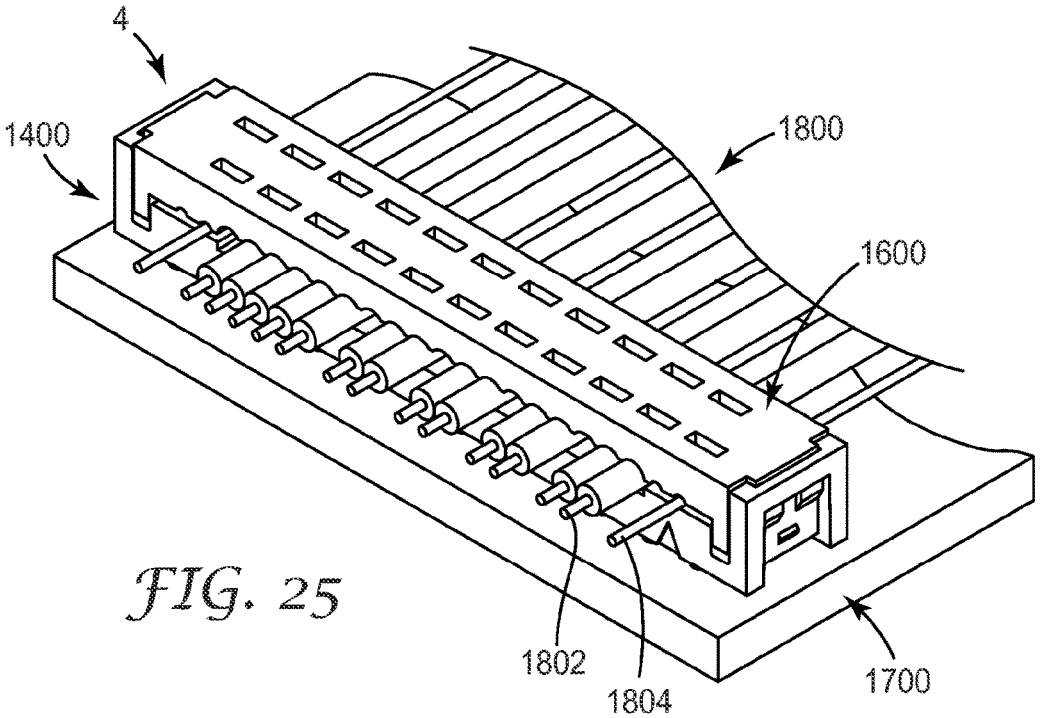
FIG. 25 is a partial perspective view of an embodiment of an electrical connector according to an aspect of the present disclosure.
Figure 26:
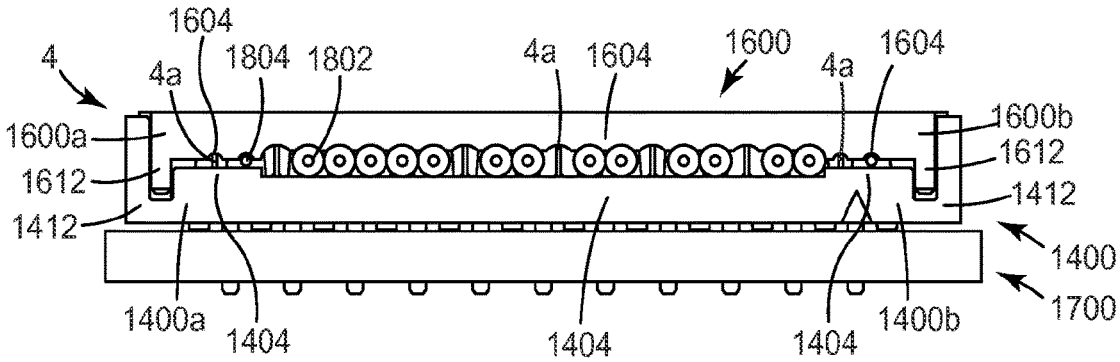
FIG. 26 is a front view of the electrical connector of FIG. 25.

FIGS. 25-28*b* illustrate an embodiment of an electrical connector according to an aspect of the present disclosure. Electrical connector 4 includes an insulative longitudinal base 1400 defining a plurality of contact openings 1402. Contact openings 1402 may be discrete spaced apart contact openings, and extend in base 1400 in a vertical direction. Contact openings 1402 are configured to support a plurality of insulation displacement contact (IDC) terminals 1500. Base 1400 includes a plurality of first wire positioning features 1404 disposed on a top surface 1406 thereof. First wire positioning features 1404 are positioned near contact openings 1402. Electrical connector 4 also includes an insulative longitudinal cover 1600 disposed on base 1400. Cover 1600 includes a plurality of second wire positioning features 1604, disposed on a bottom surface 1606 thereof. The plurality of first wire positioning features 1404 and the plurality of second wire positioning features 1604 define pairs of wire positioning features along the vertical direction. Each pair of wire positioning features is adapted to receive and position a wire, such as, e.g., insulated wire 1802 or non-insulated wire 1804 of cable 1800. Each pair of wire positioning features includes a first wire positioning feature 1404 and a corresponding second wire positioning feature 1604. In at least one embodiment, each pair of wire positioning features includes wire positioning features adapted to receive and position a wire in a horizontal direction. For example, when placing wires into wire grooves 1608, 1610, the sides of the wire grooves receive and position the wires in a horizontal direction such as to position them at the appropriate spacing (pitch) for termination to corresponding IDC terminals. At least one wire positioning feature disposed on one of top surface 1406 and bottom surface 1606 is vertically offset relative to at least one other wire positioning feature disposed on the same surface. As best illustrated in FIG. 26, in at least one embodiment, each first wire positioning feature 1404 is in registration with the corresponding second wire positioning feature 1604.

Figure 27:
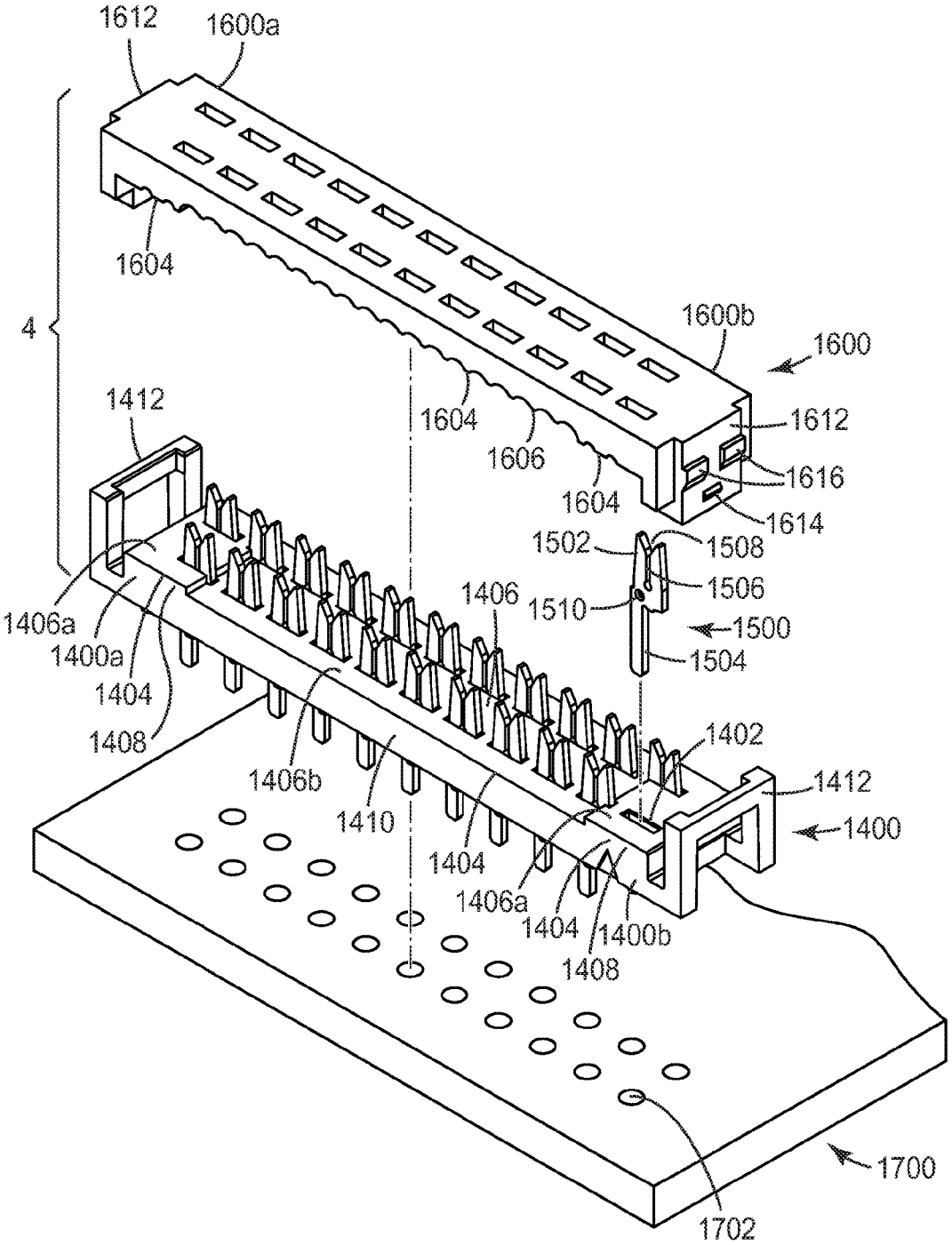
FIG. 27 is a partially exploded perspective view of the electrical connector of FIG. 25.

In at least one embodiment, electrical connector 4 includes a plurality of IDC terminals 1500. Each IDC terminal 1500 is disposed in a corresponding contact opening 1402 of base 1400. Each IDC terminal 1500 is adapted to make contact with a conductive core of a wire, such as, e.g., insulated wire 1802 or non-insulated wire 1804 of cable 1800, received and positioned in a pair of wire positioning features corresponding to the contact opening. IDC terminals 1500 each have a contact portion 1502 adapted to make contact with a conductive core of a wire. In at least one aspect, this contact is both mechanical and electrical. To facilitate receiving and securing a wire, contact portion 1502 may have a slot 1506 with a lead-in 1508, e.g., as illustrated in FIG. 27. Slot 1506 may have any shape and size suitable to receive and secure wires that have a wire gauge within a predetermined range. Lead-in 1508 may have any shape and size suitable to receive and guide these wires. IDC terminals each have a terminal portion 1504 adapted for termination to a substrate 1700, such as, e.g., a printed circuit board. Terminal portion 1504 is configured to define the IDC terminal type. In at least one embodiment, IDC terminals 1500 are through-hole type terminals, and as such can be either solder type terminals or press-fit type terminals. In at least one aspect, through-hole type terminals are configured for insertion and attachment in electrically conductive vias in a substrate, such as, e.g., vias 1702 in substrate 1700, to mechanically and electrically connect electrical connector 4 to the substrate. In at least one embodiment, IDC terminals 1500 are surface mount type terminals. In at least one aspect, surface mount type terminals are configured for placement and attachment on electrically conductive pads on a substrate (not shown) to mechanically and electrically connect electrical connector 4 to the substrate.

In at least one embodiment, the pairs of wire positioning features 1404, 1604 form a single linear row of pairs of wire positioning features. An example of this is illustrated in FIGS. 25-28*b*. In this example, this single linear row of pairs of wire positioning features extends along the length of electrical connector 4 and corresponds to multiple linear rows of IDC terminals 1500 each row also extending along the length of electrical connector 4. To facilitate this, the plurality of contact openings 1402 forms multiple linear rows of contact openings parallel to the row of pairs of wire positioning features 1404, 1604. In at least one embodiment, this single linear row of pairs of wire positioning features corresponds to a single linear row of IDC terminals 1500. To facilitate this, the plurality of contact openings 1402 forms a single linear row of contact openings parallel to the row of pairs of wire positioning features 1404, 1604. In at least one embodiment, the pairs of wire positioning features 1404, 1604 form multiple linear rows of pairs of wire positioning features. These multiple linear rows of pairs of wire positioning features extend along the length of electrical connector 4 and correspond to multiple linear rows of IDC terminals 1500 also extending along the length of electrical connector 4. To facilitate this, the plurality of contact openings 1402 forms multiple linear rows of contact openings parallel to the rows of pairs of wire positioning features 1404, 1604. In at least one embodiment, these multiple linear rows of pairs of wire positioning features correspond to a single linear row of IDC terminals 1500. To facilitate this, the plurality of contact openings 1402 forms a single linear row of contact openings parallel to the rows of pairs of wire positioning features 1404, 1604.

In at least one embodiment, each first wire positioning feature 1404 includes a flat portion disposed on top surface 1406 of base 1400 and each second wire positioning feature 1604 includes a wire groove disposed in bottom surface 1606 of cover 1600. An example of such an embodiment is illustrated in FIGS. 25-28*b*. In other embodiments, first and second wire positioning features may include flat portions or wire grooves as suitable for the intended application, e.g., to match a predetermined wire or cable configuration. For example, in at least one embodiment, each first wire positioning feature 1404 includes a wire groove disposed in top surface 1406 of base 1400 and each second wire positioning feature 1604 includes a flat portion disposed on bottom surface 1606 of cover 1600. In at least one aspect, this effectively includes including illustrated first wire positioning features 1404 in cover 1600 and including illustrated second wire positioning features 1604 in base 1400. In at least one embodiment, each first wire positioning feature 1404 includes a flat portion disposed on top surface 1406 of base 1400 and each second wire positioning feature 1604 includes a flat portion disposed on bottom surface 1606 of cover 1600. In at least one aspect, this effectively includes including illustrated first wire positioning features 1404 in both base 1400 and cover 1600. In at least one embodiment, each first wire positioning feature 1404 includes a wire groove disposed in top surface 1406 of base 1400 and each second wire positioning feature 1604 includes a wire groove disposed in bottom surface 1606 of cover 1600. In at least one aspect, this effectively includes including illustrated second wire positioning features 1604 in both base 1400 and cover 1600.

As best illustrated in FIG. 27, in at least one embodiment, the plurality of first wire positioning features 1404 includes first planar surfaces 1406*a* on opposing longitudinal ends 1400*a*, 1400*b* of base 1400, and a second planar surface 1406*b* between first planar surfaces 1406*a*. First planar surfaces 1406*a* are elevated with respect to second planar surface 1406*b*. In at least one aspect, this elevation of first planar surfaces 1406*a* allows non-insulated wires 1804 to be properly supported by first planar surfaces 1406*a*, while insulated wires 1802 can be properly supported by second planar surface 1406*b*. In the illustrated embodiment, each first planar surface 1406*a* is configured to support two non-insulated wires 1804 (although in FIGS. 25-26 only one non-insulated wire is illustrated), and each second planar surface 1406*b* is configured to support eighteen insulated wires 1802 (although in FIGS. 25-26 only thirteen insulated wires are illustrated).

Figure 28A:
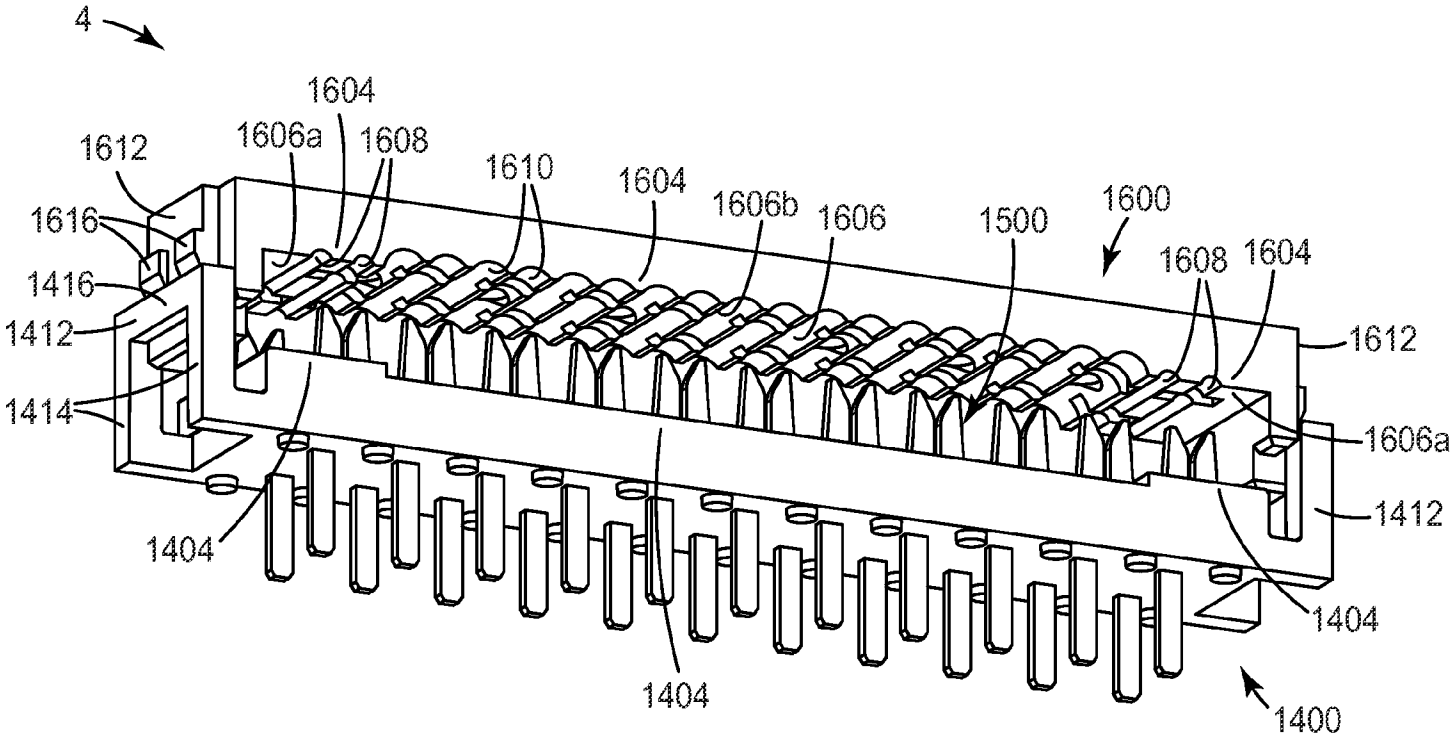
FIG. 28*a*-28*b* are perspective views of the electrical connector of FIG. 25 in an open position and in a closed position, respectively.

As best illustrated in FIG. 28*a*, in at least one embodiment, the plurality of second wire positioning features 1604 includes first planar surfaces 1606*a* on opposing longitudinal ends 1600*a*, 1600*b* of cover 1600, and a second planar surface 1606*b* between first planar surfaces 1604*a*. First planar surfaces 1606*a* are elevated with respect to second planar surface 1606*b*. In at least one aspect, this elevation of first planar surfaces 1606*a* allows non-insulated wires 1804 to be properly supported by first planar surfaces 1606*a*, while insulated wires 1802 can be properly supported by second planar surface 1606*b*. In the illustrated embodiment, each first planar surface 1606*a* is configured to support two non-insulated wires 1804, and each second planar surface 1606*b* is configured to support eighteen insulated wires 1802. In at least one embodiment and as illustrated, e.g., in FIG. 28*a*, the plurality of second wire positioning features 1604 includes a plurality of first wire grooves 1608 disposed in first planar surfaces 1606*a*, and a plurality of second wire grooves 1610 disposed in second planar surface 1606*b*. In this embodiment, first wire grooves 1608 are smaller than second wire grooves 1610, e.g., to accommodate smaller outer diameter (non-insulated) wires.

In exemplary embodiments of an electrical connector according to aspects of the present disclosure wherein the plurality of first or second wire positioning features includes a plurality of wire grooves, the plurality of wire grooves may include a plurality of first wire grooves and a plurality of second wire grooves, wherein valleys of the first wire grooves lie in a first plane and valleys of the second wire grooves lie in a second plane vertically offset from the first plane. For example, referring to FIG. 28*a*, valleys of first wire grooves 1608 lie in a first plane parallel to first planar surfaces 1606*a*, and valleys of second wire grooves 1610 lie in a second plane parallel to second planar surface 1606*b*. As best illustrated in FIG. 26, the second plane is vertically offset from the first plane. In at least one aspect, this vertical offset allows non-insulated wires 1804 or wires that have a smaller outer diameter or wire gauge to be properly supported by first wire grooves 1608, while insulated wires 1802 or wires that have a larger diameter or wire gauge can be properly supported by second wire grooves 1610.

In exemplary embodiments of an electrical connector according to aspects of the present disclosure wherein the plurality of first or second wire positioning features includes a plurality of flat portions, the plurality of flat portions may include a plurality of first flat portions and a plurality of second flat portions, wherein the first flat portions lie in a first plane and the second flat portions lie in a second plane vertically offset from the first plane. For example, referring to FIG. 27, first flat portions 1408 lie in a first plane parallel to first planar surfaces 1406*a*, and second flat portions 1410 lie in a second plane parallel to second planar surface 1406*b*. As best illustrated in FIG. 26, the second plane is vertically offset from the first plane. In at least one aspect, this vertical offset allows non-insulated wires 1804 or wires that have a smaller outer diameter or wire gauge to be properly supported by first flat portions 1408, while insulated wires 1802 or wires that have a larger diameter or wire gauge can be properly supported by second flat portions 1410.

In at least one aspect, electrical connector 4 defines a plurality of discrete spaced apart wire positioning openings 4*a* extending therein in a horizontal direction for receiving and securing a plurality of wires, such as, e.g., insulated wires 1802 and non-insulated wires 1804. In addition, electrical connector 4 defines a plurality of discrete spaced apart contact openings 1402 extending therein in a vertical direction for receiving a plurality of insulation displacement contact (IDC) terminals 1500. Each wire positioning opening 4*a* corresponds to and is in registration with a different corresponding contact opening 1402. An IDC terminal 1500 received in a contact opening 1402 is adapted to make contact with a conductive core of a wire received and secured in a wire positioning opening 4*a* corresponding to the contact opening 1402. At least one wire positioning opening 4*a* being vertically offset relative to at least one other wire positioning opening 4*a*.

In at least one embodiment, the plurality of discrete spaced apart wire positioning openings 4*a* forms a single linear first row of openings, and the plurality of discrete spaced apart contact openings 1402 forms a single linear second row of openings parallel to the first row of openings. Similar to the pairs of wire positioning features 1404, 1604, wire positioning openings 4*a* may form a single or multiple linear first row(s) of openings, and contact openings 1402 may form a single or multiple linear second row(s) of openings parallel to the single or multiple linear first row(s) of openings In at least one embodiment, bottom surface 1606 of cover 1600 faces top surface 1406 of base 1400, and for each wire positioning opening 4*a*, a portion of the wire positioning opening is defined in top surface 1406 of base 1400 and another portion of the wire positioning opening is defined in bottom surface 1606 of cover 1600.

Similar to the wire positioning features described elsewhere herein, the plurality of wire positioning openings 4*a* may include a plurality of wire grooves, and the plurality of wire grooves may include a plurality of first wire grooves and a plurality of second wire grooves, wherein valleys of the first wire grooves lie in a first plane and valleys of the second wire grooves lie in a second plane vertically offset from the first plane. Also similar to the wire positioning features described elsewhere herein, each wire positioning opening 4*a* may be adapted to receive and position a wire in a horizontal direction.

Figure 28B:
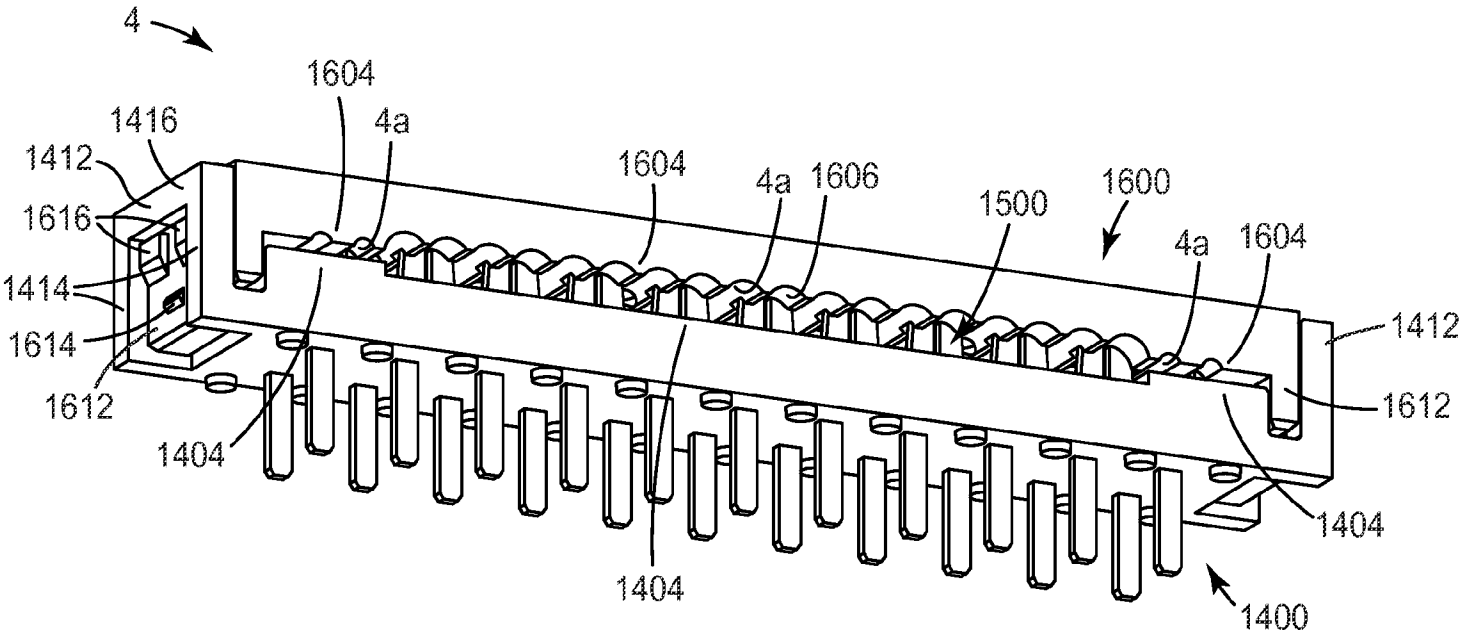

Referring now to FIGS. 28*a*-28*b*, in at least one embodiment, electrical connector 4 includes first and second cover latches 1612 and first and second base latches 1412. Cover latches 1612 extend from opposing longitudinal ends 1600*a*, 1600*b* of cover 1600 in the vertical direction. Base latches 1412 extend from opposing longitudinal ends 1400*a*, 1400*b* of base 1400 in the vertical direction. First and second cover latches 1612 are configured to engage first and second base latches 1412, respectively, to secure cover 1600 with respect to base 1400. In at least one embodiment, first and second cover latches 1612 each include first and second catch portions 1614, 1616 disposed on a side surface thereof. When first catch portions 1614 engage first and second base latches 1412, cover 1600 is retained in an open position (e.g., as shown in FIG. 28*a*), and when second catch portions 1616 engage first and second base latches 1412, cover 1600 is retained in a closed position (e.g., as shown in FIG. 28*b*). In at least one aspect, connector 4 may be provided with cover 1600 retained in an open position to an end user, who may then insert discrete wires or a cable into the connector for termination. After insertion of the discrete wires or cable into the connector, the end user may then "close" the connector by pressing cover 1600 and base 1400 together, e.g., by hand or by using a press tool, to terminate the discrete wires or cable to IDC terminals 1500 and engage second catch portions 1616 and first and second base latches 1412. In this assembled configuration, cover 1600 and base 1400 secure the terminations of the wires to the IDC terminals and protect the terminations from damage or failure, e.g., as a result of wire or cable movement when in use.

First and second catch portions 1614, 1616 may have any configuration suitable for the intended application. For example, first and second catch portions 1614, 1616 may include a single catch portion, such as, e.g., first catch portion 1614 as illustrated, or may include multiple discrete catch portions, such as, e.g., second catch portion 1616 as illustrated. First and second catch portions 1614, 1616 may have a ramp feature as illustrated to enable engagement with first and second base latches 1412. Design aspects, such as, e.g., the angle of the ramps and the height of the catch portions, may be selected to provide a suitable force required to assemble cover 1600 to base 1400, and a suitable force required to disengage cover 1600 from base 1400.

First and second base latches 1412 may have any configuration suitable for the intended application. For example, in at least one embodiment, first and second base latches 1412 each include a pair of opposing latch arms 1414 extending from base 1400 and a bridge portion 1416 connecting opposing latch arms 1414 at an end distant from base 1400. In at least one aspect, opposing latch arms 1414 function to provide resilience to the base latches and allow the base latches to resiliently move outwardly, e.g. when engaging with the cover latches. Design aspects, such as, e.g., the length, cross-section, and material of the latch arms, may be selected to provide a suitable force required to resiliently move the base latches outwardly, which impacts the force required to assemble cover 1600 to base 1400 and the force required to disengage cover 1600 from base 1400. In at least one aspect, bridge portion 1416 is configured to engage with first and second catch portions 1614, 1616. In at least one aspect, the position of first and second catch portions 1614, 1616 with respect to cover 1600 and the position of bridge portions 1416 with respect to base 1400 may be selected to provide a suitable spacing between cover 1600 and base 1400 in an open and closed position.

In at least one embodiment, first and second cover latches 1612 are configured to engage first and second base latches 1412, respectively, to position cover 1600 with respect to base 1400 in a lateral direction. For example, as illustrated, e.g., in FIGS. 28*a*-28*b*, opposing latch arms 1414 of first and second base latches may function as guides for first and second cover latches 1612 to laterally position and guide cover 1600 during its assembly to base 1400. In at least one aspect, first and second cover latches 1612 and first and second base latches 1412 may be designed to provide a stop to control the spacing between cover 1600 and base 1400 in a closed position and prevent over-terminating of the wires to the IDC terminals.

Referring to FIGS. 25-26, the type of cable 1800 used in an aspect of the present disclosure can be a single wire cable (e.g., single coaxial or single twinaxial), a plurality of single wire cables, or a multiple wire cable (e.g., multiple coaxial, multiple twinaxial, or twisted pair). Cable 1800 may consist of a plurality of discrete wires. The plurality of wires may include insulated wires and non-insulated wires, and may include wires having different design aspects, such as, e.g., core material, core configuration (e.g., stranded, solid), core diameter/size/shape, insulation material, insulation configuration (e.g., porous, hollow, solid), and insulation diameter/size/shape.

The embodiment of cable 1800 illustrated in FIGS. 25-26 includes a plurality of spaced apart conductor sets arranged generally in a single plane. Each conductor set includes a plurality of substantially parallel longitudinal insulated wires 1802. Insulated wires 1802 may include insulated signal wires, insulated power wires, or insulated ground wires. Two generally parallel shielding films (not shown) may be disposed around the conductor sets. A conformable adhesive layer (not shown) may be disposed between the shielding films to bond the shielding films to each other on both sides of each conductor set. In one embodiment, the conductor sets have a substantially curvilinear cross-sectional shape, and the shielding films are disposed around the conductor sets such as to substantially conform to and maintain the cross-sectional shape. Maintaining the cross-sectional shape maintains the electrical characteristics of the conductor sets as intended in the design of the conductor sets. This is an advantage over some conventional shielded electrical cables where disposing a conductive shield around a conductor set changes the cross-sectional shape of the conductor set.

Although in the embodiment illustrated in FIGS. 25-26, cable 1800 includes four conductor sets including two insulated wires 1802 and one conductor set including five insulated wires 1802, in other embodiments, cable 1800 may include any suitable number of conductor sets, and each conductor set may include one or more insulated wires 1802. This flexibility in arrangements of conductor sets and insulated wires 1802 allows cable 1800 to be configured suitable for the intended application. For example, the conductor sets and insulated wires 1802 may be configured to form a multiple twinaxial cable, i.e., multiple conductor sets each including two insulated wires 1802, a multiple coaxial cable, i.e., multiple conductor sets each including one insulated wire 1802, or a combination thereof. In other embodiments, a conductor set may further include a conductive shield (not shown) disposed around the one or more insulated wires 1802, and an insulative jacket (not shown) disposed around the conductive shield.

In the embodiment illustrated in FIGS. 25-26, cable 1800 further includes longitudinal non-insulated wire 1804. Non-insulated wire 1804 may include ground wires or drain wires. Non-insulated wires 1804 are spaced apart from and extend in substantially the same direction as insulated wires 1802. The conductor sets and non-insulated wires 1804 are arranged generally in a single plane. Shielding films (not shown) may be disposed around non-insulated wires 1804 and a conformable adhesive layer (not shown) may bond the shielding films to each other on both sides of non-insulated wires 1804. Non-insulated wires 1804 may electrically contact at least one of the shielding films. Although in the embodiment illustrated in FIGS. 25-26, cable 1800 includes two non-insulated wires 1804 located at the lateral ends of the cable, in other embodiments, cable 1800 may include any suitable number of non-insulated wires 1804, and non-insulated wires 1804 may be positioned in any suitable location in the cable, such as, e.g., at a lateral end of the cable or in between conductor sets.

Examples of cables that can be used with electrical connectors according to aspects of the present disclosure are shown and described in U.S. Patent Application Publication Nos. 2012/0090866 A1, 2012/0090872 A1, 2012/0097421 A1, and 2012/0090873 A1, each of which is incorporated by reference herein in its entirety.

In at least one embodiment, cable 1800 includes a shielded electrical cable including: a conductor set including one or more substantially parallel longitudinal insulated conductors; two generally parallel shielding films disposed around the conductor set; and a conformable adhesive layer disposed between the shielding films and bonding the shielding films to each other on both sides of the conductor set, a bond between the shielding films being stronger than a bond between an insulated conductor and the shielding films.

In at least one embodiment, cable 1800 includes a shielded electrical cable including: a plurality of spaced apart conductor sets, each conductor set including one or more substantially parallel longitudinal insulated conductors; at least one longitudinal ground conductor extending in substantially the same direction as the insulated conductors; two generally parallel shielding films disposed around the conductor sets and the at least one longitudinal ground conductor; a conformable adhesive layer disposed between the shielding films and bonding the shielding films to each other on both sides of each conductor set; and a plurality of longitudinal splits disposed between and separating the conductor sets.

In at least one embodiment, cable 1800 includes a shielded electrical cable including: a conductor set including one or more substantially parallel longitudinal insulated conductors; two generally parallel shielding films disposed around the conductor set and including a concentric portion substantially concentric with at least one of the conductors having a first cross-sectional area and a parallel portion wherein the shielding films are substantially parallel; and a transition portion defined by the shielding films and the conductor set and providing a gradual transition between the concentric portion and the parallel portion of the shielding films, the transition portion including a second cross-sectional area defined as an area between first transition points where the two shielding films deviate from being substantially concentric with the at least one of the conductors and second transition points where the two shielding films deviate from being substantially parallel, the second cross-sectional area being equal to or smaller than the first cross-sectional area.

In at least one embodiment, cable 1800 includes a shielded electrical cable including: a plurality of spaced apart conductor sets arranged generally in a single plane, each conductor set including one or more substantially parallel longitudinal insulated conductors; two generally parallel shielding films disposed around the conductor sets and including a plurality of concentric portions substantially concentric with at least one of the conductors having first cross-sectional areas and a plurality of parallel portions wherein the shielding films are substantially parallel; and a plurality of transition portions defined by the shielding films and the conductor sets and providing a gradual transition between the concentric portions and the parallel portions of the shielding films, the transition portions including second cross-sectional areas defined as areas between first transition points where the two shielding films deviate from being substantially concentric with the at least one of the conductors and second transition points where the two shielding films deviate from being substantially parallel, the second cross-sectional areas being equal to or smaller than the first cross-sectional areas.

In at least one embodiment, cable 1800 includes a shielded electrical cable including: a conductor set including one or more substantially parallel longitudinal insulated conductors; and two generally parallel shielding films disposed around the conductor set and including a parallel portion wherein the shielding films are substantially parallel, wherein the parallel portion is configured to electrically isolate the conductor set.

In at least one embodiment, cable 1800 includes a shielded electrical cable including: at least two spaced apart conductor sets arranged generally in a single plane, each conductor set including one or more substantially parallel longitudinal insulated conductors; and two generally parallel shielding films disposed around the conductor sets and including a parallel portion wherein the shielding films are substantially parallel, wherein the parallel portion is configured to electrically isolate adjacent conductor sets from each other.

In at least one embodiment, cable 1800 includes a shielded electrical cable including: at least one longitudinal ground conductor; an electrical article extending in substantially the same direction as the ground conductor; and two generally parallel shielding films disposed around the ground conductor and the electrical article.

In at least one embodiment, cable 1800 includes a shielded electrical cable including: two spaced apart substantially parallel longitudinal ground conductors; an electrical article positioned between and extending in substantially the same direction as the ground conductors; and two generally parallel shielding films disposed around the ground conductors and the electrical article.

In at least one embodiment, cable 1800 includes a shielded electrical cable including: a conductor set including one or more substantially parallel longitudinal insulated conductors; a shielding film including a cover portion partially covering the conductor set, and parallel portions extending from both sides of the conductor set; and a non-conductive support partially covering the conductor set opposite the cover portion of the shielding film, leaving the conductor set partially exposed.

In at least one embodiment, cable 1800 includes a shielded electrical cable including: a plurality of spaced apart conductor sets arranged generally in a single plane, each conductor set including one or more substantially parallel longitudinal insulated conductors; and a shielding film including a plurality of cover portions partially covering the conductor sets, and a parallel portion disposed between adjacent conductor sets and configured to electrically isolate the adjacent conductor sets from each other, wherein the parallel portion is positioned at a depth that is greater than about one third of the diameter of the insulated conductors.

In at least one aspect, electrical connector 4 may be assembled to cable 1800 at an end portion thereof or in a middle portion thereof as suitable for the intended application. In at least one aspect, multiple electrical connectors 4 may be assembled to a single cable 1800, and at suitable orientations, i.e., when defining a top side and opposing bottom side of cable 1800, for each connector, cover 1600 may be positioned on the top side of cable 1800 (in which case base 1400 will be positioned on the bottom side) or on the bottom side of cable 1800 (in which case base 1400 will be positioned on the top side).

The wire positioning features and wire positioning openings according to aspects of the present disclosure may be sized to accommodate wires (insulated or non-insulated) that are disposed between shielding films ("shielded wires") and wires that are not disposed between shielding films ("unshielded wires"). Shielded wires may be terminated to an IDC terminal to create an electrical connection (e.g., a ground connection) between the shielding films, the shielded wire (e.g., an insulated ground wire, a non-insulated ground wire, or a non-insulated drain wire), and the IDC terminal. This way, the shielding films can be electrically grounded via the IDC terminal. In at least one aspect, a portion of the shielding films may be removed in the IDC termination area of the wire, either at an end portion of the wire or in a middle portion of the wire, e.g., by stripping. This would effectively result in an unshielded wire in this area. This wire (e.g., an insulated signal wire, an insulated power wire, or an insulated ground wire) may then be terminated to an IDC terminal without creating an electrical connection or short to the shielding film.

Following are exemplary embodiments of an electrical connector according to aspects of the present disclosure.

Embodiment 1 is an electrical connector comprising: an insulative longitudinal base defining a plurality of contact openings extending therein in a vertical direction for supporting a plurality of insulation displacement contact (IDC) terminals, the base including a plurality of first wire positioning features disposed on a top surface thereof and positioned near the contact openings; and an insulative longitudinal cover disposed on the base and including a plurality of second wire positioning features disposed on a bottom surface thereof, wherein the plurality of first wire positioning features and the plurality of second wire positioning features define pairs of wire positioning features along the vertical direction, each pair of wire positioning features being adapted to receive and position a wire and comprising a first wire positioning feature and a corresponding second wire positioning feature, and wherein at least one wire positioning feature disposed on one of the top and bottom surfaces is vertically offset relative to at least one other wire positioning feature disposed on the same surface.

Embodiment 2 is the electrical connector of embodiment 1, wherein each first wire positioning feature is in registration with the corresponding second wire positioning feature.

Embodiment 3 is the electrical connector of embodiment 1 further comprising a plurality of IDC terminals, each IDC terminal disposed in a corresponding contact opening and adapted to make contact with a conductive core of a wire received and positioned in a pair of wire positioning features corresponding to the contact opening.

Embodiment 4 is the electrical connector of embodiment 1, wherein the pairs of wire positioning features form a single linear row of pairs of wire positioning features, and wherein the plurality of contact openings forms a single linear row of contact openings parallel to the row of pairs of wire positioning features.

Embodiment 5 is the electrical connector of embodiment 1, wherein each first wire positioning feature includes a flat portion disposed on the top surface of the base and each second wire positioning feature includes a wire groove disposed in the bottom surface of the cover.

Embodiment 6 is the electrical connector of embodiment 1, wherein each first wire positioning feature includes a wire groove disposed in the top surface of the base and each second wire positioning feature includes a flat portion disposed on the bottom surface of the cover.

Embodiment 7 is the electrical connector of embodiment 1, wherein each first wire positioning feature includes a flat portion disposed on the top surface of the base and each second wire positioning feature includes a flat portion disposed on the bottom surface of the cover.

Embodiment 8 is the electrical connector of embodiment 1, wherein each first wire positioning feature includes a wire groove disposed in the top surface of the base and each second wire positioning feature includes a wire groove disposed in the bottom surface of the cover.

Embodiment 9 is the electrical connector of embodiment 1, wherein the plurality of first wire positioning features includes first planar surfaces on opposing longitudinal ends of the base, and a second planar surface between the first planar surfaces, and wherein the first planar surfaces are elevated with respect to the second planar surface.

Embodiment 10 is the electrical connector of embodiment 1, wherein the plurality of second wire positioning features includes first planar surfaces on opposing longitudinal ends of the cover, and a second planar surface between the first planar surfaces, and wherein the first planar surfaces are elevated with respect to the second planar surface.

Embodiment 11 is the electrical connector of embodiment 10, wherein the plurality of second wire positioning features includes a plurality of first wire grooves disposed in the first planar surfaces, and a plurality of second wire grooves disposed in the second planar surface, and wherein the first wire grooves are smaller than the second wire grooves.

Embodiment 12 is the electrical connector of embodiment 1, wherein the plurality of first or second wire positioning features includes a plurality of wire grooves.

Embodiment 13 is the electrical connector of embodiment 12, wherein the plurality of wire grooves includes a plurality of first wire grooves and a plurality of second wire grooves, and wherein valleys of the first wire grooves lie in a first plane and valleys of the second wire grooves lie in a second plane vertically offset from the first plane.

Embodiment 14 is the electrical connector of embodiment 1, wherein the plurality of first or second wire positioning features includes a plurality of flat portions.

Embodiment 15 is the electrical connector of embodiment 14, wherein the plurality of flat portions includes a plurality of first flat portions and a plurality of second flat portions, and wherein the first flat portions lie in a first plane and the second flat portions lie in a second plane vertically offset from the first plane.

Embodiment 16 is the electrical connector of embodiment 1, wherein each pair of wire positioning features includes wire positioning features adapted to receive and position a wire in a horizontal direction.

Embodiment 17 is an electrical connector defining: a plurality of discrete spaced apart wire positioning openings extending therein in a horizontal direction for receiving and securing a plurality of wires; and a plurality of discrete spaced apart contact openings extending therein in a vertical direction for receiving a plurality of insulation displacement contact (IDC) terminals, each wire positioning opening corresponding to and in registration with a different corresponding contact opening, an IDC terminal received in a contact opening being adapted to make contact with a conductive core of a wire received and secured in a wire positioning opening corresponding to the contact opening, at least one wire positioning opening being vertically offset relative to at least one other wire positioning opening.

Embodiment 18 is the electrical connector of embodiment 17, wherein the plurality of discrete spaced apart wire positioning openings forms a single linear first row of openings, and wherein the plurality of discrete spaced apart contact openings forms a single linear second row of openings parallel to the first row of openings.

Embodiment 19 is the electrical connector of embodiment 17 comprising a base and a cover disposed on the base, a bottom surface of the cover facing a top surface of the base, wherein the base defines the plurality of discrete spaced apart contact openings extending therein in the vertical direction, and wherein for each wire positioning opening, a portion of the wire positioning opening is defined in the top surface of the base and another portion of the wire positioning opening is defined in the bottom surface of the cover.

Embodiment 20 is the electrical connector of embodiment 17, wherein the plurality of wire positioning openings includes a plurality of wire grooves.

Embodiment 21 is the electrical connector of embodiment 20, wherein the plurality of wire grooves includes a plurality of first wire grooves and a plurality of second wire grooves, and wherein valleys of the first wire grooves lie in a first plane and valleys of the second wire grooves lie in a second plane vertically offset from the first plane.

Embodiment 22 is the electrical connector of embodiment 17, wherein each wire positioning opening is adapted to receive and position a wire in a horizontal direction.

Embodiment 23 is the electrical connector of embodiment 1 or embodiment 17 further including first and second cover latches extending from opposing longitudinal ends of the cover in the vertical direction, and first and second base latches extending from opposing longitudinal ends of the base in the vertical direction, wherein the first and second cover latches are configured to engage the first and second base latches, respectively, to secure the cover with respect to the base.

Embodiment 24 is the electrical connector of embodiment 23, wherein the first and second cover latches each include first and second catch portions disposed on a side surface thereof, wherein when the first catch portions engage the first and second base latches, the cover is retained in an open position, and wherein when the second catch portions engage the first and second base latches, the cover is retained in a closed position.

Embodiment 25 is the electrical connector of embodiment 23, wherein the first and second base latches each include a pair of opposing latch arms extending from the base and a bridge portion connecting the opposing latch arms at an end distant from the base.

Embodiment 26 is the electrical connector of embodiment 23, wherein the first and second cover latches are configured to engage the first and second base latches, respectively, to position the cover with respect to the base in a lateral direction.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In at least one embodiment, some components, such as, e.g., latch 900 and electrically insulative components, such as, e.g., connector housing 100, cover 300, connector housing 600, connector housing 1100, base 1400, and cover 1600, are formed of a polymeric material by methods such as injection molding, extrusion, casting, machining, and the like, while other components, such as, e.g., strain reliefs 500 and 500', retention clip 800, pivot pin 1000, strain relief 1300, and electrically conductive components, such as, e.g., electrical contact terminals 200, 200', and 200", electrical conductors 402, electrical contact pins 700, contacts 1200, and IDC terminals 1500, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present disclosure. Those with skill in the mechanical, electromechanical, and electrical arts will readily appreciate that the present disclosure may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector comprising:

an insulative connector housing including a longitudinal bottom wall defining a plurality of contact openings for receiving a plurality of contacts, first and second side walls extending upwardly from the bottom wall at opposing sides of the bottom wall, first and second end walls extending upwardly from the bottom wall at opposing ends of the bottom wall, first and second pairs of latch openings at opposing ends of the bottom wall, each latch opening extending through the bottom wall and through a side wall, and first and second protrusions extending upwardly from the bottom wall and disposed between respective first and second pairs of latch openings, wherein:

each latch opening is configured to allow a latch to eject a mating connector by moving within the opening; and each of the protrusions is configured to engage a corresponding opening in a latch of a mating connector cover configured to assemble to the mating connector or a strain relief of a mating connector configured to assemble to the mating connector.

2. The electrical connector of claim 1, wherein the first and second protrusions prevent the latch of the mating connector cover from disengaging when the mating connector cover is assembled to the electrical connector.

3. The electrical connector of claim 1, wherein the latch openings are shaped to accommodate a pivoting motion of a latch.

4. The electrical connector of claim 1, wherein the latch openings extend into the bottom wall beyond the side walls.

5. The electrical connector of claim 1 further comprising first and second latches pivotably attached to the connector housing at opposing ends thereof.

6. The electrical connector of claim 1 further comprising a plurality of contacts extending through the contact openings in an insertion direction.

7. A strain relief for an electrical cable, comprising:

a longitudinal base portion; and first and second opposing strain relief latches extending from opposing lateral sides of the base portion, each latch including a curved connecting portion extending from a lateral side of the base portion first curving upwardly and then curving downwardly and terminating at an arm portion that extends downwardly, wherein the arm portion is configured to resiliently deflect outwardly to accommodate secure attachment of the strain relief to an electrical connector, and wherein the arm portion includes an opening configured to receive a corresponding protrusion of an insulative connector housing of a mating connector of the electrical connector.

8. A cover for an electrical connector, comprising:

a longitudinal body portion extending along a first direction and first and second cover latches extending from opposing longitudinal ends thereof in a second direction different than the first direction, each cover latch including:

at least one ridge disposed on a side surface thereof and extending in the second direction for guiding the cover latch along a ridge of a connector housing;

at least one first catch portion disposed on the side surface at an end distant from the body portion for being deflected by and engaging the ridge of the connector housing to secure the cover with respect to the connector housing, and an opening configured to receive a corresponding protrusion of a connector housing of a mating connector of the electrical connector.

9. The cover of claim 8, wherein the corresponding protrusion prevents the cover latch from disengaging when the cover is assembled to the electrical connector.

10. A latch for securing and ejecting a mating connector from a connector housing, comprising:

a hinge portion configured to pivotably attach the latch to a connector housing;

an arm portion extending from a first side of the hinge portion along a first direction;

a pair of discrete spaced apart hinge arms extending from an opposite second side of the hinge portion along a second direction different than the first direction; and an actuation portion extending from the arm portion along a fourth direction different than the first direction and adapted to be pushed by a user to actuate the latch, wherein the hinge arms are configured to eject the mating connector through a pair of corresponding spaced apart latch openings extending through a bottom wall and through side walls of the connector housing, and wherein an actuation angle between the arm portion and the actuation portion is equal to or less than 90°.

* * * * *